US005553560A

United States Patent [19]

Tajima et al.

[11] Patent Number: 5,553,560

[45] Date of Patent: Sep. 10, 1996

[54] SEWING MACHINE AND WORK FABRIC HOLDER DEVICE THEREOF

[75] Inventors: Ikuo Tajima; Terutada Kojima; Tomoaki Anezaki; Masayoshi Hirate; Shigeo Suzuki, all of Kasugai, Japan

[73] Assignee: Tokai Kogyo Mishin Kabushiki Kaisha, Japan

[21] Appl. No.: 319,038

[22] Filed: Oct. 6, 1994

[30] Foreign Application Priority Data

| | | | |
|---|---|---|---|
| Oct. 8, 1993 | [JP] | Japan | 5-253118 |
| Jan. 19, 1994 | [JP] | Japan | 6-004158 |
| Feb. 25, 1994 | [JP] | Japan | 6-028397 |
| Mar. 17, 1994 | [JP] | Japan | 6-047160 |
| Apr. 15, 1994 | [JP] | Japan | 6-077454 |

[51] Int. Cl.[6] ..... D05C 9/04

[52] U.S. Cl. ..... 112/103; 112/470.18; 112/309

[58] Field of Search ..... 112/470.06, 470.09, 112/470.14, 470.18, 102, 102.5, 103, 475.11

[56] References Cited

U.S. PATENT DOCUMENTS

| | | | |
|---|---|---|---|
| 4,117,790 | 10/1978 | Hasegawa et al. | 112/470.18 X |
| 5,261,338 | 11/1993 | Tajima et al. | 112/309 X |
| 5,415,116 | 5/1995 | Nishio | 112/103 |

FOREIGN PATENT DOCUMENTS

| | | | |
|---|---|---|---|
| 60-162583 | 8/1985 | Japan . | |
| 0284288 | 12/1986 | Japan | 112/63 |
| 1-239151 | 9/1989 | Japan | 112/103 |
| 1-53384 | 11/1989 | Japan . | |
| 2-251660 | 10/1990 | Japan . | |
| 4-40467 | 7/1992 | Japan . | |

*Primary Examiner*—Ismael Izaguirre
*Attorney, Agent, or Firm*—Dennison, Meserole, Pollack & Scheiner

[57] ABSTRACT

A sewing machine serves to form stitches on a curved work fabric by an upper and a lower thread through cooperation of a shuttle and a needle vertically reciprocally driven. The sewing machine includes a holder device for retaining the work fabric to be sewn. The holder device is supported by a support device and is rotatably within a plane in parallel to X axis. The support device is movable in a direction of Y axis. The X axis and the Y axis are perpendicular to each other within a plane extending substantially perpendicular to the driving direction of the needle. The holder device is rotated by an X axis drive mechanism within the plane in parallel to the X axis. The support device is moved by a Y axis drive mechanism in the direction of the Y axis. The holder device serves to retain the work fabric so as to provide a sewable area for substantially the entire circumferential surface of the work fabric.

20 Claims, 71 Drawing Sheets

SEWING MACHINE AND WORK FABRIC HOLDER DEVICE THEREOF

BACKGROUND OF THE INVENTION

1. Field of the Invention

The present invention relates to a sewing machine which is operable to form a stitch on a curved work fabric by an upper and a lower thread through cooperation of a shuttle and a needle which is vertically reciprocally driven, and particularly to a sewing machine which is suitable to embroider a cylindrical work such as a side portion of a cap or a hat. The present invention also relates to a holder device which is operable to retain the work fabric to be sewn by the sewing machine.

2. Description of the Prior Art

Japanese Patent Publication No. 4-40467 discloses a sewing machine which includes a drive mechanism (a fabric support frame in the publication) moved within a horizontal plane in both X-axis and Y-axis directions which are perpendicular to each other. A cylindrical cap frame for mounting thereon a work fabric or a cap to be embroidered is rotatable around Y-axis and is movable along Y-axis. The cap frame includes a rotary ring rotatably driven by the drive mechanism and a retainer member which is detachably mounted on the rotary ring and which has a peripheral portion on which a side portion of the cap is set. An embroidery window is formed on the retainer member, so that a part of the rim of the cap to be embroidered is positioned at the window.

With the above sewing machine, in order to provide more broader area in the circumferential direction of the side portion to be embroidered, the cap frame itself may be rotated even one revolution by the drive mechanism. However, since the embroidery window is formed on the retainer member as described above, the side portion can be embroidered at only the area corresponding to the embroidery window.

Further, in order to rotate the cap frame, Japanese Patent Publication No. 4-40467 as described above includes a rack and pinion mechanism associated with the drive mechanism. Japanese Patent Publication No. 1-53384 or Japanese Laid-Open Patent Publication No. 60-162853 discloses a link mechanism associated with a drive mechanism. Such mechanisms to rotate the cap frame are not suited to cope with the embroidery operation of the work fabric over its entire circumferential surface. Thus, as the rotational angle of the cap increases, the amount of movement required for the drive mechanism becomes larger, so that the size of the embroidery machine as well as the size of the drive mechanism in the X axis direction increases. Particularly, in case of a multi-head embroidery machine having a plurality of sewing heads, a greater distance is required between two adjacent sewing heads, so that the size of the embroidery machine becomes more larger.

Additionally, in general, when a cap is mounted on a retainer member of a cap frame of an embroidery machine for an embroidery operation, a broader embroidery area is required for embroidering the entire circumferential surface of the side portion of the cap. However, the side portion is normally spread out toward an opening, so that the cap must be mounted on the retainer member such that the central axis of the side portion is inclined relative to the rotational axis of the cap frame so as to position a part of the side portion to be embroidered in parallel to the axial direction of the retainer member or in parallel to a throat plate. For this reason, the other part of the side portion extends excessively toward the retainer member, resulting in that the sewable area of the side portion is reduced at this part.

Japanese Laid-Open Patent Publication No. 2-251660 discloses an improvement in which an annular pressing member for pressing a cap on a retainer member has a middle portion protruding toward a visor portion of the cap so as to prevent a part of a side portion of the cap adjacent the visor portion from creasing when the side portion has been pressed on the retainer member by the pressing member. This may permit such a part of the side portion to be suitably embroidered.

With this construction, however, the problem of a narrowed sewable area is still caused with respect to the other part of the rim for the same reason as previously explained.

SUMMARY OF THE INVENTION

It is, accordingly, an object of the present invention to provide a sewing machine which can sew substantially the entire circumferential surface of a work having a curved configuration such as a cylindrical configuration.

It is another object of the present invention to provide a sewing machine having an improved drive mechanism suitable for sewing substantially the entire circumferential surface of a work having a curved configuration such as a cylindrical configuration.

It is a further object of the present invention to provide a multi-head sewing machine which is suitable to sew substantially the entire circumferential surface of a work having a curved configuration and which includes a drive mechanism associated with each sewing head and permitting the sewing machine to have a smaller size.

It is a still further object of the present invention to provide a retainer device which is adapted for mounting thereon a work fabric having a curved configuration such as a cylindrical configuration and which is suitable for sewing substantially the entire circumferential surface of the work fabric by a sewing machine.

According to a first aspect of the present invention, there is provided a sewing machine for forming stitches on a curved work fabric by an upper and a lower thread through cooperation of a shuttle and a needle vertically reciprocally driven, comprising:

a holder device for retaining the work fabric to be sewn;

a support device for rotatably supporting the holder device within a plane in parallel to X axis, the support device being movable in a direction of Y-axis, the X axis and the Y axis being perpendicular to each other within a plane extending substantially perpendicular to the driving direction of the needle;

an X axis drive mechanism for rotating the holder device within the plane in parallel to the X axis; and a Y axis drive mechanism for moving the support device in the direction of Y axis;

the holder device retaining the work fabric so as to provide a sewable area for substantially the entire circumferential surface of the work fabric.

According to a second aspect of the present invention, there is provided a multi-head sewing machine comprising:

a plurality of sewing heads each operable to form stitches on a curved work fabric by an upper and a lower thread through cooperation of a shuttle and a needle vertically reciprocally driven;

a holder device and a support device associated with each of the sewing heads;

the holder device being operable to retain the work fabric to be sewn;

the support device being operable to rotatably supporting the holder device within a plane in parallel to X axis, the support device being movable in a direction of Y axis, the X axis and the Y axis being perpendicular to each other within a plane extending substantially perpendicular to the driving direction of the needle;

the holder device retaining the work fabric so as to provide a sewable area for substantially the entire circumferential surface of the work fabric;

an X axis drive mechanism for rotating each holder device within the plane in parallel to the X axis; and a Y axis drive mechanism for moving each support device in the direction of the Y axis;

the X axis drive mechanism including an X axis drive member and a motion converting mechanism, the X axis drive member being movable in the direction of the X axis, the motion converting mechanism converting the movement of the X axis drive member into rotational movement of each holder device;

the motion converting mechanism including pulleys each mounted on the holder device and cord-like members each having both ends fixed to the X axis drive member and having a middle portion passed over corresponding one of the pulleys;

the positions of passing of the cord-like members over two adjacent pulleys are displaced from each other in the direction of the Y axis.

According to a third aspect of the present invention, there is provided a holder device for holding a curved work fabric to be sewn by a sewing machine which is operable to form stitches on the curved work fabric by an upper and a lower thread through cooperation of a shuttle and a needle vertically reciprocally driven, comprising;

a retainer member having a tubular retainer surface for supporting the lower surface of the work fabric; and a pressing member for pressing the work fabric on the surface of the retainer member so as to fix the work fabric in position; and the retainer member being rotatable around a rotational axis extending substantially vertically relative to the moving direction of the needle; and the retainer member including a free forward end positioned rearwardly of the driving path of the needle.

The invention will become more apparent from the appended claims and the description as it proceeds in connection with the drawings.

DETAILED DESCRIPTION OF THE PREFERRED EMBODIMENTS

Various embodiments of the present invention will now be described with reference to the drawings.

FIRST EMBODIMENT

A first embodiment of the present invention will now be described with reference to FIGS. 1 to 6.

Figure 1:
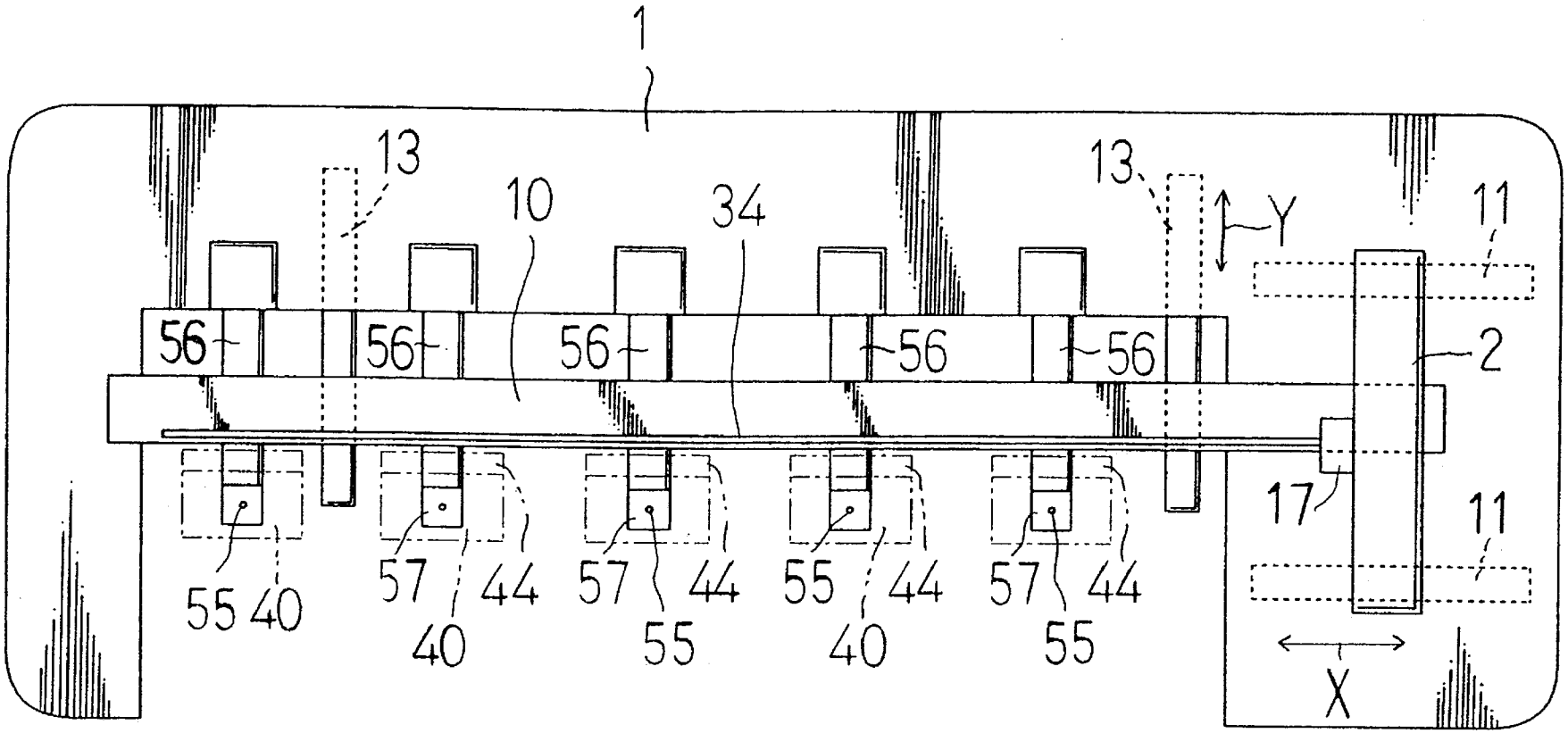
FIG. 1 is a schematic plan view of a multi-head embroidery machine according to a first embodiment of the present invention.

Referring to FIG. 1, a multi-head embroidery machine is schematically shown in plan view. Five cylindrical shuttle bases 56 are disposed below a machine table 1 and are equally spaced from each other in a longitudinal direction or lateral direction of the machine table 1, so that they are positioned below their corresponding sewing heads 50 which will be hereinafter explained. Each of the cylindrical shuttle bases 56 has an axial direction perpendicular to the lateral direction of the machine table 1. A throat plate 57 having a needle hole 55 formed therein is mounted on an upper portion of each of the shuttle bases 56.

X-axis drive devices 11 and Y-axis drive devices 13 are disposed below the machine table 1. Each of the X-axis drive devices 11 as well as each of the Y-axis drive devices 13 is constructed as a belt-type drive device having a belt driven by a pulse motor (not shown) based on data of a pattern to be sewn, so that the belts of the X-axis drive devices 11 and the Y-axis drive devices 13 are reciprocally moved in the direction of X axis and in the direction of Y axis, respectively.

An X axis drive member 2 and a Y axis drive member 10 are disposed on the machine table 1 and connected to the belts of the X-axis drive devices 11 and the Y-axis drive devices 13, respectively, so that the X axis drive member 2 and the Y axis drive member 10 are moved in the direction of X axis and the direction of Y axis, respectively, as the X-axis drive devices 11 and the Y-axis drive devices 13 are driven.

A drive rod 34 is slidably supported on the Y-axis drive member 10 via a plurality of rod supports 35 fixed to the Y-axis drive member 10. The drive rod 34 has one end connected to a drive block 17 fixed to the X axis drive member 2, so that the drive rod 34 is movable in the direction of X axis together with the X axis drive member 2 and that the drive rod 34 is movable in the direction of Y axis relative to the X axis drive member 2 as the Y axis drive member 10 is moved.

The construction of the embroidery machine will now be explained in connection with one of the sewing heads 50 and its associated shuttle bases 56 and a work fabric holder device which will be explained later. The construction of the sewing heads 50 as well as the construction of their associated mechanisms are the same with each other.

Figure 2:
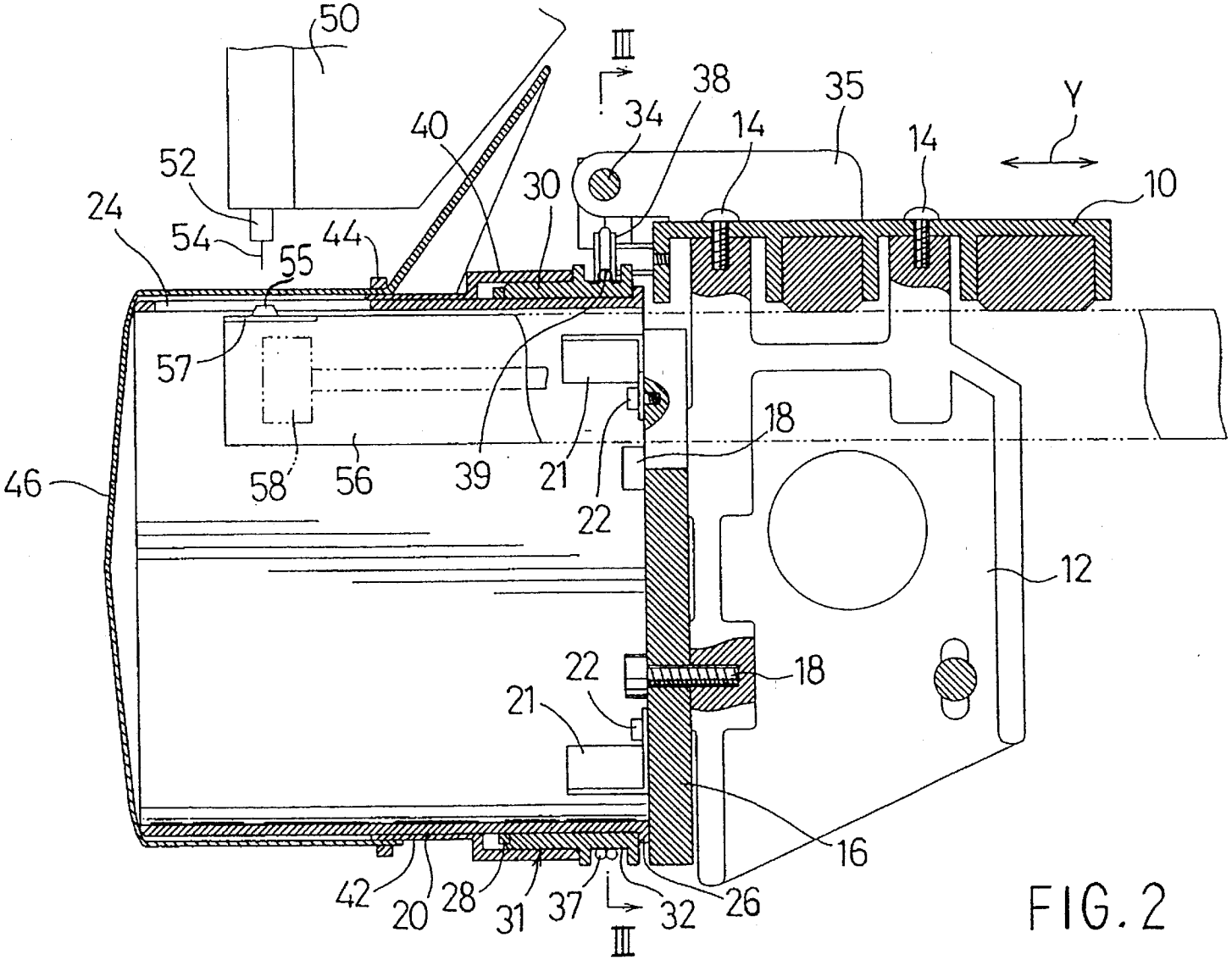
FIG. 2 is a sectional view of the essential parts of FIG. 1.
Figure 3:
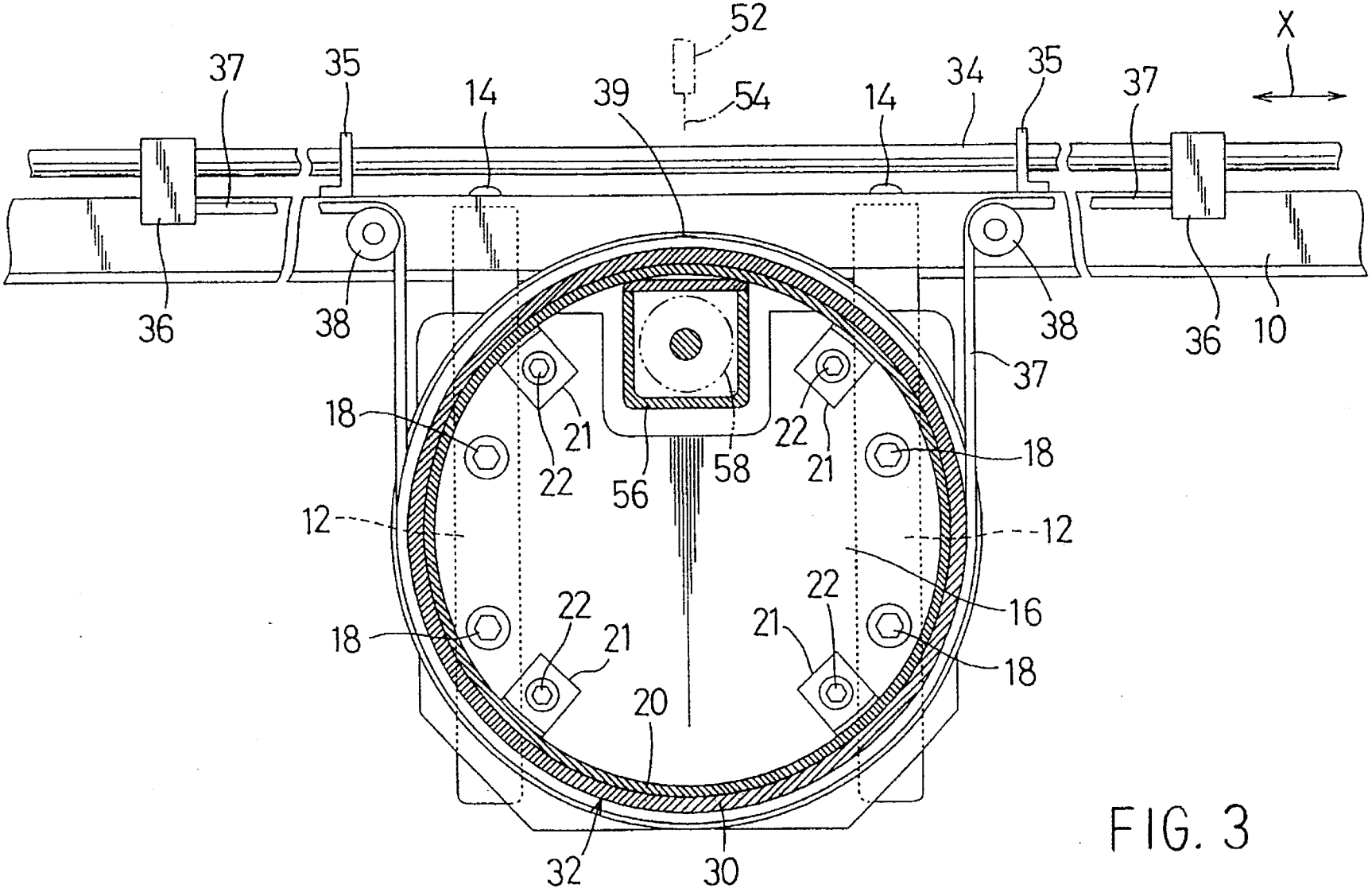
FIG. 3 is a sectional view taken along line III—III in FIG. 2.
Figure 4:
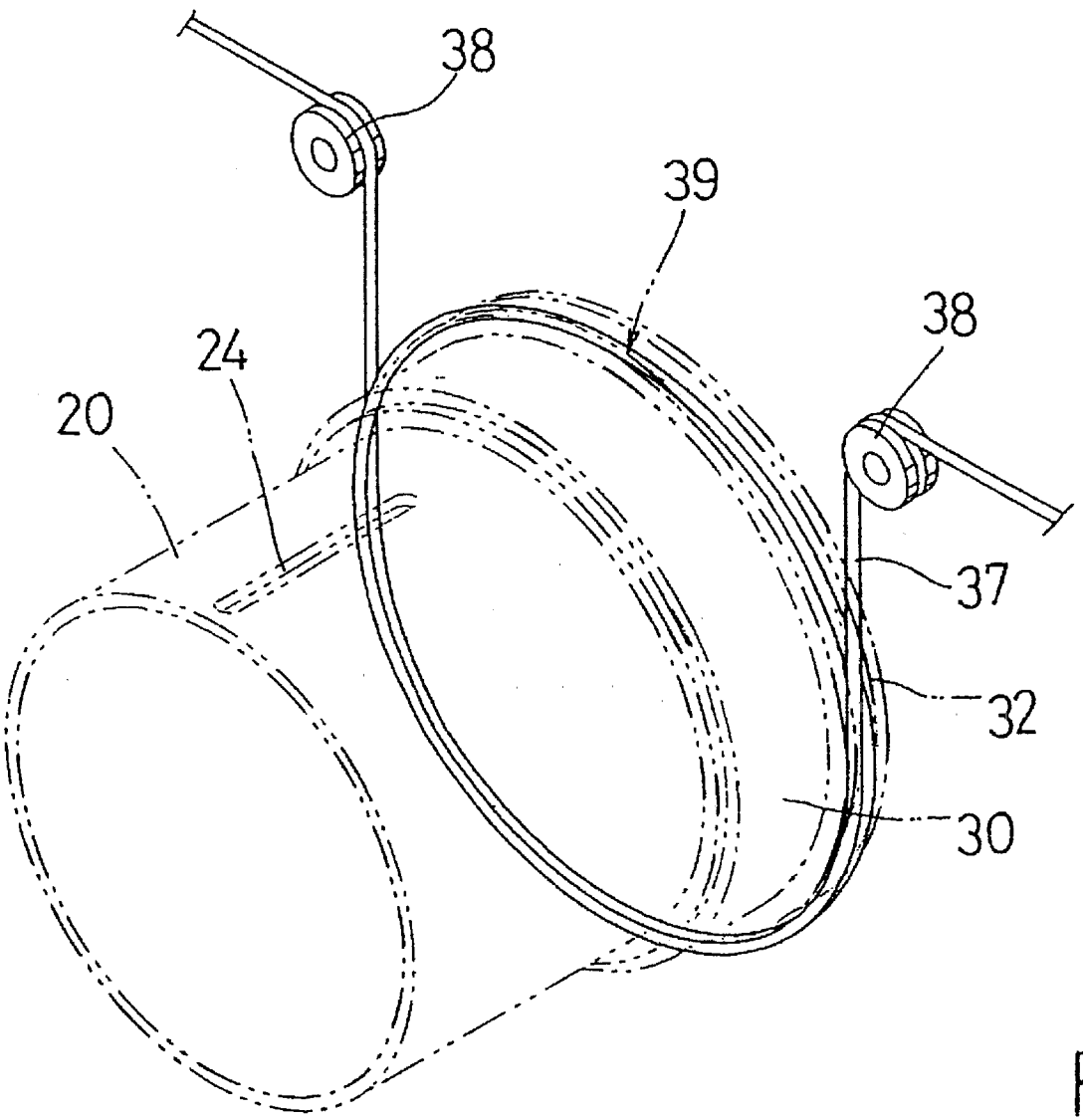
FIG. 4 is a perspective view showing a cord-like member passed over a rotary member shown in FIG. 3.

As shown in FIGS. 2 and 3, each of the sewing heads 50 includes a needle bar 52 and a sewing needle 54 attached to the lower end of the needle bar 52. The shuttle base 56 includes a shuttle 58 disposed therein and positioned below the throat plate 57. As is well known, in order to perform a sewing operation, the sewing needle 54 is vertically reciprocally moved together with the needle bar 52 while the shuttle 58 is rotatably driven synchronously with the movement of the needle bar 52 so as to form stitches, by upper and lower threads, on a part of a work fabric 46 positioned above the throat plate 57.

A pair of support bases 12 are disposed on both sides of the shuttle base 56 and are fixed to the lower surface of the X-axis drive member 10 by means of bolts 14. A plate 16 having a configuration not to interfere with the shuttle base 56 is fixed to both the front surfaces of the support bases 12 (see FIG. 3). A cylindrical support member 20 includes a rear end having a plurality of brackets 21 fixed to the inner surface thereof. The brackets 21 are fixed to the front surface of the plate 16 by means of bolts 22, so that the support member 20 is fixed to the plate 16. The support member 20 is positioned to surround the shuttle base 56 and includes an elongated needle slot 24 formed at a position above the needle hole 55 formed in the throat plate 57. The needle slot 24 permits insertion of the sewing needle 54 and has a longitudinal direction in the direction of Y axis. The length of the needle slot 24 is determined to correspond to the movable range of the Y-axis drive member 10. A flange 26 is formed with the rear end of the support member 20 and extends outwardly therefrom.

A ring-like rotary member 30 is rotatably mounted on an outer surface of the rear end of the support member 20 but is movable in the direction of Y axis together with the support member 20. Thus, the rotary member 30 is slidably fitted between the flange 26 and a stopper ring 28 fixed to the outer surface of the support member 20 so as not to move in the direction of Y axis relative to the support member 20. The rotary member 30 includes an annular recess 32 formed on a part of an outer surface thereof at a position adjacent the Y axis drive member 10. The other part of the outer surface of the rotary member 30 provides a mounting surface 31 for mounting a retainer member 40 thereon.

In order to convert the linear movement of the rod 34 into the rotational movement of the rotary member 30, a cord-like member 37 such as a wire and a steel belt is passed over the annular recess 32 and has both end portions which are passed over pulleys 38 mounted on the Y-axis drive member 10 at positions on both sides of the support member 20 and which are then connected to fixed blocks 36 fixed to the rod 34 driven by the X-axis drive member 2. Thus, as the rod 34 is moved in the direction of X axis by the X-axis drive member 2, the cord-like member 37 is moved to rotate the rotary member 30 relative to the support member 20.

The path of the cord-like member 37 is shown in FIG. 3. As will be seen from FIG. 3, the cord-like member 37 is passed over the annular recess 32 of the rotary member 30 by the length of one and half of circumferential length of the annular recess 32, so that the rotary member 30 is rotated by one and half time when the rod 34 is moved by a distance corresponding to the passed length of the cord-like member 37 over the annular recess 32. The number of time of rotation of the rotary member 30 can be selectively determined by selecting the time of passing over the rotary member 30 of the cord-like member 37 as well as the length of the cord-like member 37 moved by the rod 34, so that a helical sewing operation can be performed.

As shown in FIG. 2, the retainer member 40 having a cylindrical configuration is detachably mounted on the mounting surface 31 of the rotary member 30. The retainer member 40 includes a set surface 42 on which the work fabric 46 (a cap in this embodiment) is retained by means of a pressing ring 44. Thus, the rotary member 30, the retainer member 30 and the pressing ring 44 form a holder device for rotatably retaining the work fabric 46.

Figure 5A:
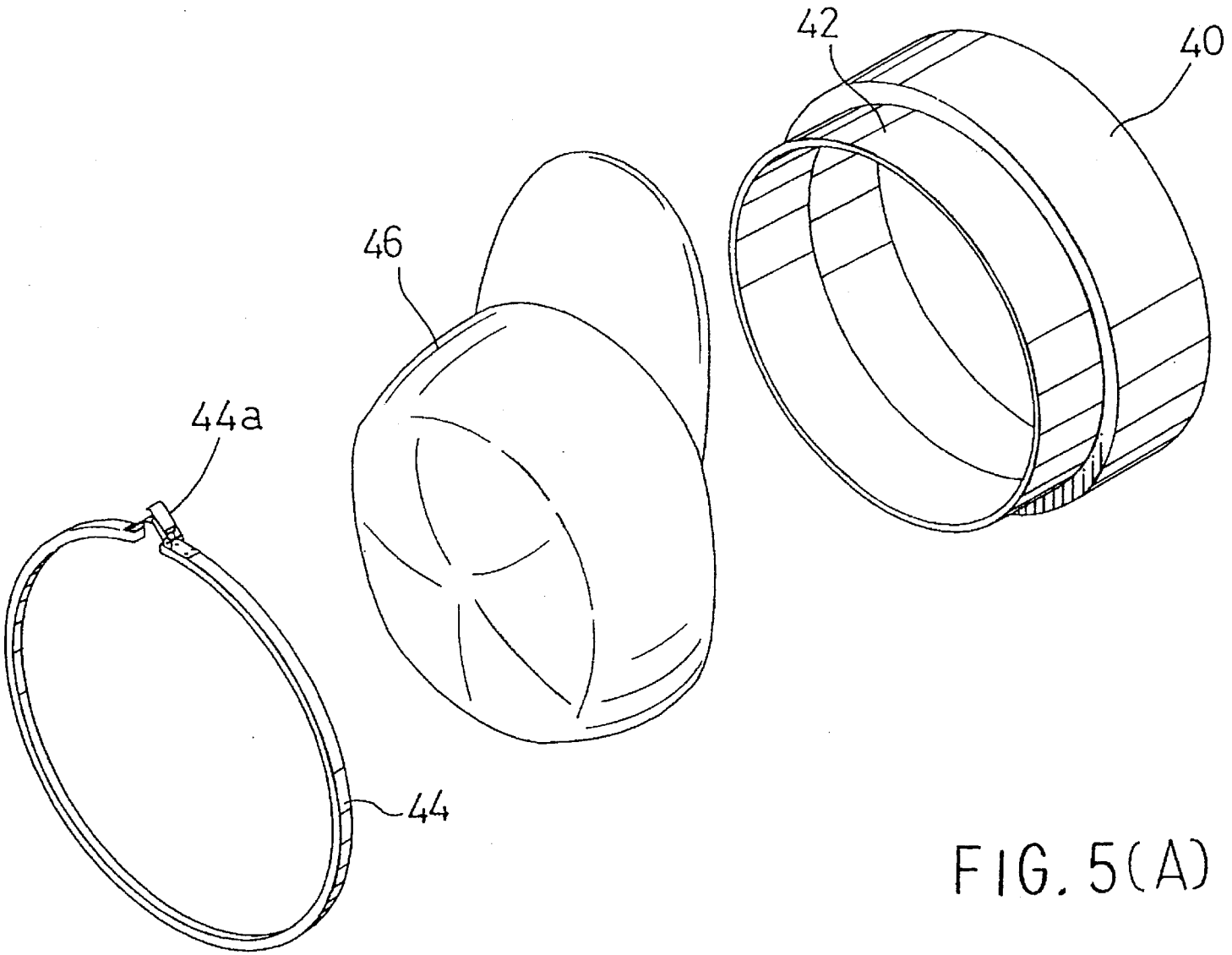
FIG. 5(A) is an exploded perspective view showing the state prior to setting a work fabric on a retainer member by a pressing member shown in FIG. 2.
Figure 5B:
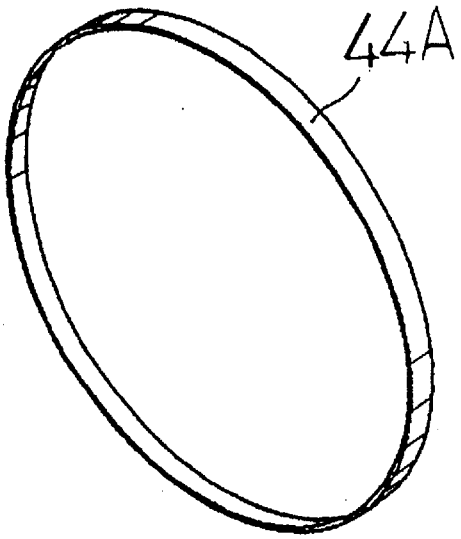
FIGS. 5(B) and 5(C) are perspective views showing modifications of the pressing member, respectively.
Figure 5C:
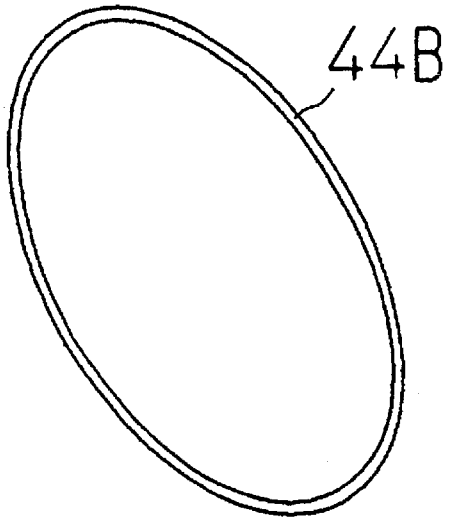
Figure 6:
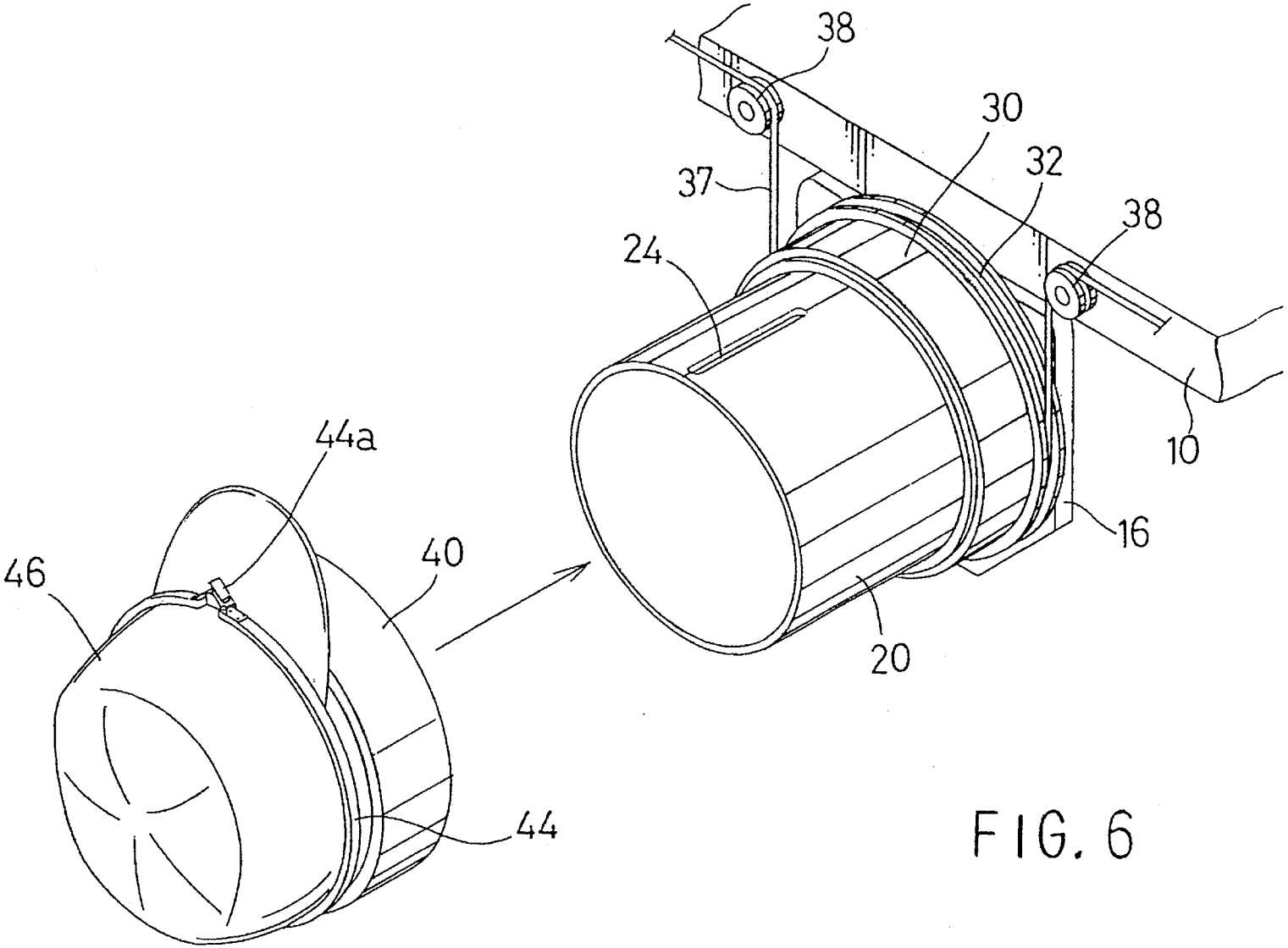
FIG. 6 is a perspective view showing the state prior to mounting the retainer member on a rotary member.

The work fabric 46 prior to mounting on the retainer member 40 is shown in FIG. 5(A). The retainer member 40 prior to mounting on the rotary member 30 is shown in FIG. 6. As will be seen from these drawings, the work fabric 46 is set on the set surface 42 of the retainer member 40, and the pressing ring 44 is thereafter set around the outer surface of the work fabric 46. The pressing ring 44 is then tightened by locking engagement of a hook device **44*a*, so that the work fabric 46 is pressed on the set surface 42 of the retainer member 40. The retainer member 40 on which the work fabric 46 is thus retained is mounted on the mounting surface 31 of the rotary member 30 and is then fixed in position by means of a lock mechanism (not shown). As shown in FIG. 2, the inner peripheral surface of the retainer member 40 opposed to the set surface 40 is stably supported by the outer peripheral surface of the support member 40. The pressing ring 44 may be made of a resilient member such as a rubber-belt ring 44A shown in FIG. 5(B) and a garter ring 44B shown in FIG. 5**(C).

In order to perform a sewing operation on the work fabric 46, the work fabric 46 is set on the retainer member 40 and is then mounted on the rotary member 30 as described above. The rotary member 30 is moved in the direction of Y axis together with the support member 20 when the Y-axis drive member 10 is moved by the Y-axis drive devices 13 based on the data of pattern to be sewn with respect to Y axis, while the rotary member 30 is rotated relative to the support member 20 the when rod 34 is moved together with the X-axis drive member 2 by the X-axis drive devices 11 based on the data of pattern to be sewn with respect to X axis. Thus, the work fabric 46 mounted on the rotary member 30 by means of the retainer member 40 is moved together with the support member 20 in the direction of Y axis and is rotated within a plane which is perpendicular to Y axis and extends in the direction of X axis. The needle bar 52 and the shuttle 58 are synchronously driven with such movement of the work fabric 46 to form stitches of desired pattern on a part of the work fabric 46 (hereinafter called "embroidery part") to be embroidered by the upper and lower threads. In this embodiment, the embroidery part is a side portion of the cap having a substantially cylindrical configuration.

As shown in FIG. 2, the curvature of the support member 20 is determined to be substantially the same as the curvature of the embroidery part of the work fabric 46. Further, as shown in FIG. 2, the support member 20 extends forwardly beyond the forward end or free end of the retainer member 40 to provide a support for the embroidery part of the work fabric 46 which extends from the retainer member 40. This may prevent the embroidery part from floating up and down when the sewing needle 54 is moved up and down for the sewing operation. Further, the embroidery part may not be deformed at a position above the throat plate 57 when the work fabric 46 is moved in the direction of Y axis or when it is rotated within the plane of X axis.

Additionally, as shown in FIG. 2, the free end of the retainer member 40 is positioned not to extend forwardly of the needle hole 55 of the throat plate 57, so that the embroidery part can be sewn over the whole circumferential length.

Since the rotary member 30 can be rotated by one and half time around the support member 20 based on the data of the pattern with respect to X axis, the embroidery part can be also rotated by one and half time. This may provide an advantageous feature over the prior art sewing machine in which the rotational angle of a work fabric is limited. Thus, according to this embodiment, in order to perform a sewing operation over the whole circumferential length, it is not necessary to stop the sewing operation for changing the position of the work fabric 46 relative to the retainer member 40. Further, particularly in case that the pattern to be embroidered is continuous in the circumferential direction, it is not necessary to divide the data of pattern to be provided or it is not necessary to perform a pattern matching operation after each sewing operation has been performed for a limited circumferential area.

Second to eighth embodiments of the present invention will now be explained with reference to FIGS. 7 to 20. These embodiments are modifications of the first embodiment, and therefore, an explanation of the same parts as the first embodiment is omitted by affixing the same reference numerals in the drawings.

SECOND EMBODIMENT

Figure 7:
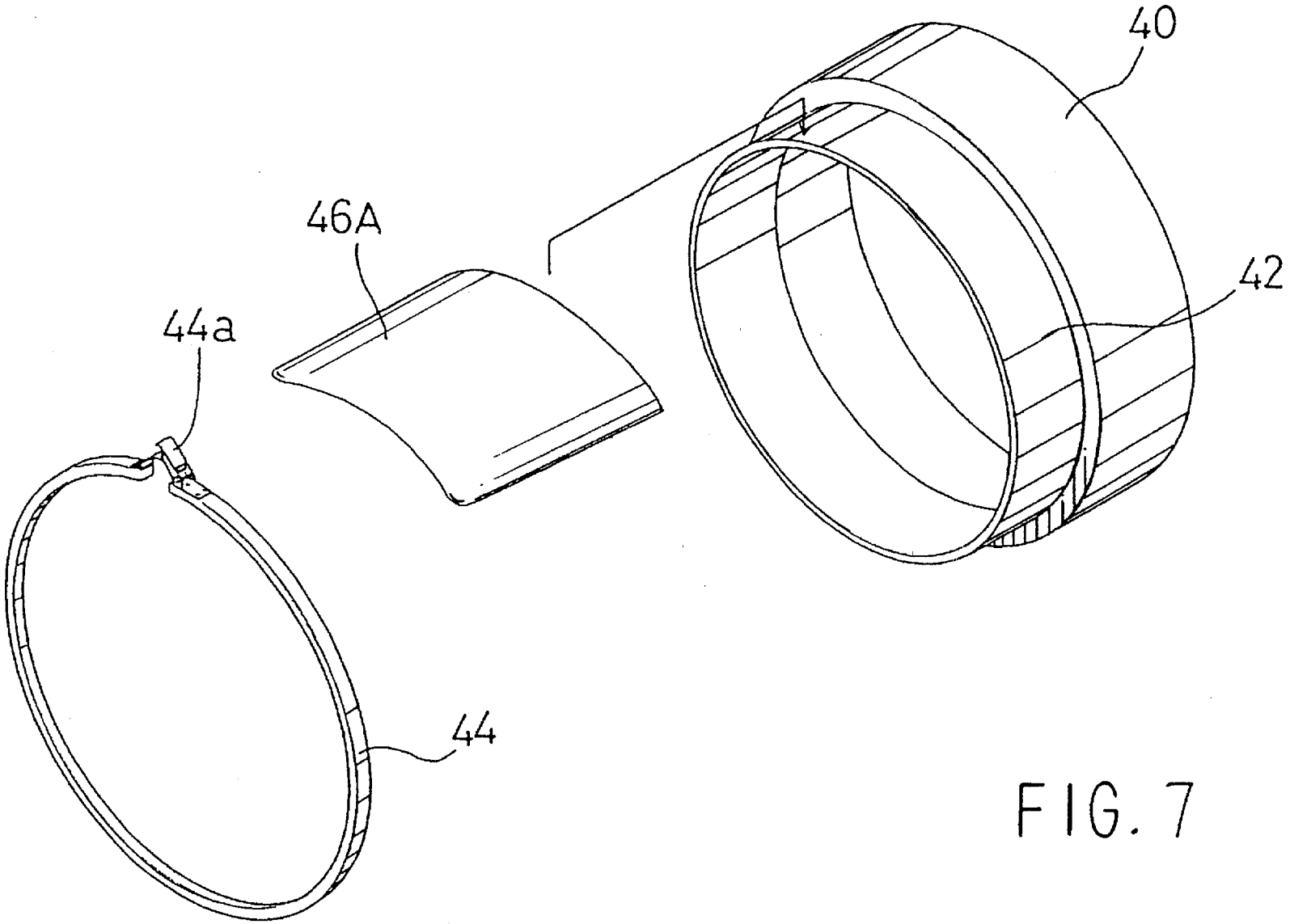
FIG. 7 is an exploded perspective view showing the state prior to setting a work fabric on a retainer member by a pressing member of a multi-head embroidery machine according to a second embodiment of the present invention.
Figure 8:
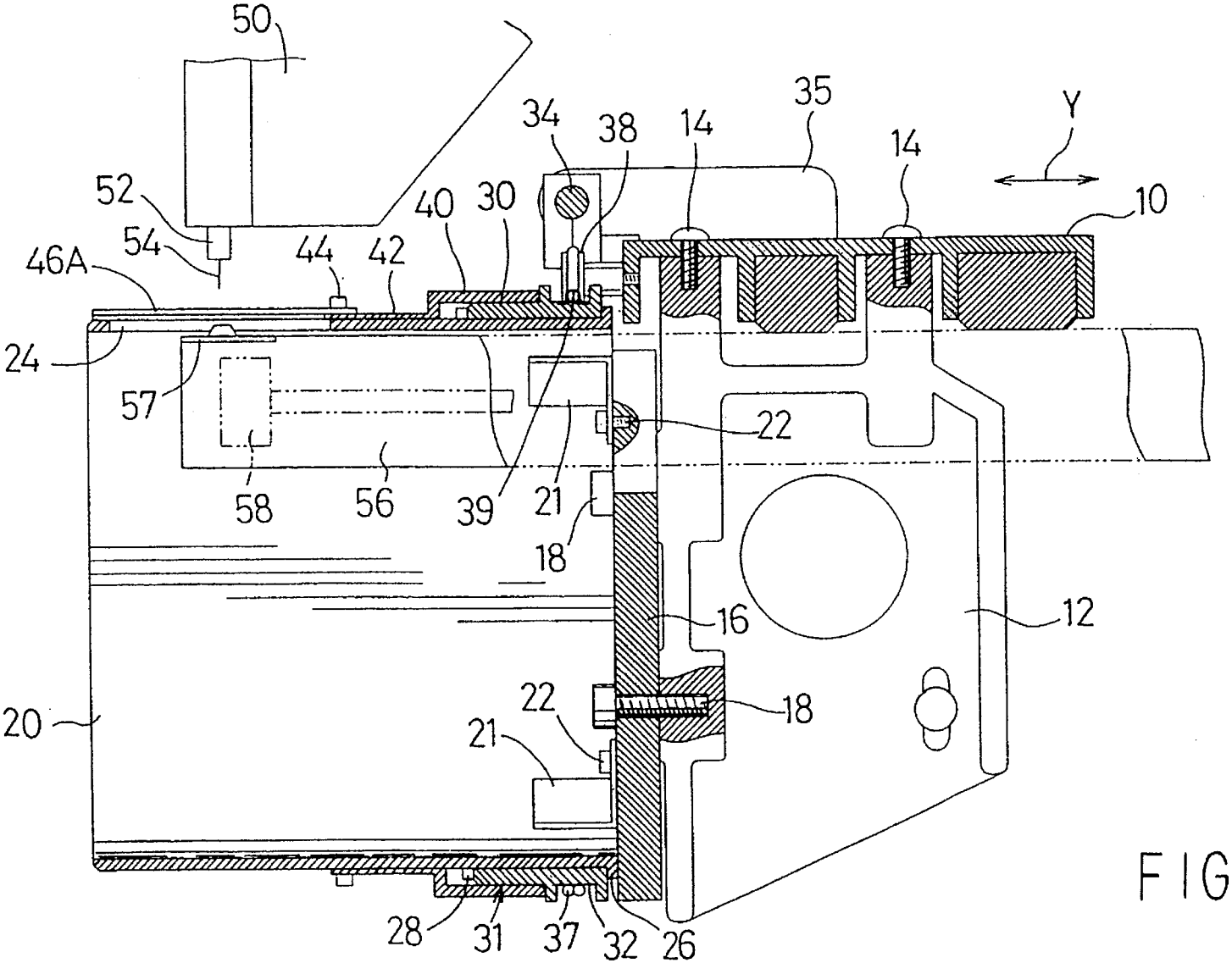
FIG. 8 is a sectional view, corresponding to FIG. 2, of the essential parts of the second embodiment.

The second embodiment of the present invention will now be explained with reference to FIGS. 7 and 8. In this embodiment, a work fabric 46A is a curved cloth piece such as a front side piece of a cap before jointed to other pieces to form the cap. Although the work fabric 46A of this embodiment does not have a complete cylindrical configuration and is different from the embroidery part of the work fabric 46 of the first embodiment having substantially the cylindrical configuration, the work fabric 46A can be set on the rotary member 30 by means of the retainer member 40 and the pressing ring 44 as shown in FIG. 8. Preferably, the work fabric 46A has a relatively higher rigidness to maintain the curved configuration during the sewing operation.

THIRD EMBODIMENT

Figure 9:
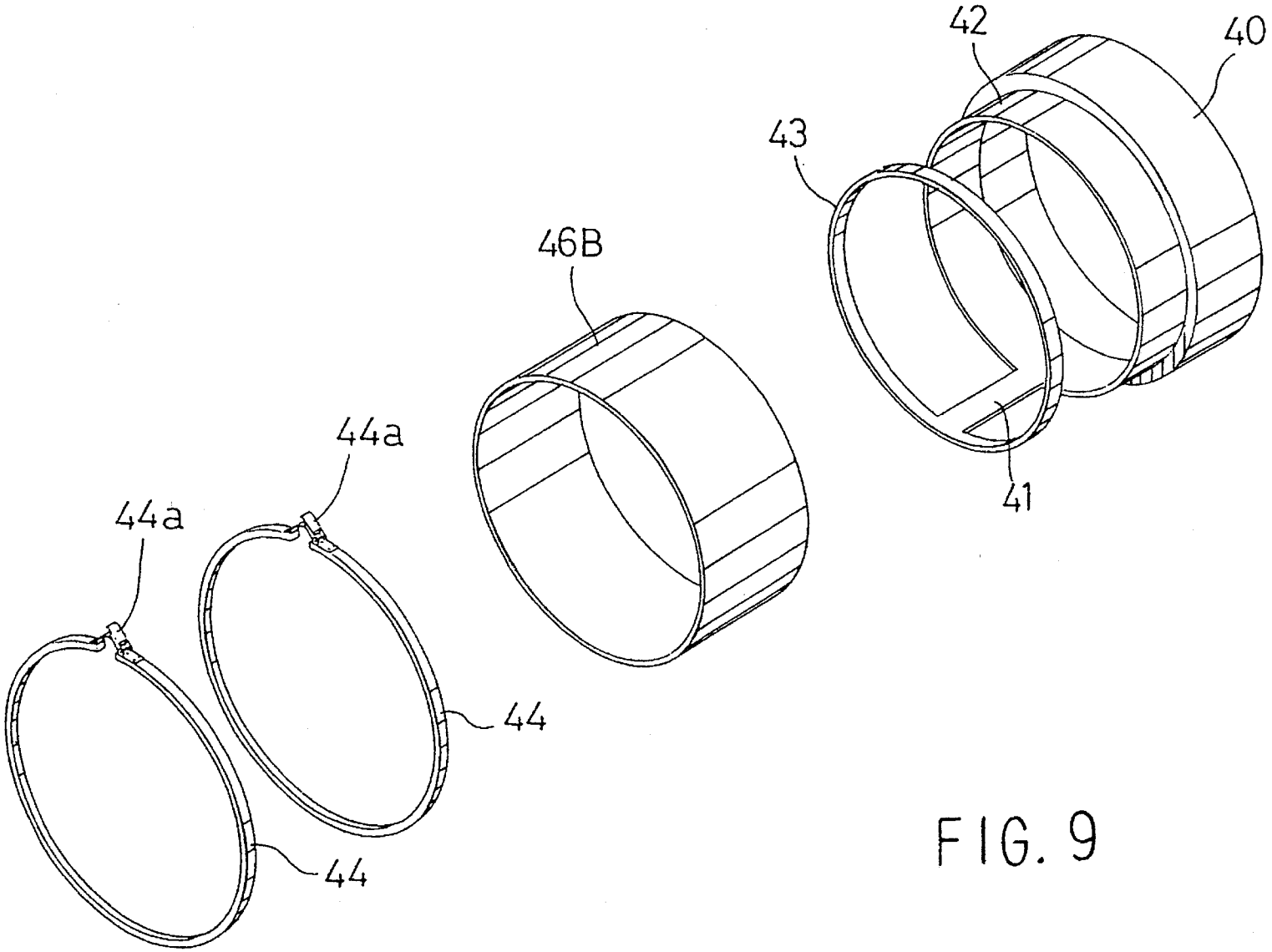
FIG. 9 is an exploded perspective view showing the state prior to setting a work fabric on a retainer member of a multi-head embroidery machine according to a third embodiment of the present invention.
Figure 10:
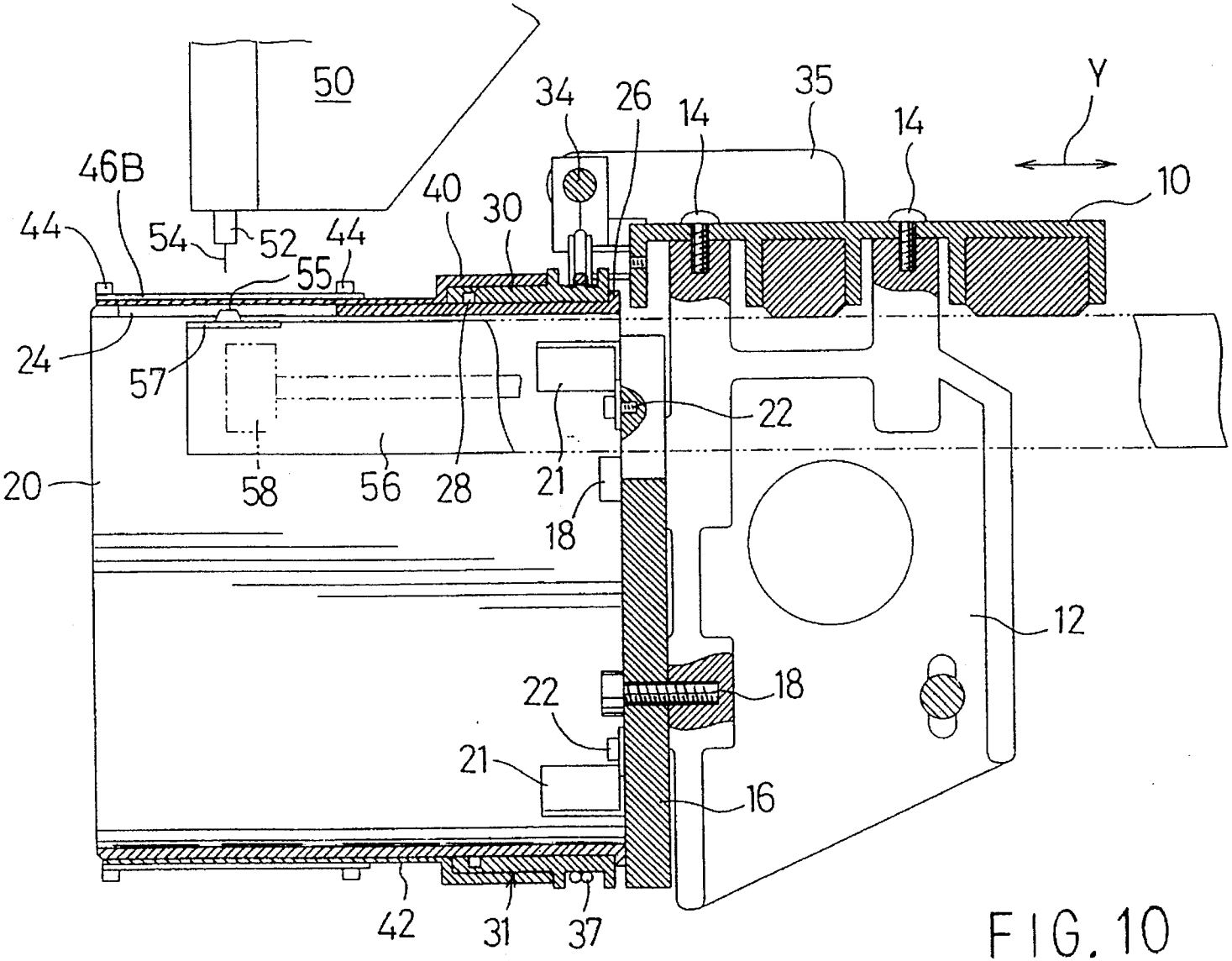
FIG. 10 is a sectional view, corresponding to FIG. 2, of the essential parts of the third embodiment.

The third embodiment of the present invention will now be described with reference to FIGS. 9 and 10. This embodiment is adapted for sewing a cylindrical work fabric 46B having a relatively lower rigidness such as a wrist band and a head band for a sporting purpose. In this embodiment, the retainer member 40 includes an auxiliary retainer member 43 connected thereto via an arm 41 extending forwardly from the free end of the retainer member 40. The auxiliary retainer member 43 has an annular configuration having an outer diameter equal to the diameter of the set surface 42 of the retainer member 40. Further, in this embodiment, two pressing members 44 are used to press the work fabric 46B on the set surface 42 of the retainer member 40 and on the outer surface of the auxiliary retainer member 43, so that the work fabric 46B of relatively lower rigidness can be stably retained at two positions rearwardly and forwardly of the needle slot 24 or the needle hole 55.

FOURTH EMBODIMENT

Figure 11A:
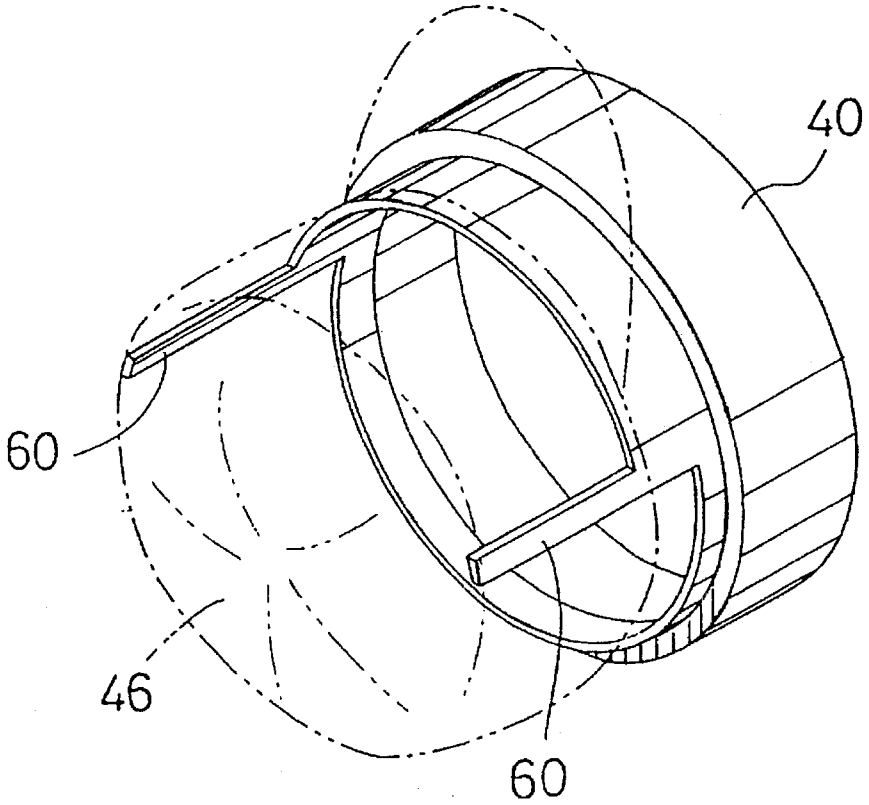
FIG. 11(A) is a perspective view of a retainer member of a multi-head embroidery machine according to a fourth embodiment of the present invention.
Figure 11B:
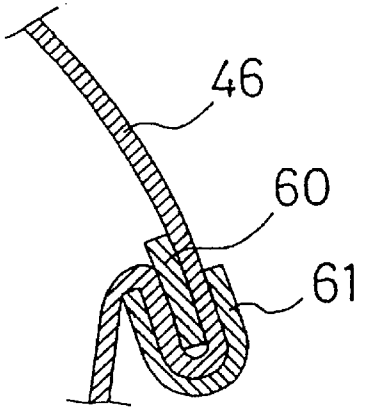
FIG. 11(B) is a sectional view showing the operation of the fourth embodiment.

The fourth embodiment of the present invention will now be described with reference to FIGS. 11(A) and 11(B). In this embodiment, the retainer member 40 has a pair of fingers 60 extending forwardly as shown in FIG. 11(A), so that the cap or the work fabric 46 can be fixed to the fingers 60 by means of clips 61 (only one shown in FIG. 11(B)). The retainer member 40 having the fingers 60 of this embodiment is also suitably adapted to retain the curved cloth piece or the work fabric 46A of the second embodiment.

FIFTH EMBODIMENT

Figure 12:
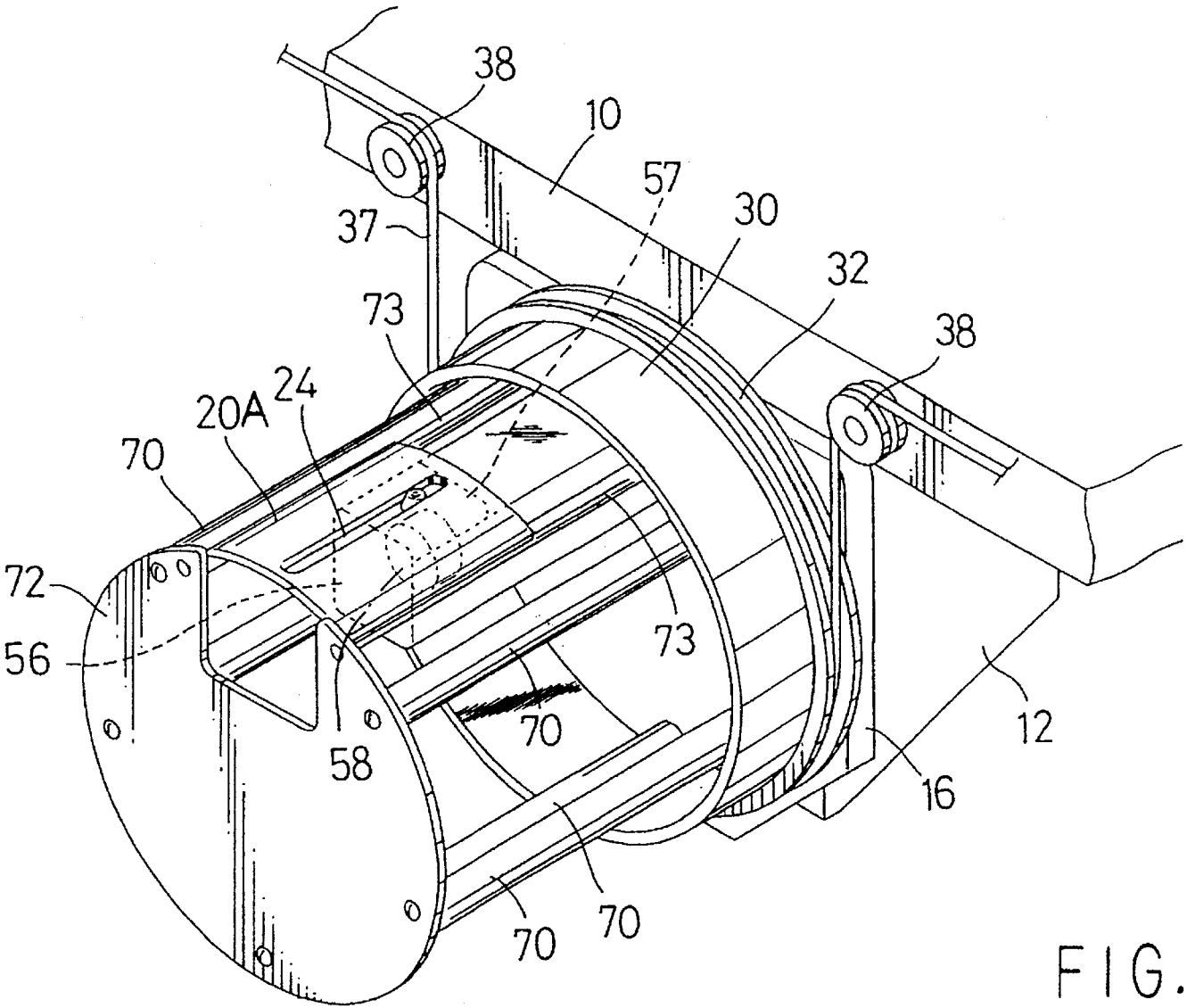
FIG. 12 is a perspective view of the essential parts of a multi-head embroidery machine according to a fifth embodiment of the present invention.
Figure 13:
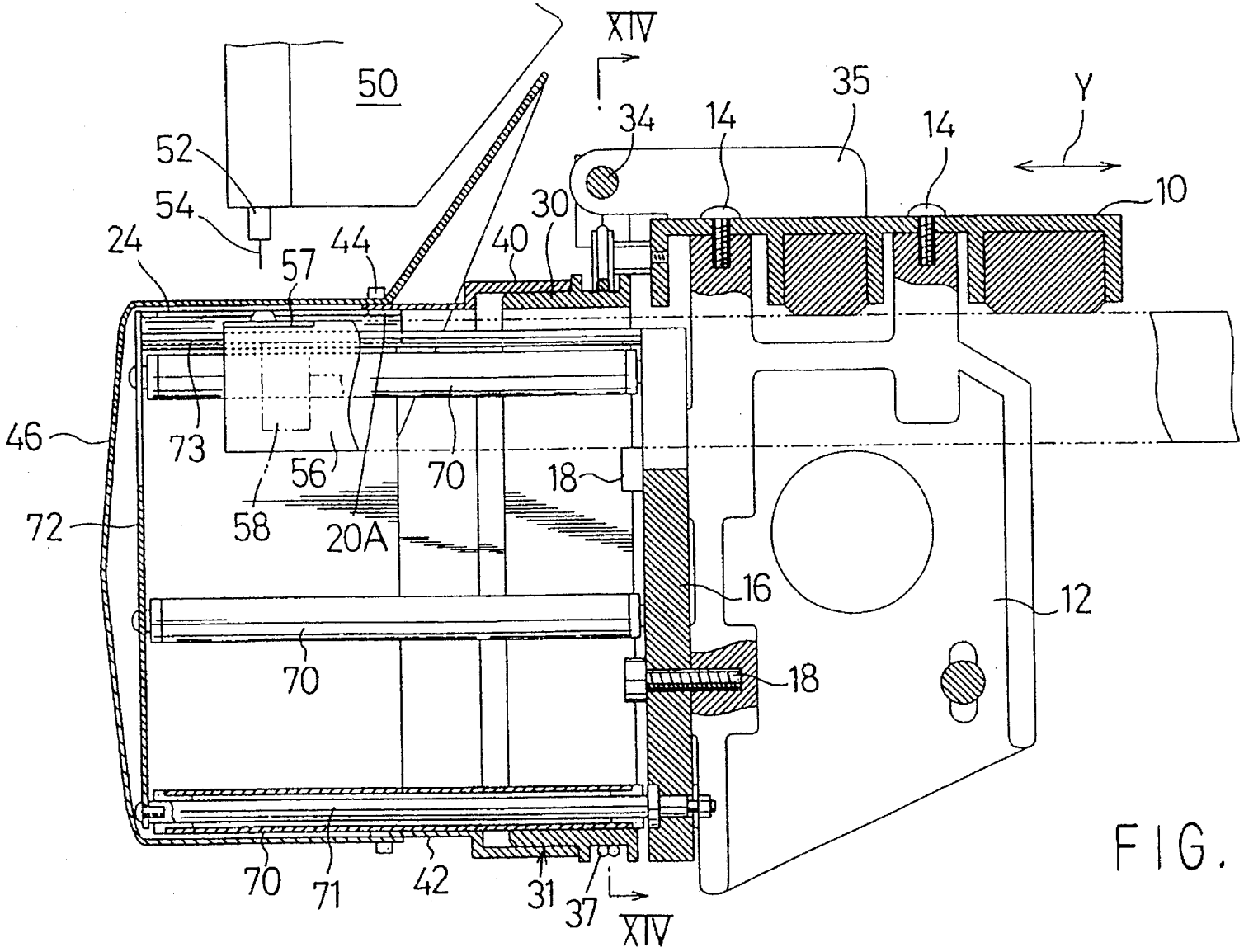
FIG. 13 is a sectional view, corresponding to FIG. 2, of the fifth embodiment.
Figure 14:
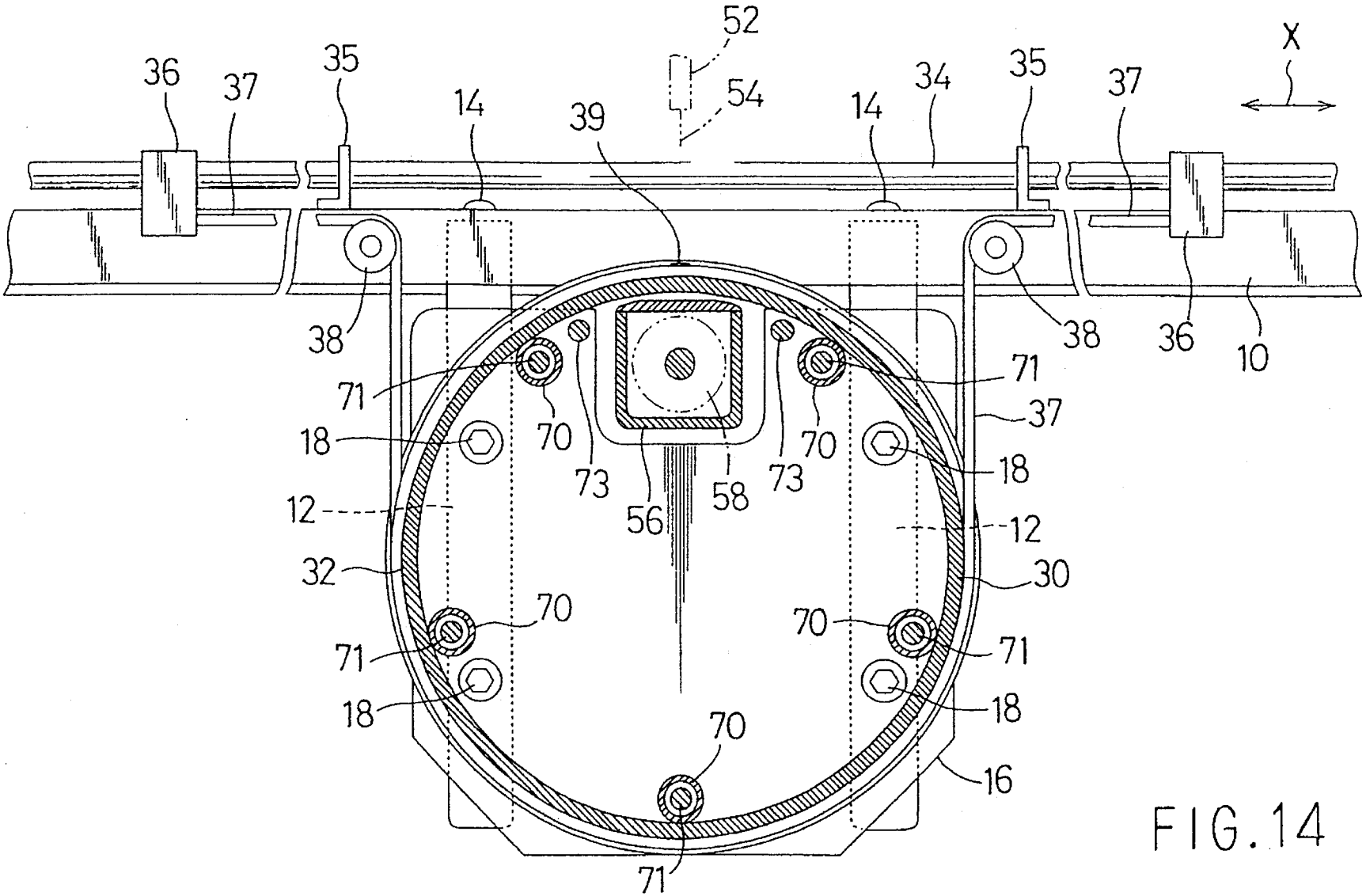
FIG. 14 is a sectional view taken along line XIV—XIV in FIG. 13.

The fifth embodiment of the present invention will now be described with reference to FIGS. 12 to 14. In this embodiment, a plurality of support shafts 71 (five in this embodiment) have rear ends fixed to the plate 16 of the support base 12 which is fixed to the Y-axis drive member 10. The support shafts 71 extend in parallel to each other in the direction of Y axis and have forward ends connected to a disc 72. A tubular sleeve 70 is rotatably fitted on each of the support shafts 71.

The rotary member 30 is rotatably supported by the support shafts 71 at a position adjacent the Y-axis drive member 10 but is prevented from movement in the direction of Y axis relative to the support shafts 71. In this embodiment, when the rotary member 30 is rotated by the X-axis drive member 2 based on the data of pattern with respect to X axis, the sleeves 70 are rotated relative to their corresponding support shafts 71. Thus, the sliding resistance may not be produced between each of the sleeves 70 and the work fabric 46 mounted on the rotary member 30, so that the work fabric 46 can be rotated along the sleeves 70 without being caught by the sleeves 70.

A pair of connecting rods 73 are connected between the plate 16 and the disc 72 and are disposed on both sides of the shuttle base 56. A support member 20A having the needle slot 24 is fixed between the connecting rods 73. The support member 20A is in the form of a curved plate having a curvature corresponding to the curvature of the embroidery part of the work fabric 46. The support member 20A serves to merely cover the area above the throat plate 57.

SIXTH EMBODIMENT

Figure 15:
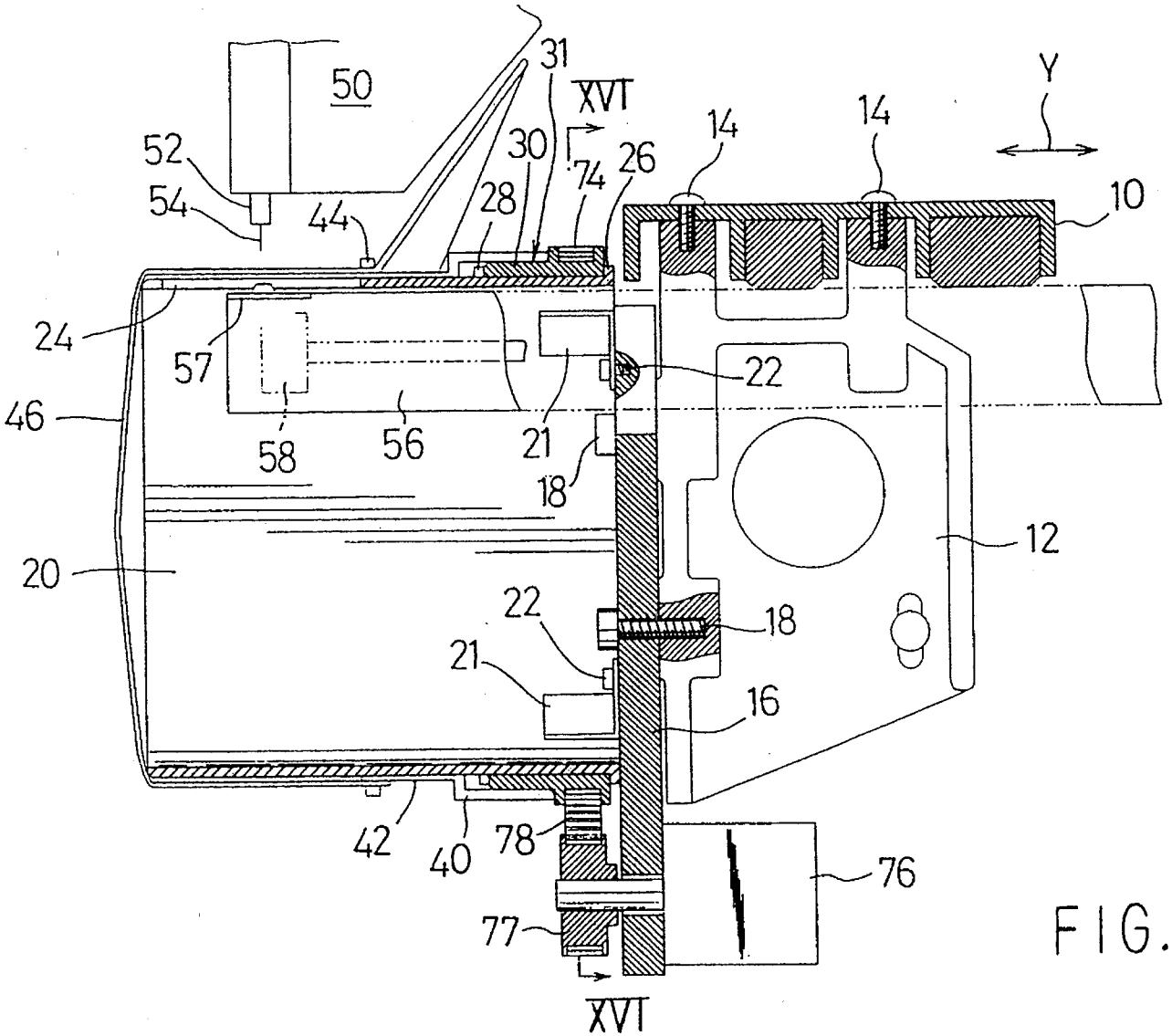
FIG. 15 is a sectional view, corresponding to FIG. 2, of the essential parts of a multi-head embroidery machine according to a sixth embodiment of the present invention.
Figure 16:
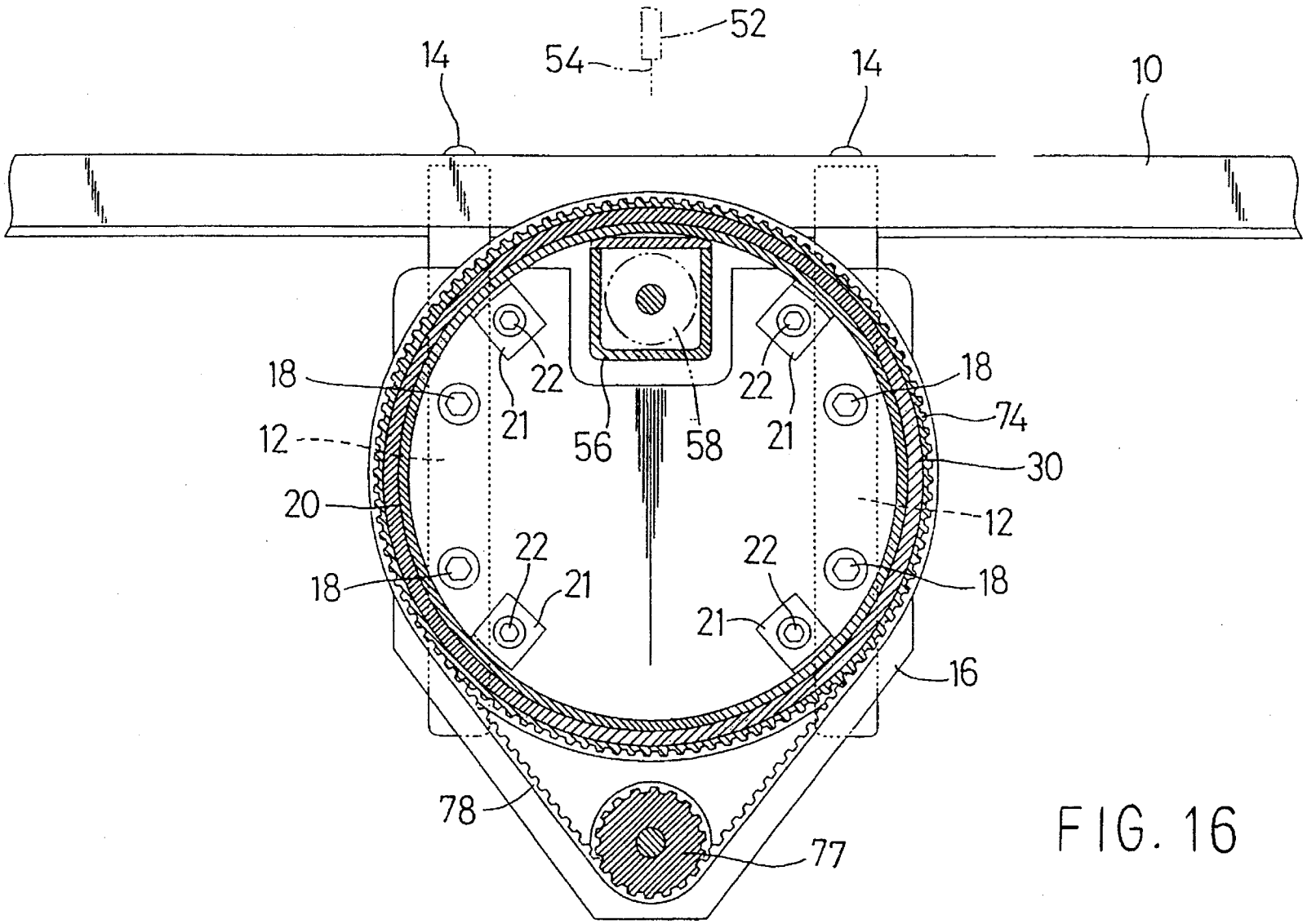
FIG. 16 is a sectional view taken along line XVI—XVI in FIG. 15.

The sixth embodiment of the present invention will now be described with reference to FIGS. 15 and 16. This embodiment is concerned with a modification of the X-axis drive mechanism for rotation of the rotary member 30. In this embodiment, a timing gear 74 is formed around the rotary member 30 by affixing a timing belt to the circumferential bottom surface of the annular recess 32 of the rotary member 30. A pulse motor 76 is mounted on the plate 16 of the support base 12 and is driven based on the data of pattern with respect to X axis. A timing pulley 77 is fixed to an output shaft of the motor 76. A timing belt 78 is passed over the timing pulley 77 and the timing gear 74 of the rotary member 30, so that the rotary member 30 can be rotated by driving the pulse motor 76 to perform a reliable control of the rotational position of the rotary member 30. Thus, with this embodiment, the X-axis drive devices 11 and its associated X axis drive member 2 and the rod 34 as required in the above embodiments can be omitted.

SEVENTH EMBODIMENT

Figure 17:
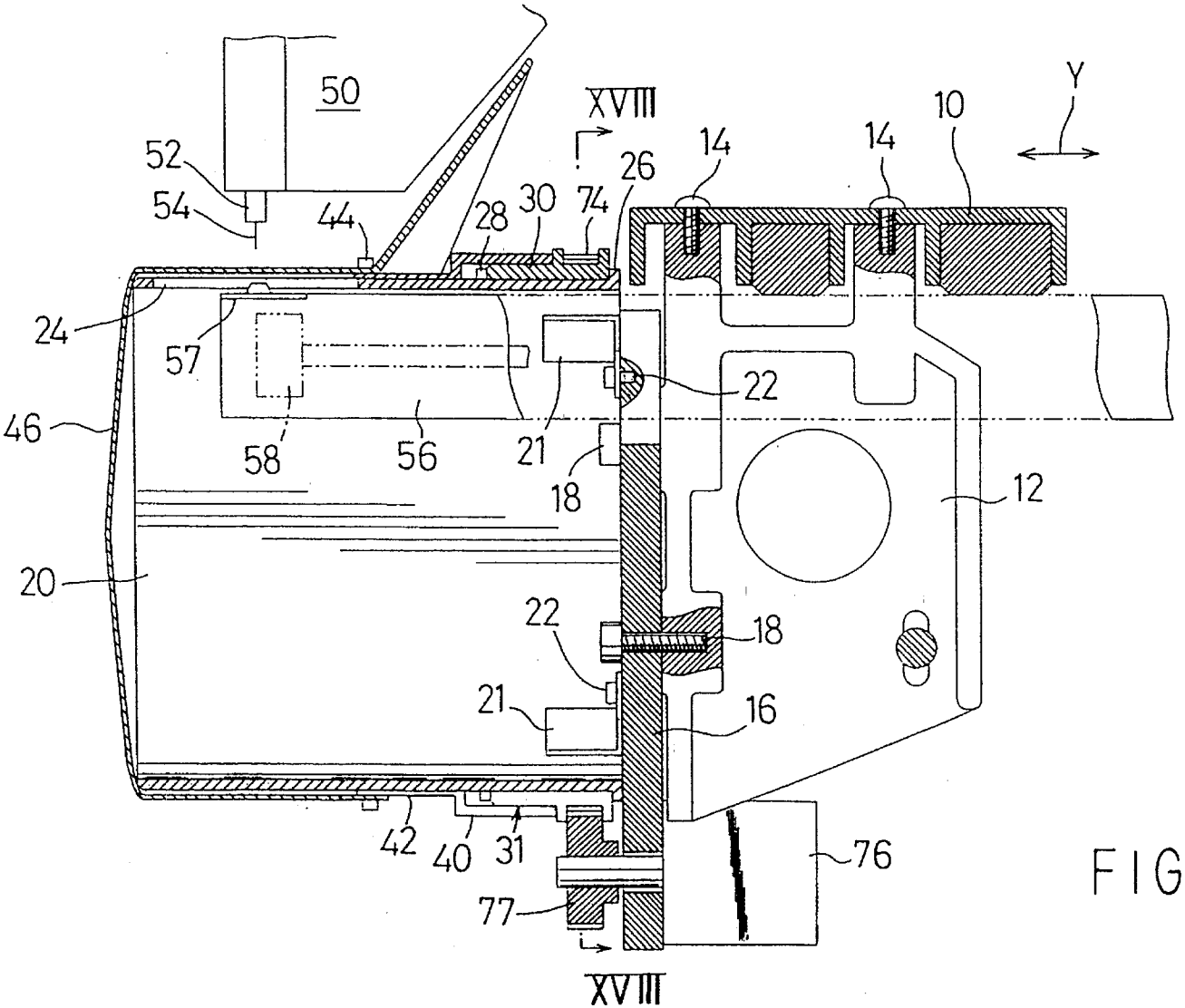
FIG. 17 is a sectional view, corresponding to FIG. 2, of the essential parts of a multi-head embroidery machine according to a seventh embodiment of the present invention.
Figure 18:
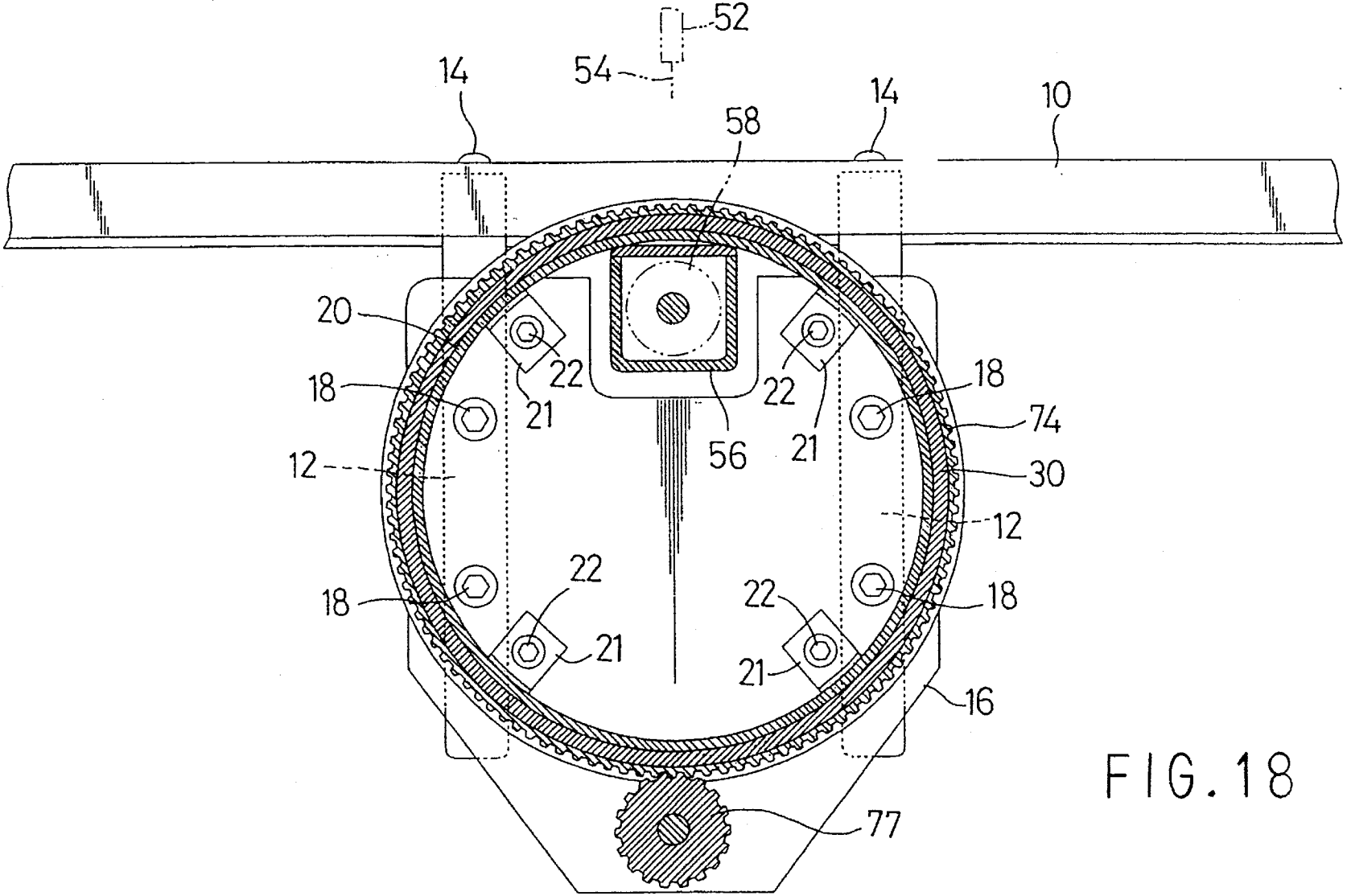
FIG. 18 is a sectional view taken along line XVIII—XVIII in FIG. 17.

The seventh embodiment of the present invention will now be described with reference to FIGS. 17 and 18. This embodiment is a modification of the sixth embodiment in which the timing gear 74 are in direct engagement with the timing pulley 77 of the pulse motor 76, so that the timing belt 78 is omitted.

EIGHTH EMBODIMENT

Figure 19:
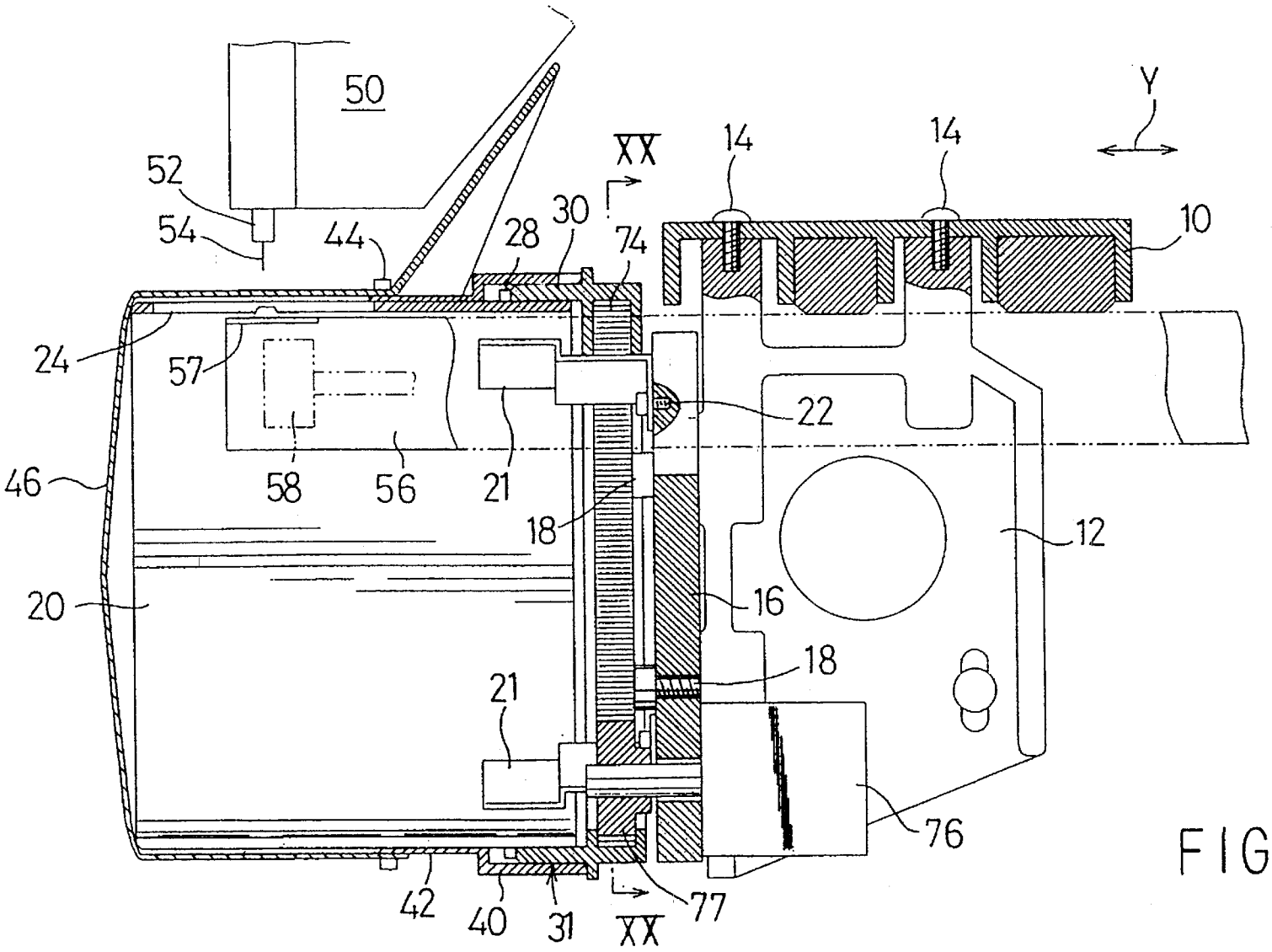
FIG. 19 is a sectional view, corresponding to FIG. 2, of the essential parts of a multi-head embroidery machine according to an eighth embodiment of the present invention.
Figure 20:
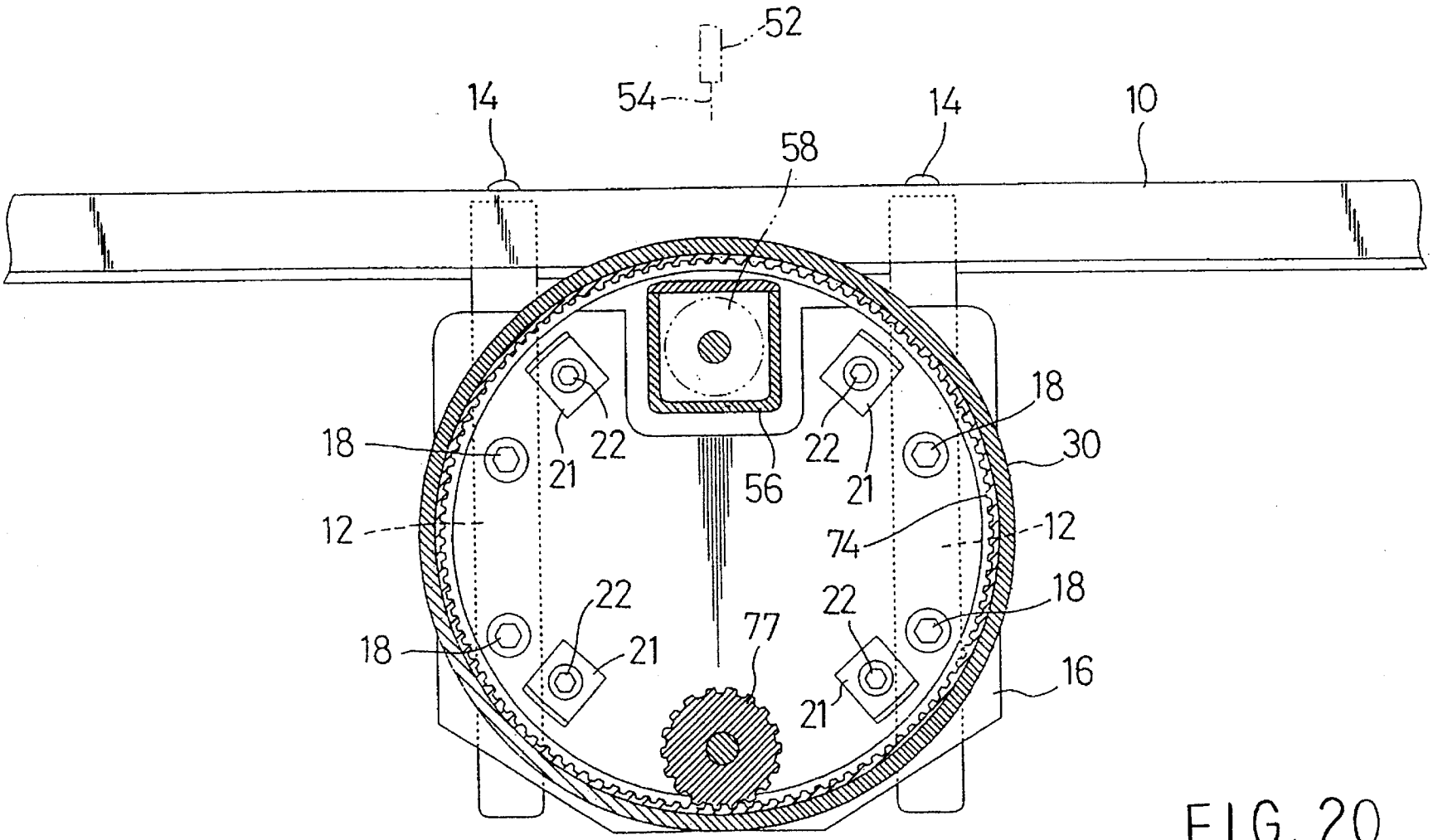
FIG. 20 is a sectional view taken along line XX—XX in FIG. 19.

The eighth embodiment of the present invention will now be described with reference to FIGS. 19 and 20. This embodiment is a modification of the seventh embodiment in which a timing gear 74 is formed on the inner peripheral surface of the rotary member 30 by affixing a timing belt to the inner peripheral surface of the rotary member 30. The pulse motor 76 is positioned such that the timing pulley 77 is disposed inwardly of the rotary member 30 and is in direct engagement with the timing gear 74.

The above sixth to eighth embodiments are advantageous over the former embodiments incorporating the cord-like member 37 since the rotational angle or the time of rotation of the rotary member 30 is not limited. Therefore, a continuous helical sewing operation can be performed on a cylindrical work fabric by a long sewing path.

Ninth to eleventh embodiments will now be explained with reference to FIGS. 21 to 32. These embodiments are modifications of the first embodiment and are particularly suitable for embroidering a work fabric having a truncated conical part to be embroidered. Such a truncated conical part is typically provided on a certain kind of cap, and these embodiments are explained with respect to an embroidery machine for embroidering such kind of cap. Further, in FIGS. 21 to 32, the same numerals are affixed to the same parts as the first embodiment.

NINTH EMBODIMENT

Figure 21:
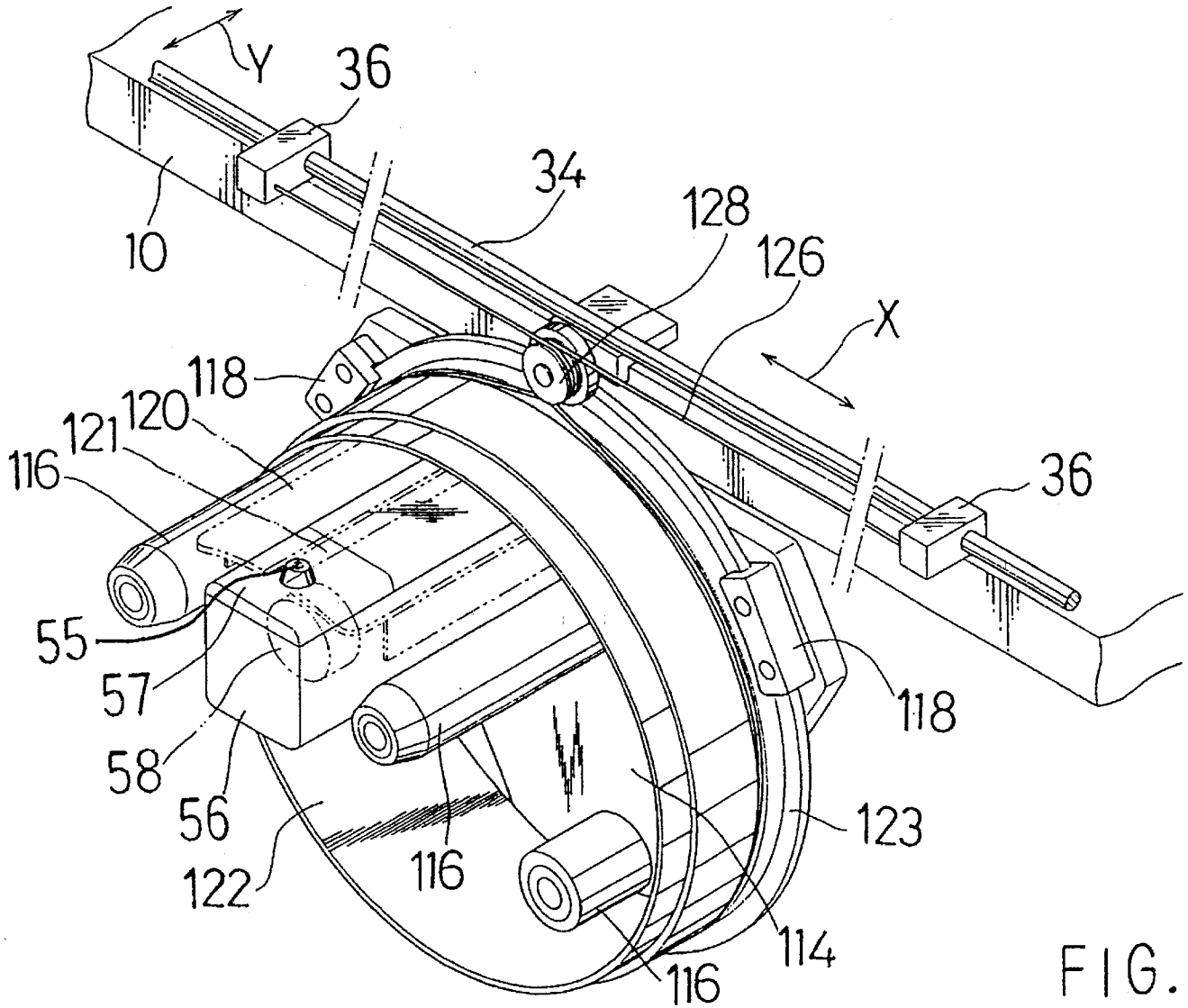
FIG. 21 is a perspective view of the essential parts of a multi-head embroidery machine according to a ninth embodiment of the present invention.
Figure 22:
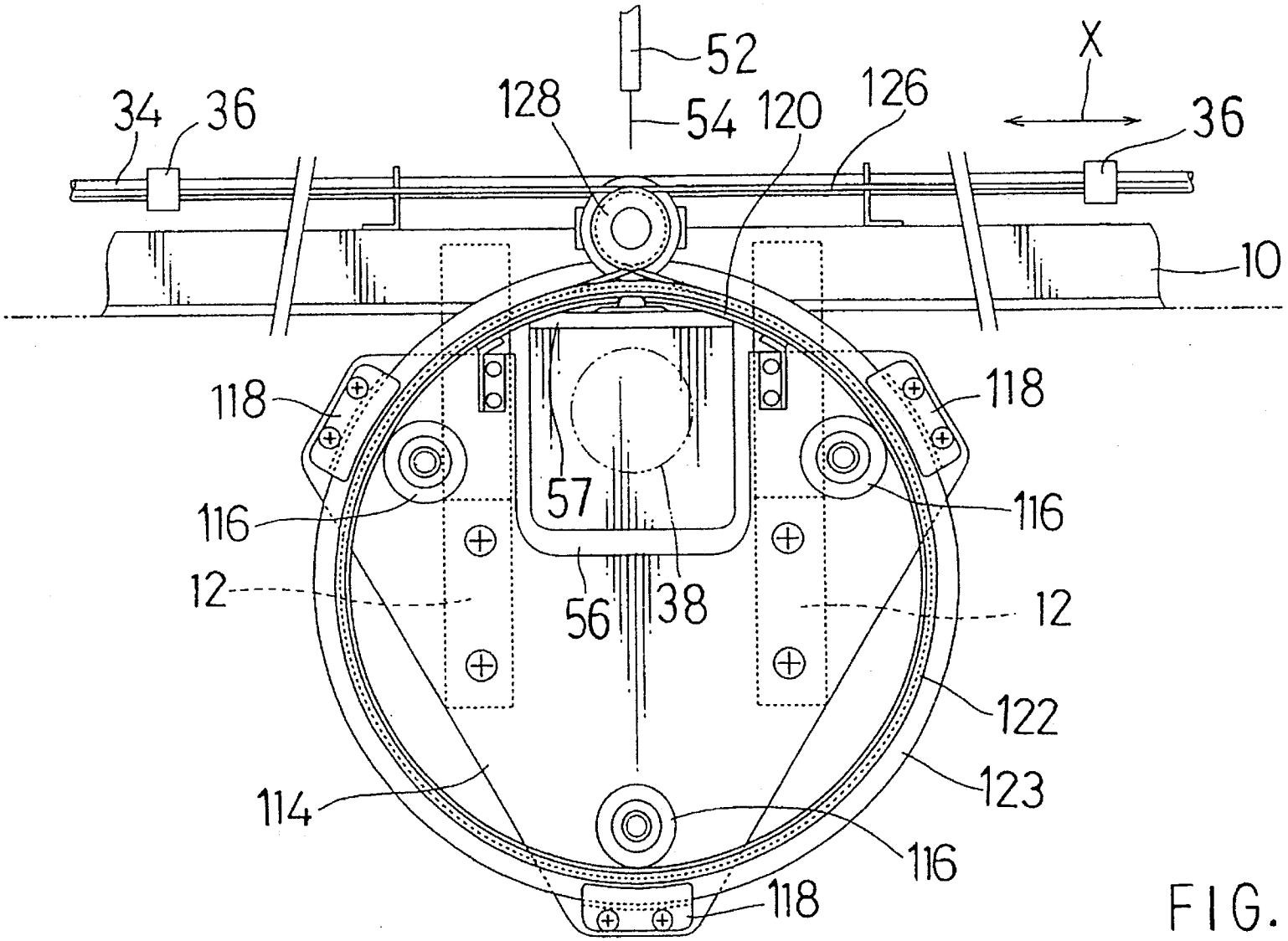
FIG. 22 is a front view of FIG. 21.

The ninth embodiment of the present invention will now be described with reference to FIGS. 21 to 28. As shown in FIGS. 21 and 22, an embroidery machine of this embodiment includes a rotary member 122 which is movable in the direction of Y axis together with the Y axis drive member 10 and which is rotatably driven within the plane in parallel to X axis by the rod 34. The rotary member 122 is disposed forwardly of a plate 114 which is fixed to the Y axis drive member 10 via the base plates 12. The rotary member 122 has an inner surface which is rotatably supported by three support rollers 116. The support rollers 116 are rotatably mounted on the front surface of the plate 114 at three positions equally spaced from each other in the circumferential direction of the rotary member 122. Three guide members 118 are also fixed to the front surface of the plate 114 and slidably receive an outer flange portion 123 of the rotary member 122 to permit rotation thereof.

A cord-like member 126 such as a wire and a steel belt is passed over the outer periphery of the rotary ring 122 in the same manner as the cord-like member 37 of the first embodiment. The cord-like member 126 has both ends which are passed over a pulley 128 supported by the Y axis drive member 10 and are fixed to the rod 34 by means of the blocks 36. Thus, as the rod 34 is moved in the direction of X axis based on the date of pattern with respect to X axis, the rotary member 122 is rotatably driven within the plane in parallel to X axis. On the other hand, as the Y axis drive member 10 is moved in the direction of Y axis based on the data of pattern with respect to Y axis, the rotary member 122 is moved in the direction of Y axis together with the support base 12 and the plate 114. In this embodiment, although the cord-like member 126 is passed over the rotary member 122 by one time, the rotary member 122 can be rotated by an angle of more than 360° by appropriately determining the distance between the blocks 36 to which both ends of the cord-like member 126 are connected.

Figure 23:
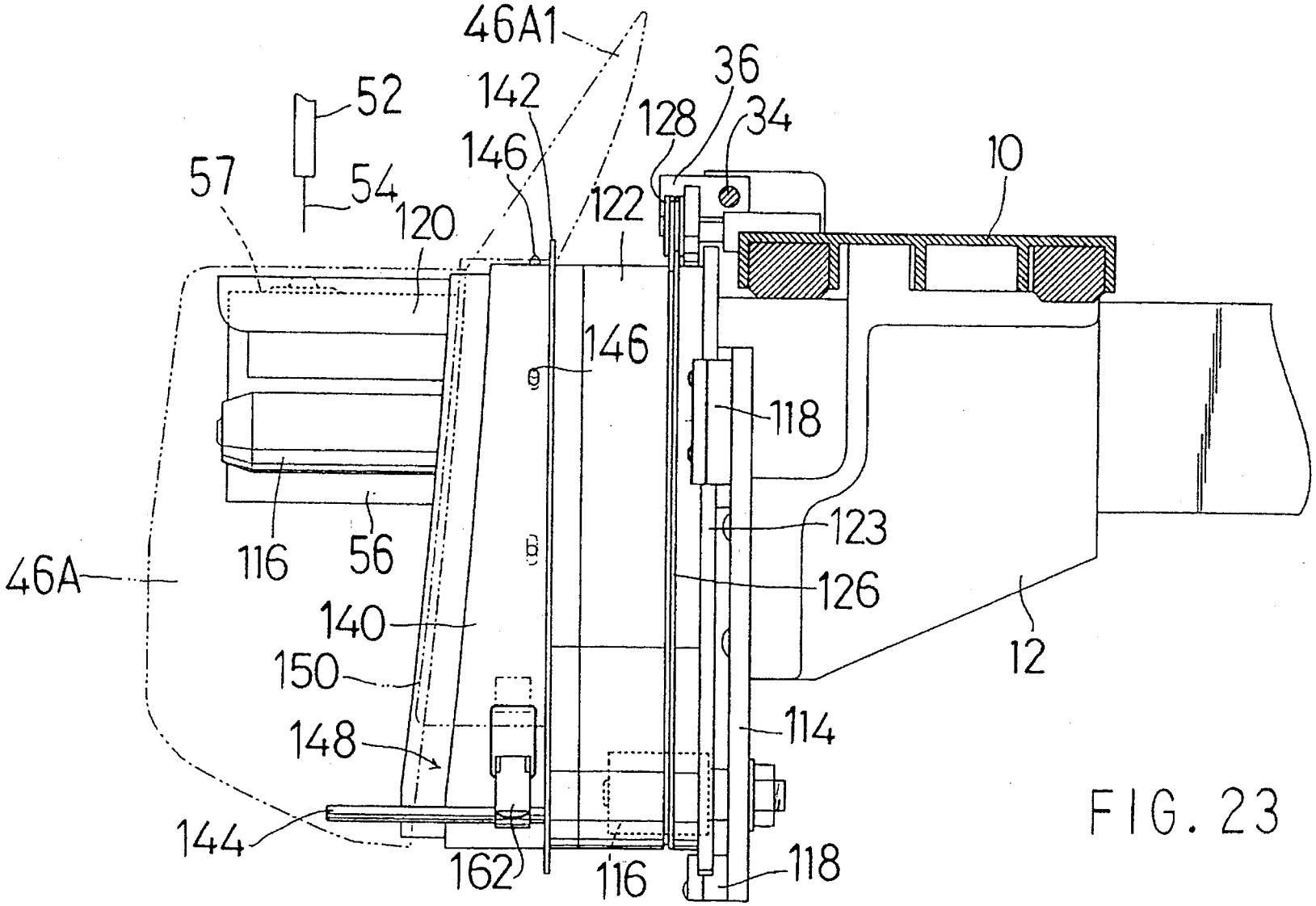
FIG. 23 is a right side view of FIG. 21 but showing a retainer device for setting a work fabric thereon.

A retainer device comprises a ring-like retainer member 140 and a belt-like pressing member 150 as shown in FIGS. 22 and 23. The retainer member 140 is mounted on the outer surface of the rotary member 122 and is fixed in position by a lock device (not shown), so that the retainer member 140 is rotatable together with the rotary member 122 around the same axis. The retainer member 140 has a front end or free end and includes a set surface 148 formed on its outer surface on the side of the free end for mounting thereon a cap or work fabric 46A.

Figure 25:
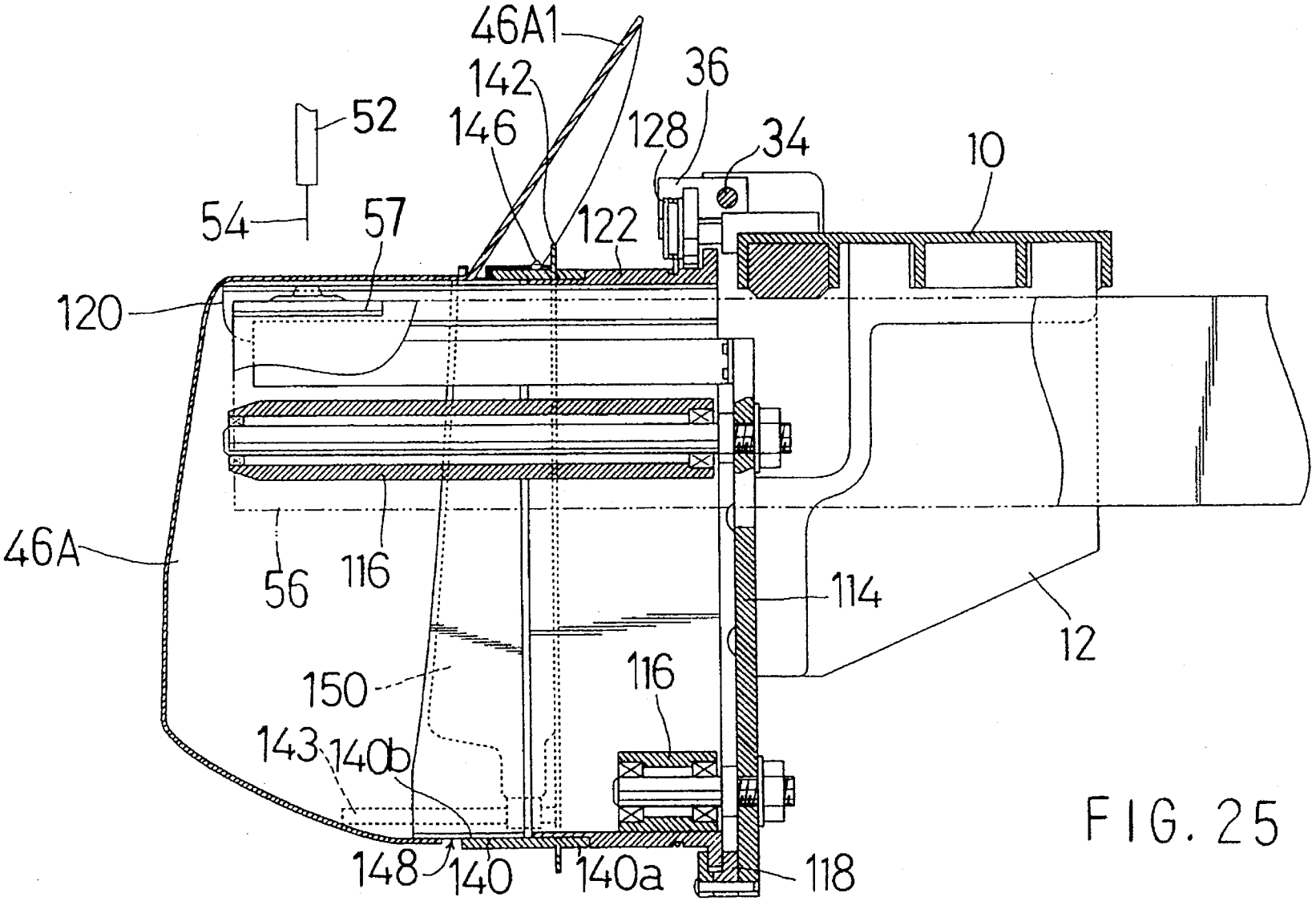
FIG. 25 is a vertical sectional view of FIG. 23.

As shown in FIG. 25, the retainer member 140 comprises an outer ring 140*a* and an inner ring 140*b* which are joined to each other. The outer ring 140*a* has an inner peripheral surface to be placed on the outer peripheral surface of the rotary member 122. The inner ring 140*b* has an outer peripheral surface which forms the set surface 148. A plurality of positioning pins 146 are fixed to the outer peripheral surface of the outer ring 140*a* and are positioned equally from each other in the circumferential direction. The outer ring 140*a* includes an outer flange 142 formed integrally therewith at a position rearwardly adjacent the positioning pins 146.

Figure 24:
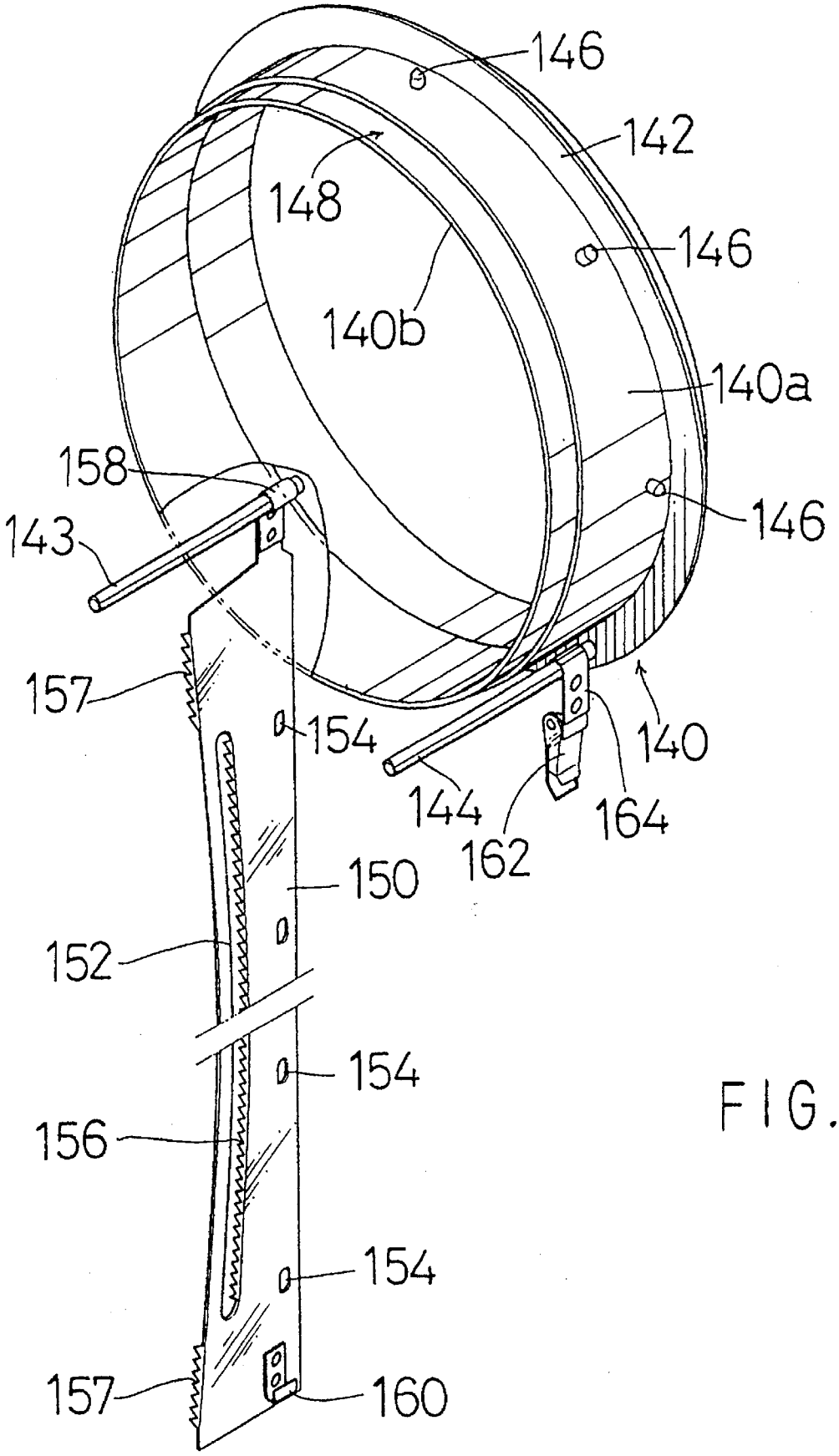
FIG. 24 is a perspective view of the retainer device.

The pressing member 150 is made of material having a suitable flexibility such as a stain-less steel plate, such that it can be resiliently deformed to have a configuration conforming to the outer periphery of the retainer member 140. As shown in FIG. 24, the pressing member 150 has one end pivotally supported by a bar 143 via a connecting member 158. The bar 143 is fixed to the flange 142 of the outer ring 140*a*. The other end of the pressing member 150 has a hook 160 fixed thereto. A lock member 162 for locking engagement with the hook 160 is pivotally mounted on a second bar 144 via a connecting member 164. The second bar 144 is fixed to the flange 142.

Figure 26:
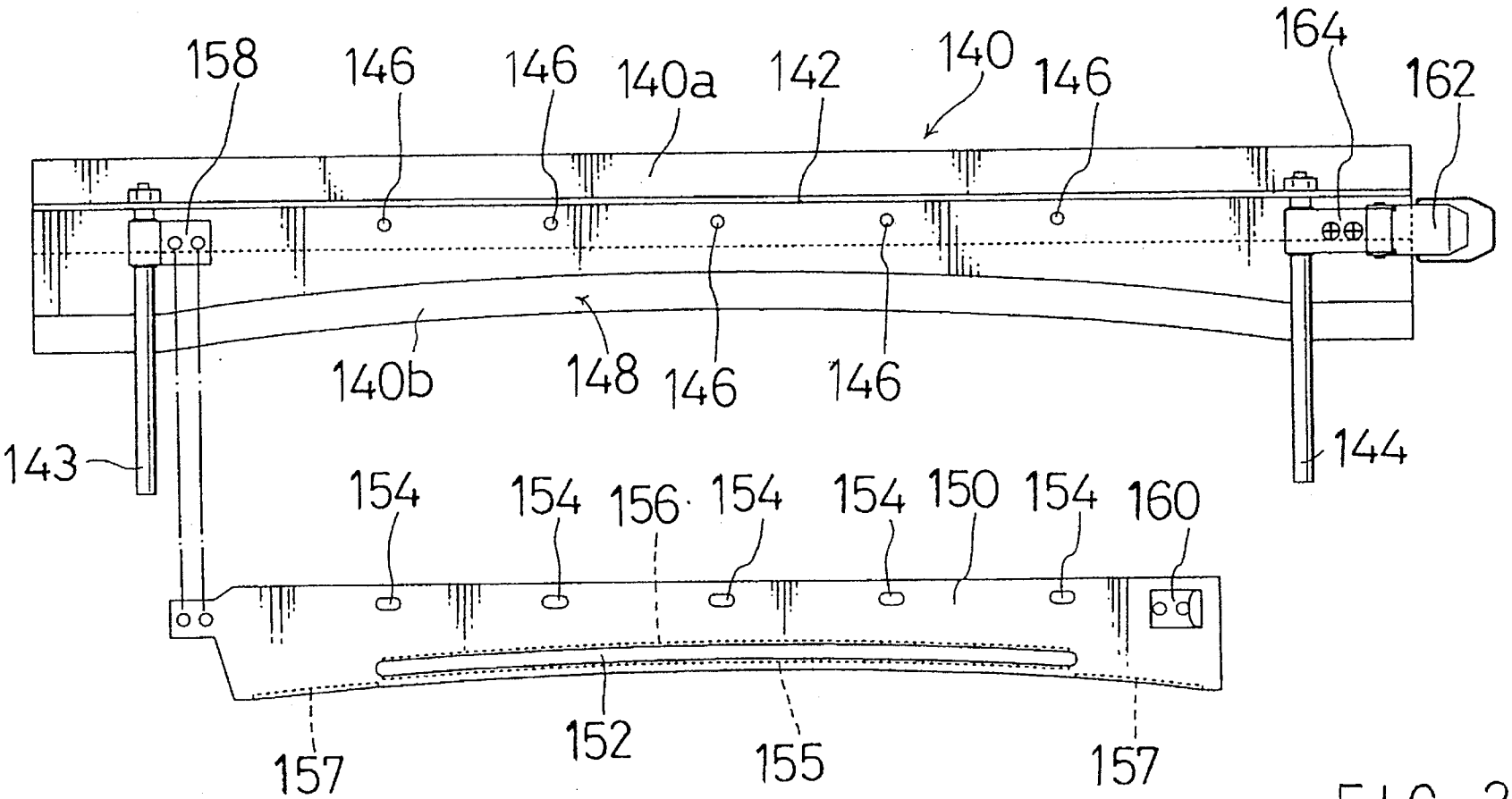
FIG. 26 is a view, in developed form, of the retainer device.
Figure 27:
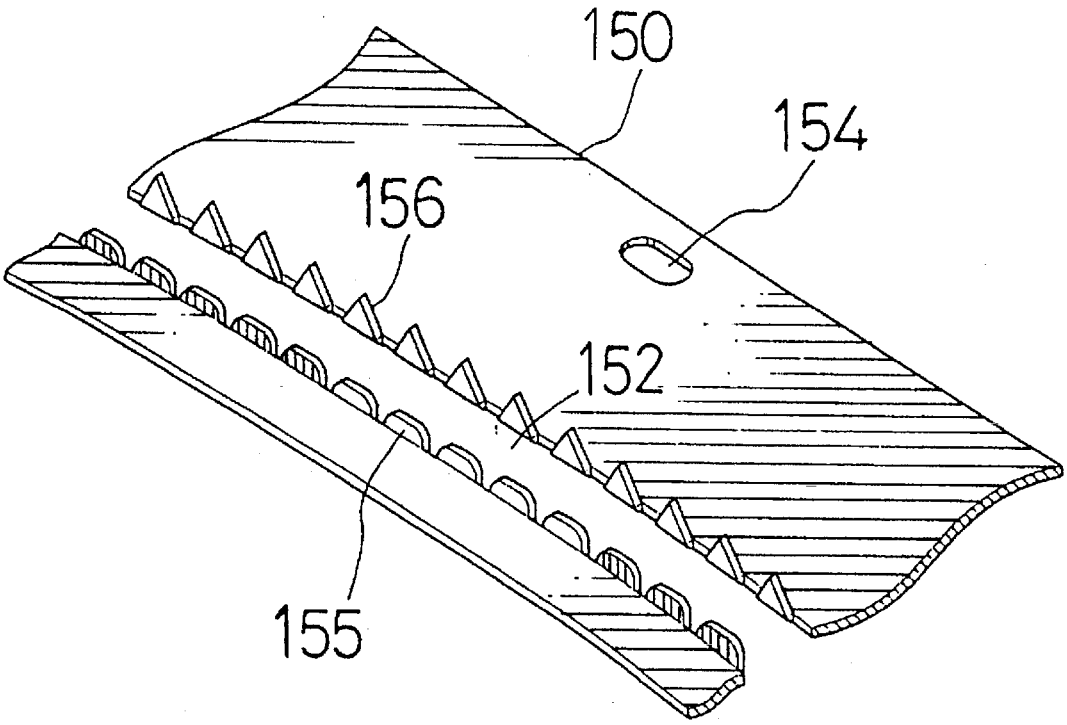
FIG. 27 is an enlarged perspective view of a part of a pressing member of the retainer device.

As shown in FIGS. 26 and 27, an insertion slot 152 is formed on the pressing member 150 for inserting a visor part 46A1 of the work fabric 46A. A plurality of positioning slots 154 are formed on the pressing member 150 for engagement with the positioning pins 146 of the retainer member 140.

Further, two sets of teeth 155 and 156 are formed on the pressing member 150 along the insertion slot 152 and are positioned on both sides thereof. Two sets of teeth 157 are also formed on both end portions of the pressing member 150 at positions confronting to the set surface 148 of the retainer member 140.

The work fabric 46A has a truncated conical embroidery part which is to be embroidered, and the embroidery operation is normally performed over an area of this part extending circumferentially to a large extent from a forehead position joined to the visor part 46A1. The embroidery part has an opening in one side toward which the diameter increases. The work fabric 46A is set on the set surface 148 of the retainer member 140 with the opening of the embroidery part oriented toward the retainer member 140. In order to position the embroidery part to extend in parallel to the throat plate 57 during the embroidery operation, the axis of the embroidery part must be inclined relative to the rotational axis of the retainer member 140.

To cope with such inclination of the embroidery part, the free end of the retainer member 140 or the front end of set surface 148 of the inner ring **140*b* is determined to have a configuration conforming to the edge of the opening of the embroidery part of the work fabric 46A set on the set surface 148. Further, in this embodiment, a front edge of the pressing member 150 is determined to have the configuration conforming to the edge of the opening of the embroidery part. Thus, as shown in FIG. 26 in which the retainer member 140 and the pressing member 150 are shown in developed form, the free end of the retainer member 140 as well as the front edge of the pressing member 150 has a curved configuration. Further, in this embodiment, the front end of the outer ring 140*a*** is also determined to have the configuration conforming to the edge of the opening of the embroidery part.

The operation of the retainer device will now be explained.

Firstly, the work fabric 46A is set on the set surface 148 of the retainer member 140 with the pressing member 140 being free from the retainer member 140 as shown in FIG. 24. Then, the pressing member 140 is bent around the work fabric 46A along the outer peripheral surface of the retainer member 140, while the visor portion 46A1 being passed through the inserting slot 152. The hook 160 mounted on the other end of the pressing member 150 is thereafter engaged by the lock member 162, so that the edge portion of the opening of the work fabric 46A is pressed on the set surface 148 and is fixed in position.

At this stage, the free end of the set surface 148 of the retainer member 140 as well as the front edge of the pressing member 150 is in alignment with the edge of the opening of the work fabric 46A as shown in FIGS. 23 or 25. Thus, the retainer member 140 as well as the pressing member 150 does not substantially extend forwardly from the opening of the work fabric 46A, so that a broader embroidery area can be obtained.

When the pressing member 150 is thus bent around the retainer member 140, the positioning slots 154 are brought to engage their corresponding positioning pins 146 of the retainer member 140, so that the work fabric 46A is prevented from moving in the direction of Y axis together with the pressing member 150 during the embroidery operation. Each of the positioning slots 154 has an elongated configuration so as to cope with the variation in positions of the positioning slots 154 relative to the positioning pins 146 in response to change of thickness of the work fabric 46A to be retained.

Figure 28:
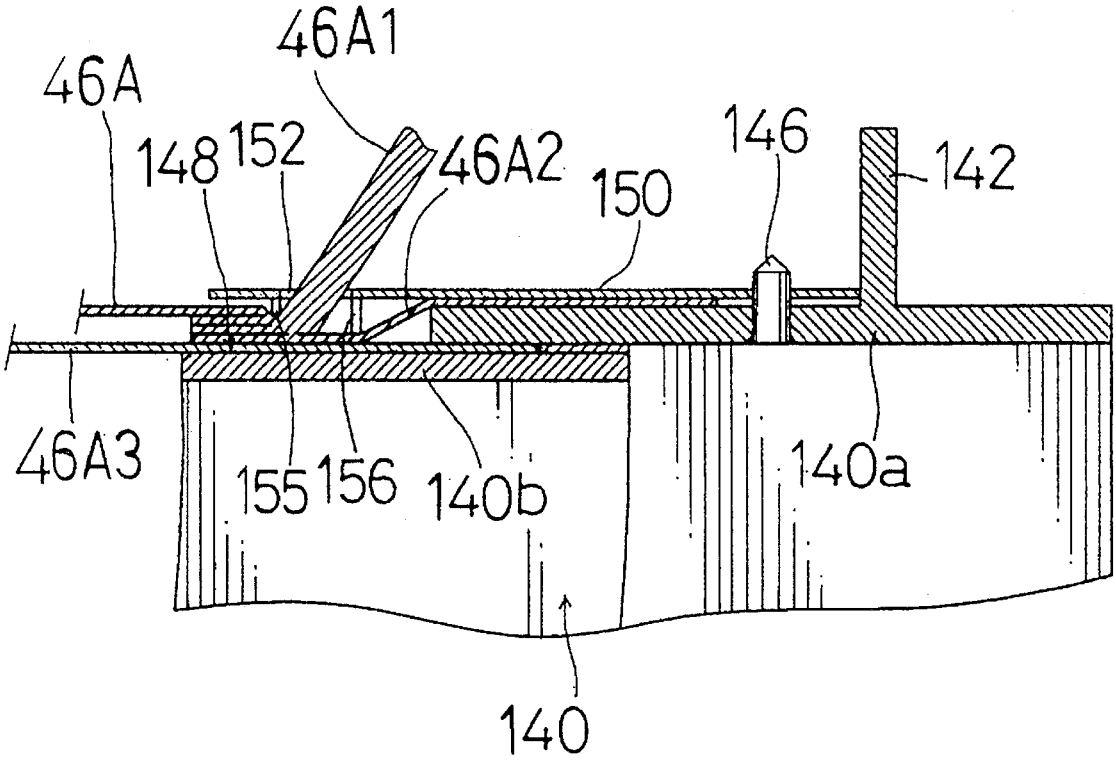
FIG. 28 is an enlarged sectional view of a part of the retainer device on which the work fabric is set.

As shown in FIG. 28, for the embroidery operation, the work fabric 46A is set on the retainer member 140 with a belt-like sweat prevention member 46A2 bent to extend outwardly from the opening. The sweat prevention member 46A2 is sewn on the inner edge of the opening of the work fabric 46A. The set of teeth 155 formed on one side of the inserting slot 152 of the pressing member 150 serves to engage the visor part 46A1 at a position adjacent the opening so as to press it on the retainer member 140. On the other hand, the set of teeth 156 formed on the other side of the inserting slot 152 serves to engage the sweat prevention member 46A2 at a position adjacent the opening so as to press it on the retainer member 140. Two sets of teeth 157 serve to engage the edge portion of the opening of the work fabric 46A at positions on both sides of the visor part 46A1.

Particularly, each of the teeth 156 for engagement with the sweat prevention member 46A2 has a pointed end, so that the sweat prevention member 46A2 can be reliably fixed in position.

When a core 46A3 made of a cylindrical rolled paper, etc. is to be placed inside of the work fabric 46A for preventing the work fabric 46A set on the retainer device from deformation, the core 46A3 is fitted around the set surface 148 of the retainer member 140 or the outer peripheral surface of the inner ring **140*b*, and an end portion of the core 46A3 is inserted into a space between the inner ring 140*b* and the outer ring 140*a* as shown in FIG. 28. Such use of the core 46A3 is not essential to the work fabric 46**A.

The retainer member 140 on which the work fabric 46A has been set is then mounted on the rotary member 122 as shown in FIGS. 23 or 25. A curved support member 120 is fixed to the support plate 114 and extends adjacent and above the throat plate 57 of the shuttle base 56. The support member 120 serves to support the embroidery part of the work fabric 46A at a position above the throat plate 57. As shown in FIG. 21, the support member 120 has an elongated slot 121 which extends in the direction of Y axis and permits insertion of the sewing needle 54.

As the rotary member 122 is rotated based on the data of pattern with respect to X axis, while being moved in the direction of Y axis based on the data with respect to Y axis, the work fabric 46A mounted on the rotary member 122 via the retainer device is rotated and moved in the same manner as the rotary member 122, and the sewing operation can be performed on the embroidery part of the work fabric 46A in the same manner as the first embodiment.

Since the retainer device comprising the retainer member 140 and the pressing member 150 of this embodiment serves to provide a broader sewing area for the embroidery part, the limitation of kind of pattern to be sewn can be improved. Further, since the work fabric 46A can be rotated by an angle of more than 360° due to the rotation of the rotary member 122, with the improved sewable area as described above, the embroidery machine can cope with demand of various kind of patterns.

TENTH EMBODIMENT

Figure 29:
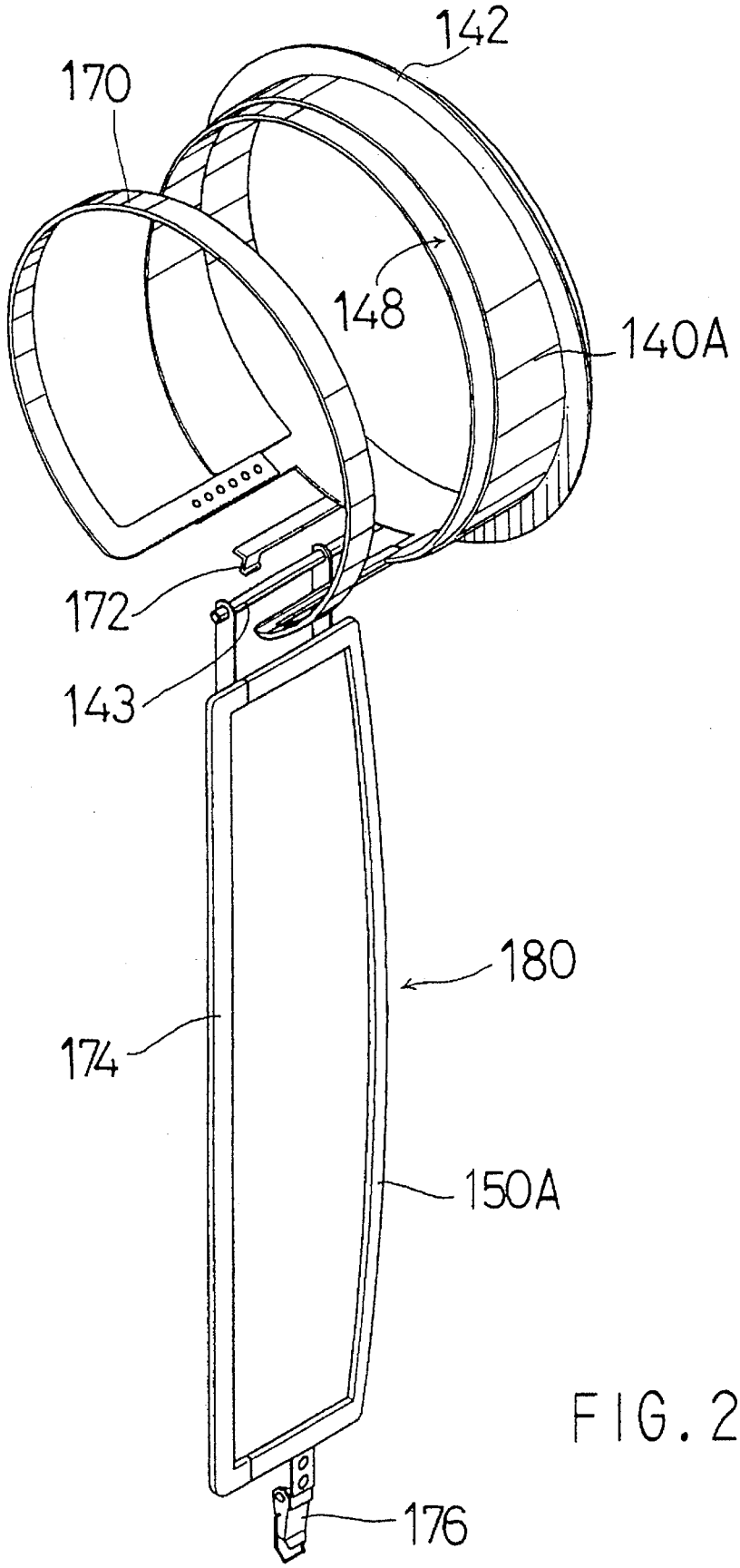
FIG. 29 is a perspective view of a retainer device of a multi-head embroidery machine according to a tenth embodiment of the present invention.

The tenth embodiment of the present invention will now be described with reference to FIGS. 29 and 30. This embodiment relates to a modification of the retainer device of the ninth embodiment and includes an auxiliary retainer member 170 positioned forwardly of a retainer member 140A corresponding to the retainer member 140 of the ninth embodiment. Thus, the auxiliary retainer member 170 is spaced from the free end or the front end of the set surface 148 of the retainer member 140A in the direction of Y axis. The auxiliary retainer member 170 serves to support the inner periphery of the work fabric 46A at a position adjacent a top part 46A4 of the work fabric 46A which is spaced from the opening by the embroidery part. The auxiliary retainer member 170 is mounted on the retainer member 140A such that the position of the auxiliary retainer member 170 is adjustable in the direction of Y axis relative to the retainer member 140A in response to the height (depth) of the work fabric 46A to be embroidered.

Figure 30:
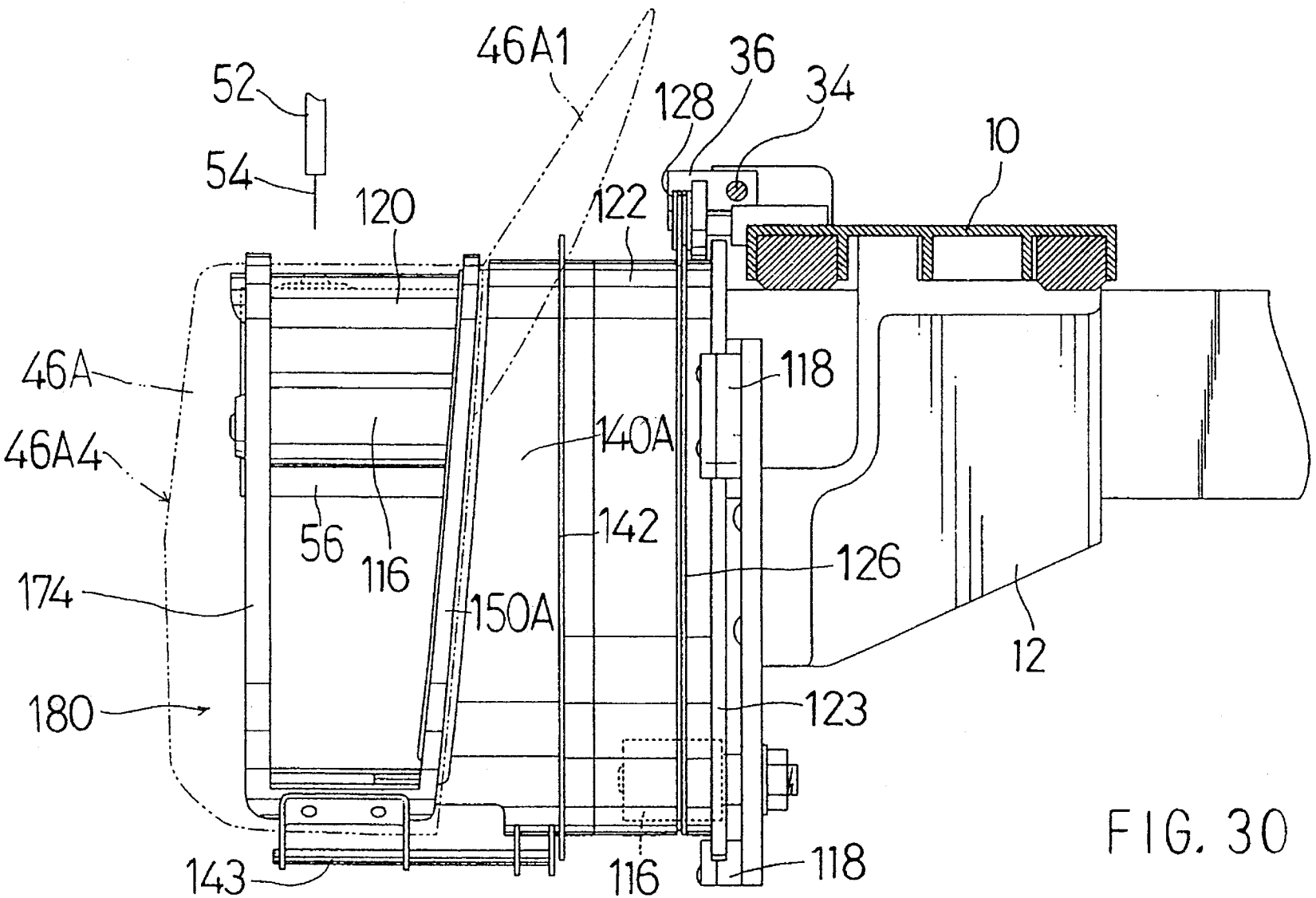
FIG. 30 is a side view of the essential parts of the embroidery machine of the tenth embodiment.
Figure 31:
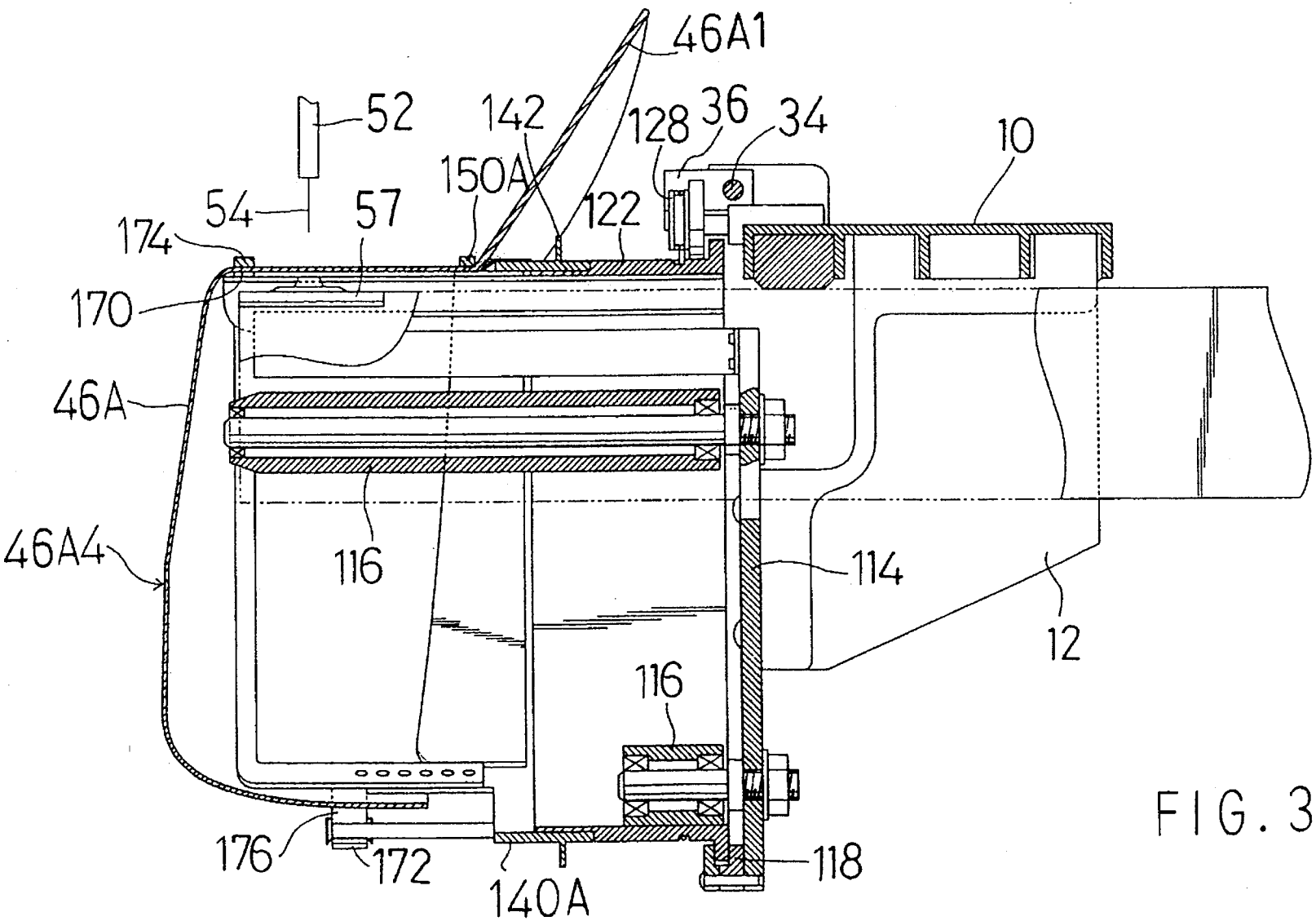
FIG. 31 is a vertical sectional view of FIG. 30.

A pressing member 180 of this embodiment includes a pressing part 150A which corresponds to the pressing member 150 of the ninth embodiment but has a narrower width than the width of the pressing member 150, so that the pressing part 150A serves to press only the edge portion of the opening of the work fabric 46A as shown in FIGS. 30 and 31. The pressing part 150A is connected to an auxiliary pressing part 174 which is adapted to be pressed toward the auxiliary retainer member 170, so that the pressing member 180 has a substantially rectangular frame-like configuration. The pressing member 180 has one end pivotally connected to the bar 143 fixed to the flange 142 of the retainer member 140A. A lock member 176 is mounted on the other end of the pressing member 180. The pressing member 180 is constructed such that the distance between the pressing part 150A and the auxiliary pressing part 174 is adjustable in response to the adjustment of position of the auxiliary retainer member 170 relative to the retainer member 140A as described above.

In this embodiment, when the work fabric 46A is set on the set surface 148 of the retainer member 140A, the auxiliary retainer member 170 is positioned inside of the work fabric 46A and adjacent the top part 46A4. Then, the pressing member 180 is bent around the work fabric 46A along the retainer member 140A and the auxiliary retainer member 170, and the lock member 176 mounted on the free end of the pressing member 180 is brought to engage a hook 172 mounted on the retainer member 140A, so that the edge portion of the opening of the work fabric 46A is pressed on the set surface 148 of the retainer member 140A by the pressing part 150A and that a portion of the work fabric 46A adjacent the top part 46A4 is pressed on the auxiliary retainer member 170 by the auxiliary pressing part 174.

The pressing part 150A includes a plurality of teeth (not shown) for engagement with the edge portion of the opening of the work fabric 46A. Further, a rubber strip (not shown) is affixed to the surface of the auxiliary pressing part 174 which contacts the work fabric 46A, so that the work fabric 46A is prevented from slippage.

Thus, with this embodiment, the work fabric 46A is stably mounted on the retainer device as shown in FIGS. 30 and 31, so that the position of the work fabric 46A can be reliably maintained during the embroidering operation. Therefore, in this embodiment, the support plate 120 mounted on the plate 114 can be eliminated.

11TH EMBODIMENT

Figure 32:
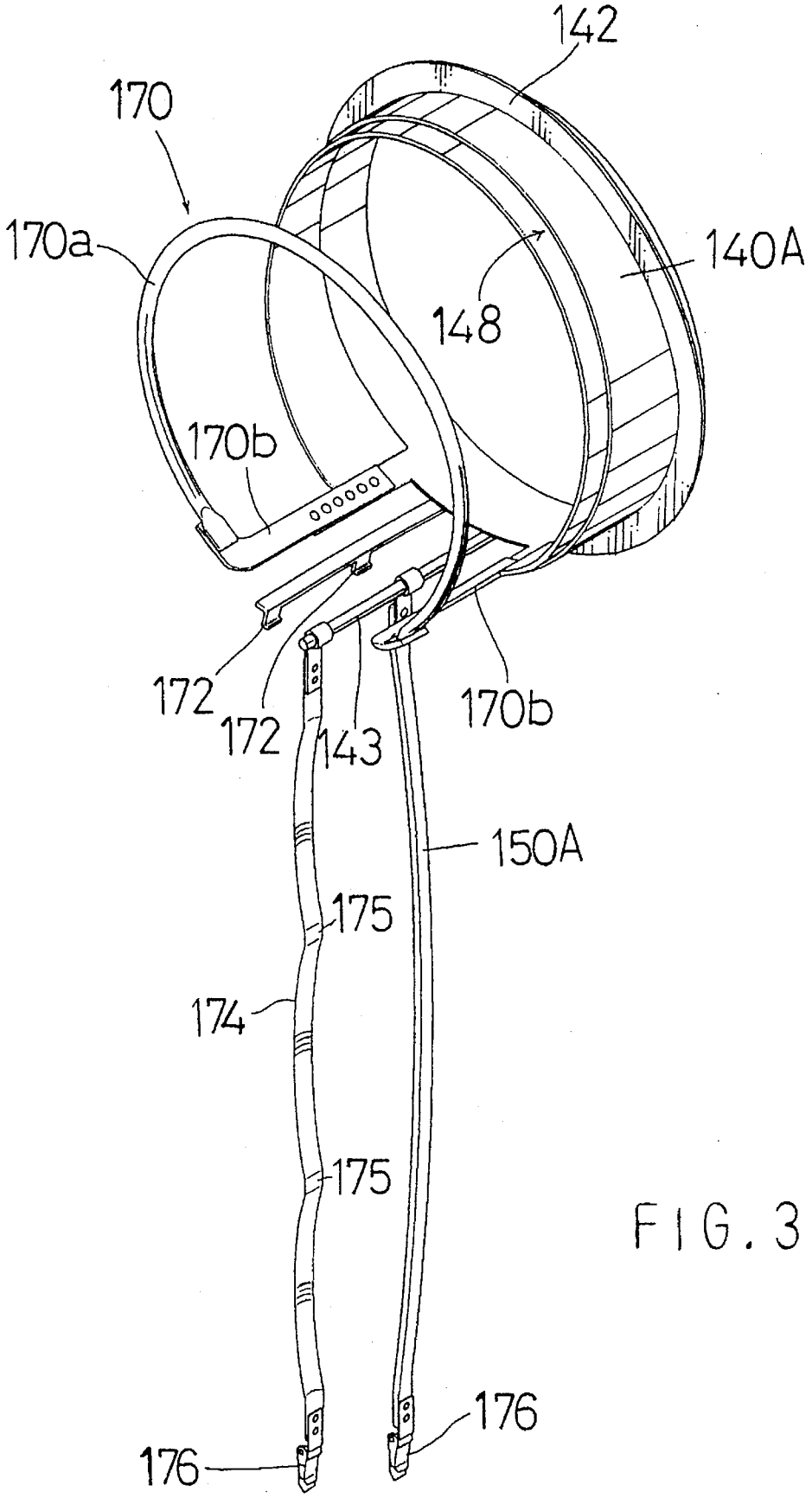
FIG. 32 is a perspective view of a retainer device of a multi-head embroidery machine according to an 11th embodiment of the present invention.

The 11th embodiment of the present invention will now be described with reference to FIG. 32. This embodiment relates to an improvement of the tenth embodiment. In a retainer device of this embodiment, the auxiliary retainer member 170 includes a round bar 170*a* which is bent in an arcuate configuration and which has both ends welded on a support arm 170*b*. The pressing part 150A and the auxiliary pressing part 174 are separated from each other. Thus, one end of each of the pressing part 150A and the auxiliary pressing part 174 is pivotally connected to the bar 143 fixed to the flange 142 of the retainer member 140A, while the other end of each of them being a free end on which the lock member 176 is mounted.

In this embodiment, the auxiliary pressing part 174 is made of a belt-like stainless-steel plate and has three bent sections separated by flat sections 175 in a longitudinal direction. Each of the bent sections is curved in a widthwise direction, so that each of the bent sections overlaps with the round bar 170*a* by substantially one third of the circumferential length in section thereof. Further, each of the bent sections are also curved in the longitudinal direction to have a curvature corresponding to the curvature of the round bar 170*a* in the lengthwise direction. The auxiliary pressing part 174 is permitted to resiliently deform at the flat sections 175, so that the auxiliary pressing part 174 can overlap with the round bar 170*a* by substantially the whole length thereof and that it can recover an original shape shown in FIG. 32 when it is released.

The work fabric 46A is set on the retainer device of this embodiment as will be hereinafter explained. Firstly, the edge portion of the opening of the work fabric 46A is set on the set surface 148 of the retainer member 140A in the state shown in FIG. 32. Then, the pressing part 150A is bent around the work fabric 46A along the retainer member 140A, and the lock member 176 is brought to engage the hook 172 of the retainer member 140A for locking engagement. The auxiliary pressing part 174 is thereafter bent around the work fabric 46A along the auxiliary retainer member 170, while applying a suitable tension to the embroidery part of the work fabric 46A. The lock member 176 of the auxiliary retainer member 170 is then brought to engage the hook 172 of the retainer member 140A.

Since the work fabric 46A can be retained separately at the edge portion of the opening and at the portion adjacent the top part 46A4, the work fabric 46A can be set on the retainer device to keep a suitable position. With respect to the portion adjacent the top part 46A4, it can be reliably retained since this portion is held between the outer peripheral surface of the round bar 170*a* of the auxiliary retainer part 170 and the auxiliary retainer member 174 which is bent as described above.

12th to 14th embodiments of the present invention will now be explained with reference to FIGS. 33 to 44. These embodiments relate to improvements of a motion conversion device incorporating the cord-like member 37 for converting the liner movement of the X-axis drive member 2 into the rotational movement of the rotary member 30 as described in the first embodiment. In FIGS. 33 to 44, the same numerals are affixed to the same parts as the first embodiment.

12TH EMBODIMENT

Figure 33:
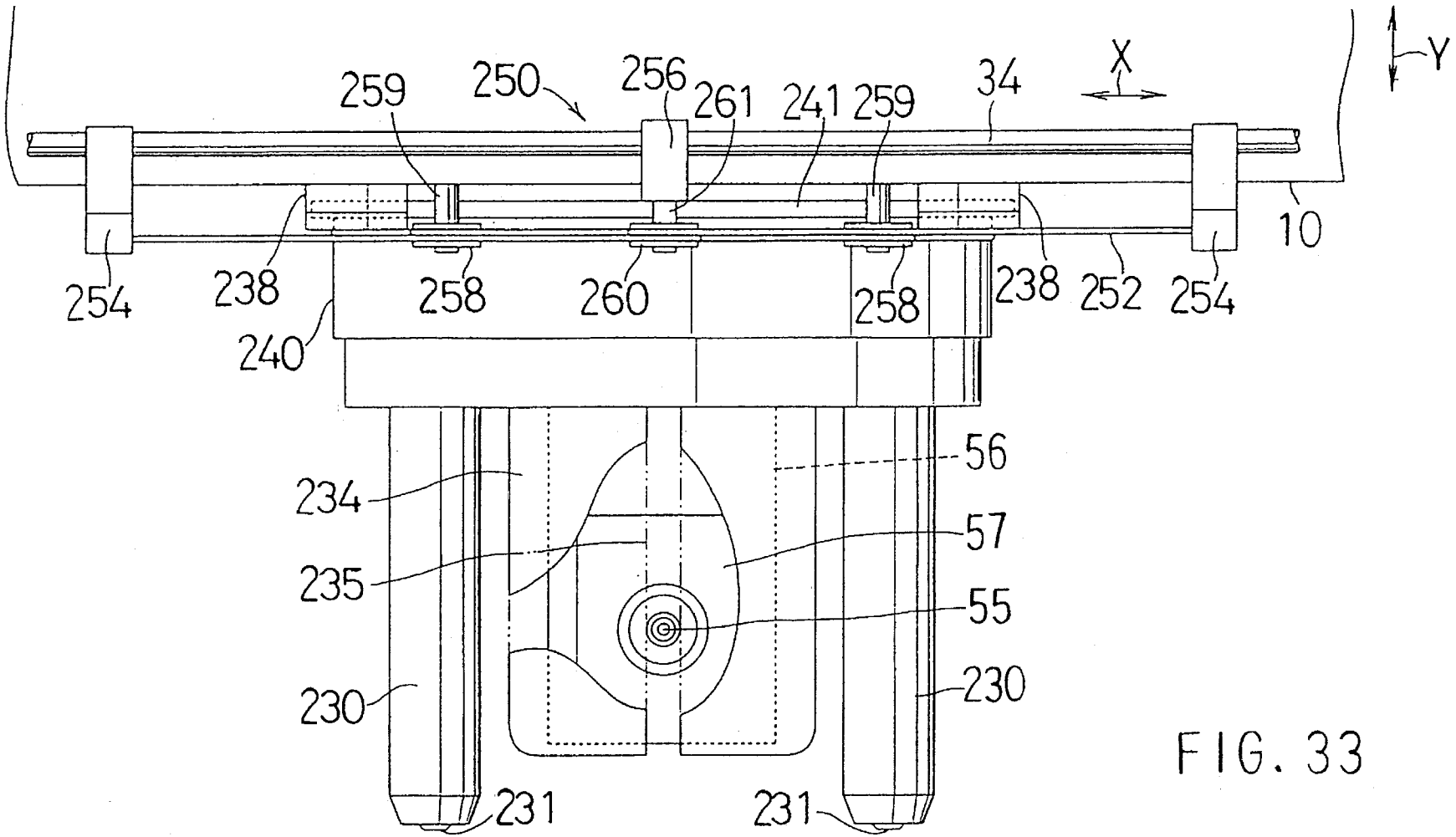
FIG. 33 is a plan view of the essential parts of a multi-head embroidery machine according to a 12th embodiment of the present invention.
Figure 34:
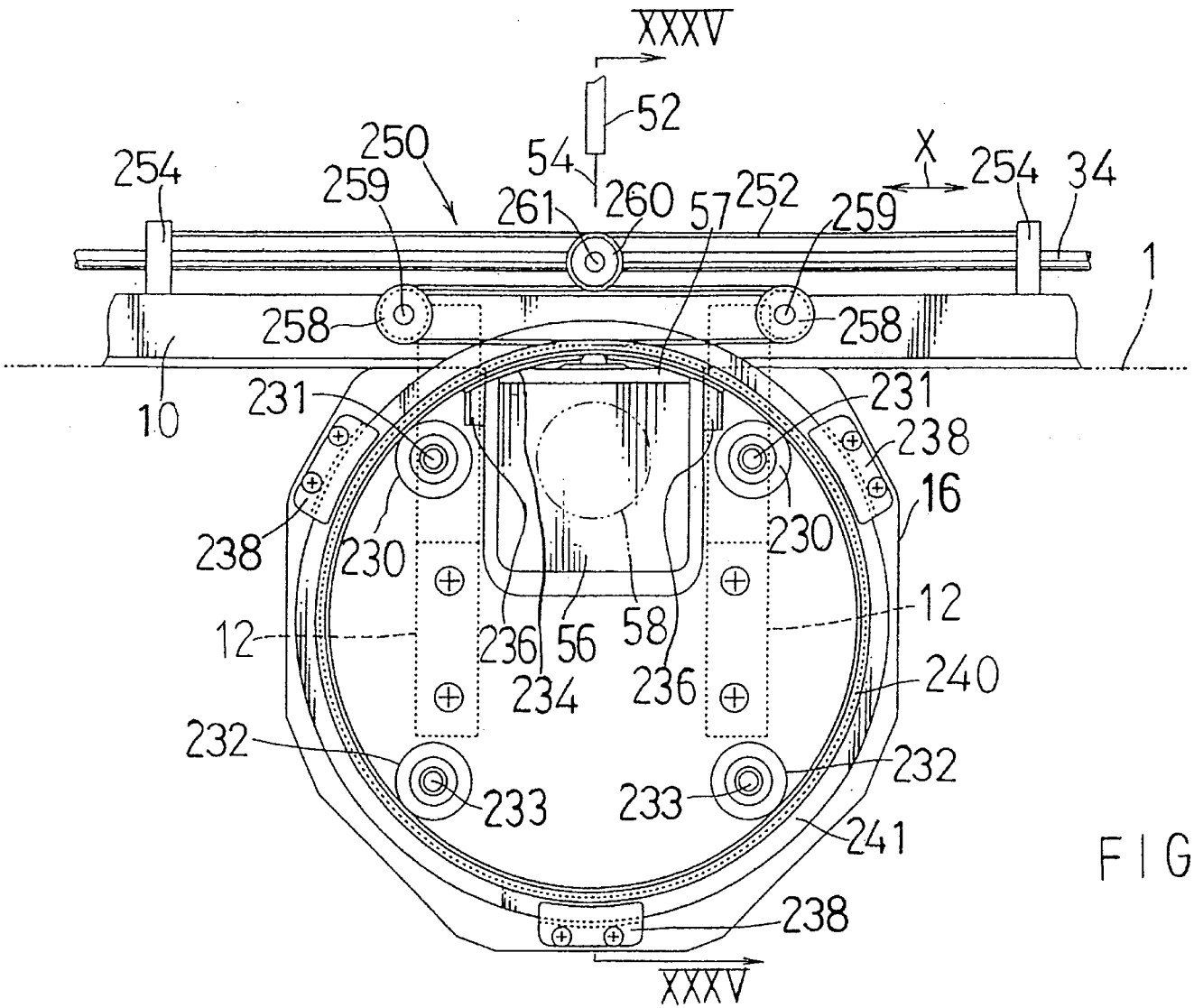
FIG. 34 is a front view of FIG. 33.
Figure 35:
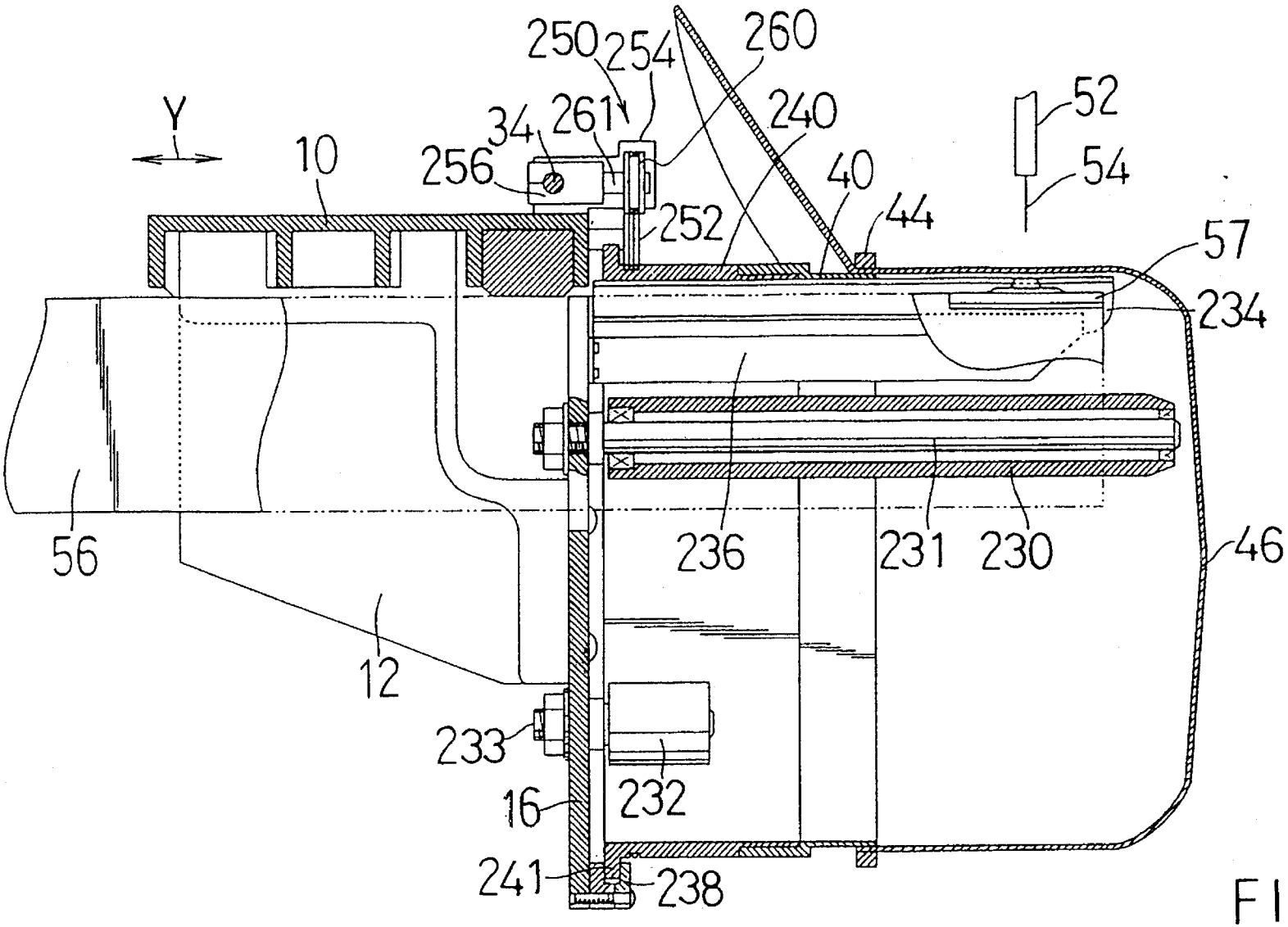
FIG. 35 is a sectional view taken along line XXXV—XXXV in FIG. 34.

The 12th embodiment will now be explained with reference to FIGS. 33 to 36. As shown in FIGS. 33 to 35, a support plate 234 is fixed to the plate 16 by means of brackets 236. The plate 16 is fixed to the Y-axis drive member 10 by means of the support bases 12 as described in the first embodiment. The support plate 234 has an arcuate configuration in section and is disposed above the shuttle base 56 so as to support a part of the inner peripheral surface of the work fabric 46 to be embroidered. A slot 235 corresponding to the needle slot 24 of the first embodiment is formed on the support plate 234 and extends in the direction of Y axis. The slot 235 has the length corresponding to at least the movable range of the Y-axis drive member 10.

Two pairs of rollers 230 and 232 are mounted on the upper portion and lower portion of the plate 16, respectively. As shown in FIG. 35, each of the rollers 230 is rotatably supported by a roller shaft 231 having one end connected to the plate 16. Each of the rollers 232 is rotatably supported by a roller shaft 233 having one end connected to the plate 16. As shown in FIGS. 33 and 35, each of the rollers 230 positioned at the upper portion extends forwardly beyond the support plate 234 and has a tapered front end. The tapered front end serves to support the inner peripheral surface of the work fabric 46 so as to prevent the work fabric 46 from slidably moving in the circumferential direction through contact with the front end of the support plate 234 as will be explained later. The rollers 232 positioned downwardly do not require to perform such function, and therefore, they have a shorter length than the rollers 230 to reduce the weight of the embroidery machine.

A rotary member 240 corresponding to the rotary member 30 of the first embodiment is rotatably supported by the rollers 230 and 232. The rotary member 240 thus supported is positioned to surround the support plate 234 such that the rotary member 240 slightly contacts the upper surface (arcuate surface) of the support member 234. An outer flange 241 is formed on the rear end (on the side of the plate 16) of the rotary member 240 and is slidably fitted into three guide members 238 fixed to the plate 16. Thus, the rotary member 240 is rotatable relative to the support plate 238 but is prevented from movement in the direction of Y axis relative to the support plate 238 by means of the guide members 238.

As shown in FIG. 35, the ring-like retainer member 40 is detachably mounted on the rotary member 240. The work fabric 46 having the cylindrical embroidery part is set on the retainer member 40 by means of the pressing member 44 as described in the first embodiment.

A motion conversion device 250 for converting the linear movement of the X-axis drive member 2 into the rotational movement of the rotary member 250 will now be explained. A pair of pulley shafts 259 are fixedly mounted on the front surface of the Y-axis drive member 10 at symmetrical positions with respect to the rotational axis of the rotary member 240. A pulley 258 (hereinafter called "fixed pulley 258") is rotatably supported by each of the pulley shafts 259. Two blocks 254 for slidably supporting the rod 34 is fixed to the upper surface of the Y-axis drive member 10 at symmetrical positions with respect to the rotational axis of the rotary member 240. A block 256 is fixed to the rod 34 at a position between the blocks 254. A pulley 260 (hereinafter called "movable pulley 260") is rotatably supported on a pulley shaft 261 which is fixed to the block 256.

Figure 36:
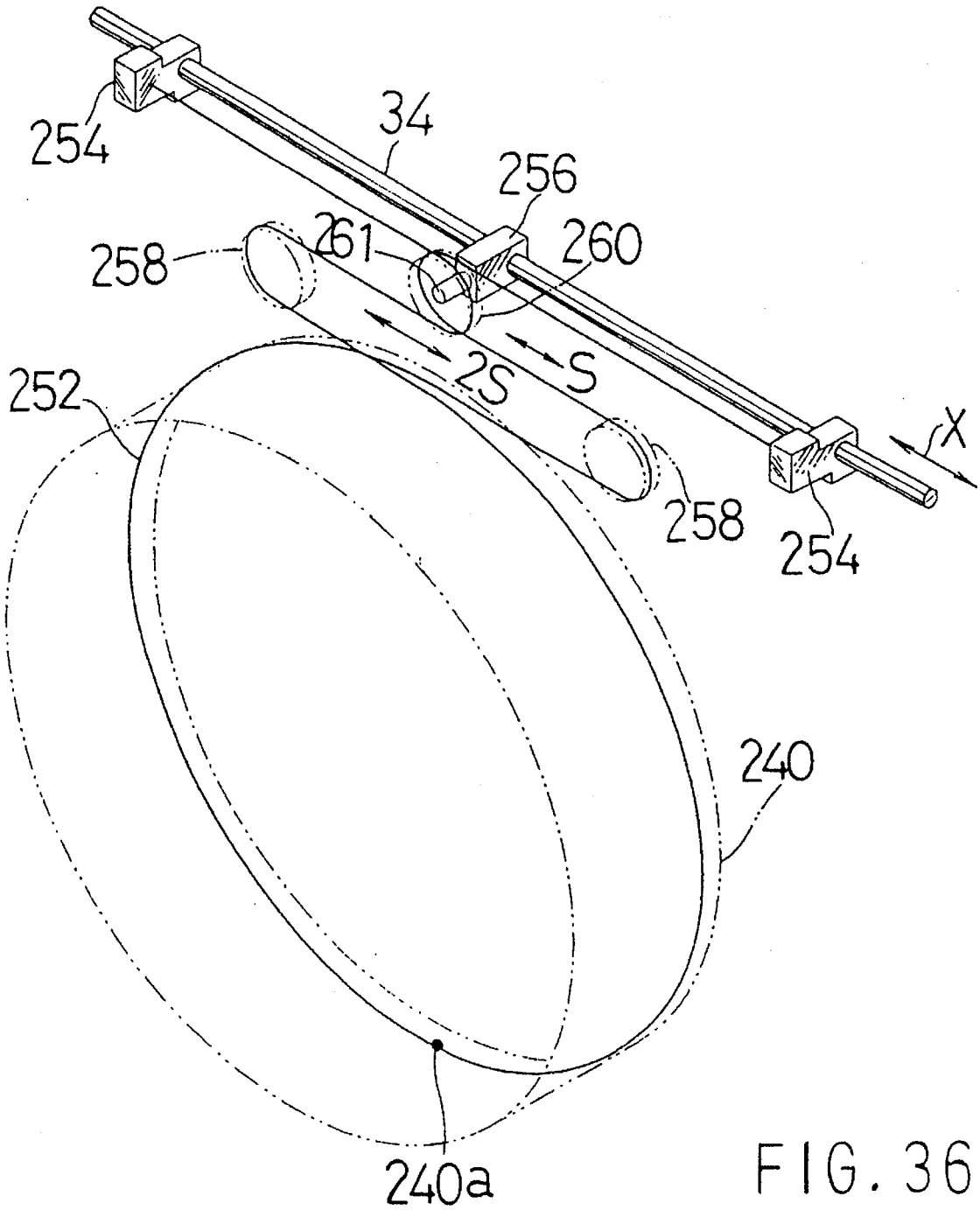
FIG. 36 is a perspective view showing the path of a cord-like member shown in FIG. 33.

A cord-like member 252 such as a wire and a steel belt is passed over a circumferential recess formed on the outer peripheral surface of the rotary member 240 at a position adjacent the flange 241. As shown in FIG. 36, both ends of the cord-like member 252 are passed over the fixed pulleys 258, respectively, for changing their directions, and are thereafter passed over the movable pulley 260 for again changing their directions. These ends are then connected to the blocks 254, respectively. The cord-like member 252 is fixed to the rotary member 240 at a point 240*a* within the length of the circumferential recess of the rotary member 240.

When the rod 34 is moved in the direction of X axis such that the movable pulley 260 is moved by a distance S shown in FIG. 36, due to the fixed pulleys 258, the cord-like member 252 is moved by a distance 2S which is twice the distance S. Therefore, the rotary member 240 is rotated by the distance 2S in the circumferential direction. This means that the movement of the X-axis drive member 2 is transmitted to the rotational member 240 such that the moving amount becomes twice at the rotational member 240.

The driving amount of the X-axis drive devices 11 may only have a value half the moving amount (rotational amount) in the circumferential direction of the work fabric 46, so that the driving length of each of the X-axis drive devices 11 (the length of the belt) can be shortened.

However, the data of pattern to be embroidered and the rotational amount must have one-to-one relationship with each other for embroidering the pattern according to the data. Therefore, in this embodiment, the data is converted previously such that the driving amount of the X-axis drive devices 11 becomes half the amount for the original data. Otherwise, the output of a driver circuit (not shown) of the pulse motor of the each of X-axis drive devices 11 is adjusted such that the driving amount of the pulse motor becomes half the original driving amount, while the data is not converted.

During the embroidery operation, the work fabric 46 is rotated relative to the support plate 234. Since the rollers 230 are positioned on both sides of the support plate 234 and extend forwardly beyond the support plate 234, the inner peripheral surface of the work fabric 46 is supported by the tapered front ends of the rollers 230 which are free to rotate. Therefore, the work fabric 46 is prevented from sliding contact with the support plate 234.

13TH EMBODIMENT

Figure 37:
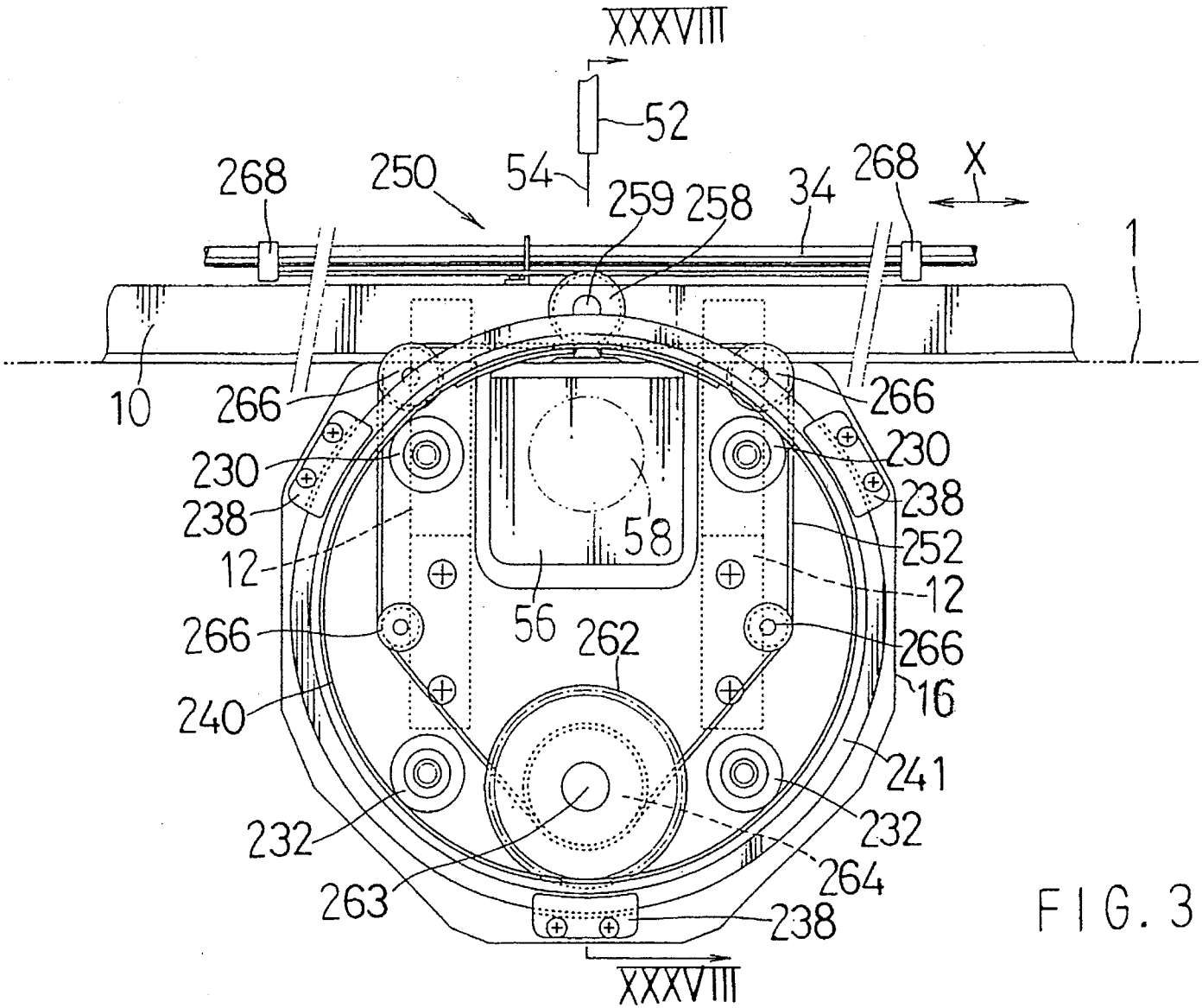
FIG. 37 is a front view of the essential parts of a multi-head embroidery machine according to a 13th embodiment of the present invention.
Figure 38:
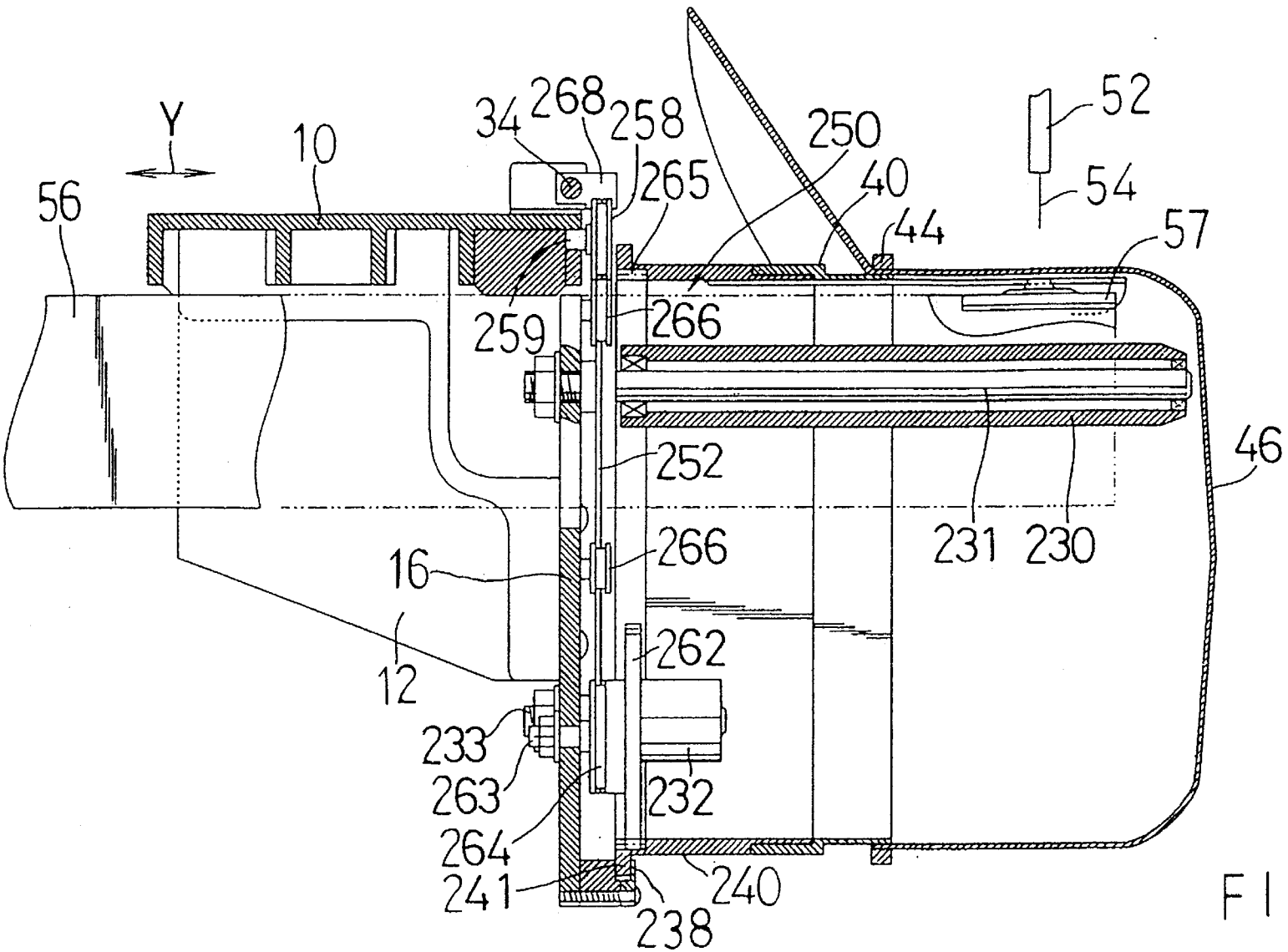
FIG. 38 is a sectional view taken along line XXXVIII—XXXVIII in FIG. 37.

The 13th embodiment of the present invention will now be explained with reference to FIGS. 37 to 39. This embodiment relates to a modification of the motion conversion device 250 of the above embodiment and includes a drive gear 262 and a drive pulley 264 mounted on a gear shaft 263 fixed to the plate 16. The drive gear 262 and the drive pulley 264 are rotatable together relative to the gear shaft 263. A driven gear 265 is formed by a timing belt attached to the inner peripheral surface of the rotary member 240. The driven gear 265 is in engagement with the drive gear 262.

The ratio of the diameter of the drive pulley 264 to the diameter of the drive gear 262 is 1 to 2, so that the circumferential speed of the drive gear 62 is twice the circumferential speed of the drive pulley 264.

Four pulleys 266 are rotatably mounted on the front surface of the plate 16 at positions above the drive gear 262 (drive pulley 264) such that two of the pulleys 266 are positioned above the other two of the pulleys 266. A fixed pulley 258 is rotatably mounted on the front surface of the Y-axis drive member 10 at a central position corresponding to the drive gear 262 (drive pulley 264).

Figure 39:
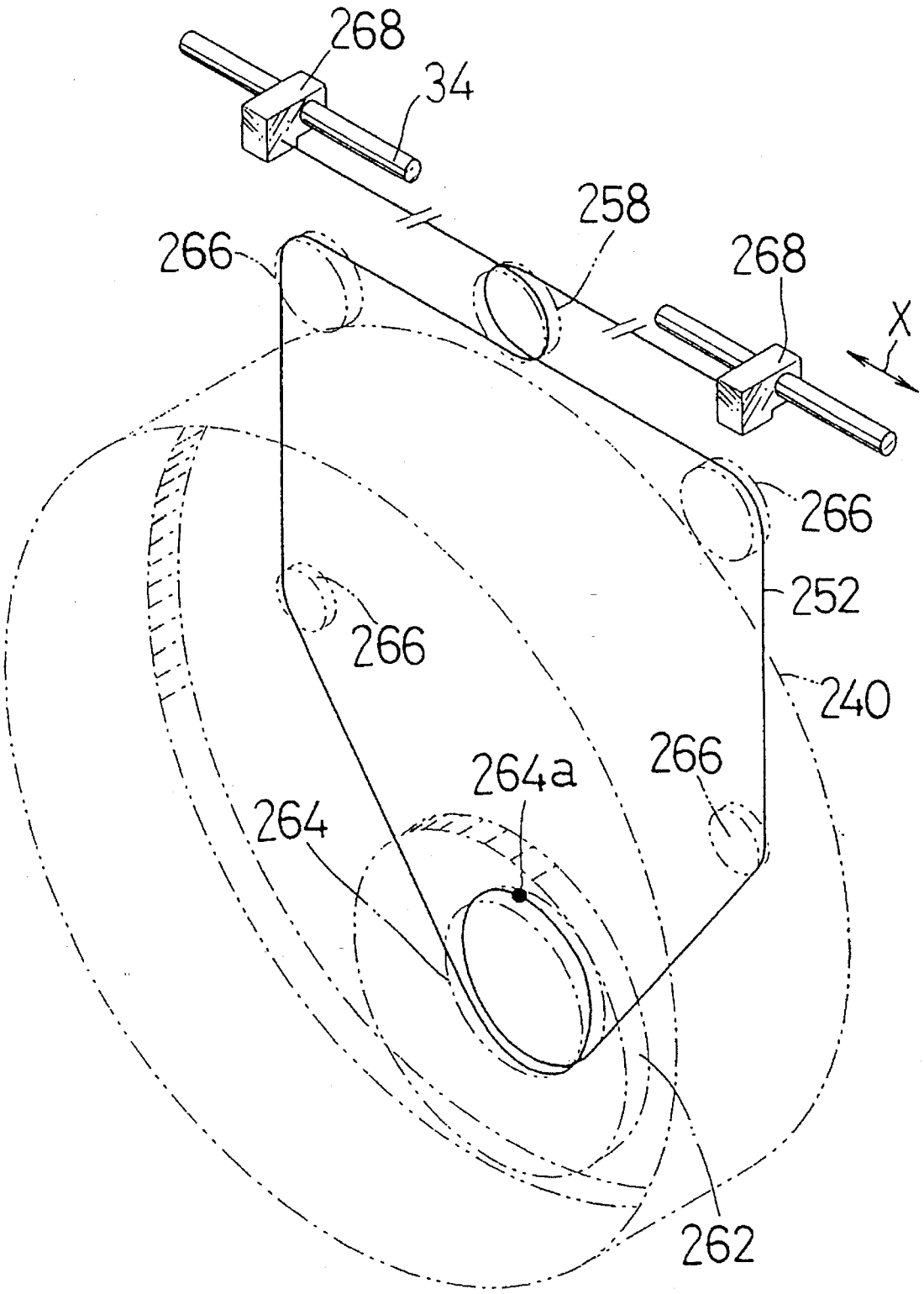
FIG. 39 is a perspective view of the path of a cord-like member shown in FIG. 37.

In this embodiment, the cord-like member 252 is not passed over the rotary member 240 but is passed over the drive pulley 264 as shown in FIG. 39. As will be seen from FIG. 39, each end of the cord-like member 252 extending from the drive pulley 264 is passed over corresponding upper one and lower one of the pulleys 266 and is then passed over the fixed pulley 258 of the Y-axis drive member 10, such that both ends of the cord-like member 252 are passed to the fixed pulley 258 from opposite directions and that their directions are inverted at the fixed pulley 258. Both ends of the cord-like member 252 are then connected to a pair of blocks 268 fixed to the Y-axis drive member 10. A part of the cord-like member 252 is fixed to the drive pulley 264 at a position 264*a* in the circumferential direction.

With this embodiment, the drive pulley 264 and the drive gear 262 are rotated by means of the cord-like member 252 as the rod 34 is moved in the direction of X-axis. As described above, the circumferential speed of the drive gear 262 is twice the circumferential speed of the drive pulley 264, so that twice the distance of movement of the rod 34 (driving amount of each of the X-axis drive devices 11) is transmitted to the rotary member 240.

Particularly in this embodiment, the ratio of increase of the driving amount can be selectively determined by varying the ratio of the diameter of the drive pulley 264 relative to the diameter of the drive gear 262. In this case, the data of pattern for driving the X-axis drive devices 11 should be converted in response to the ratio of increase.

Figure 40:
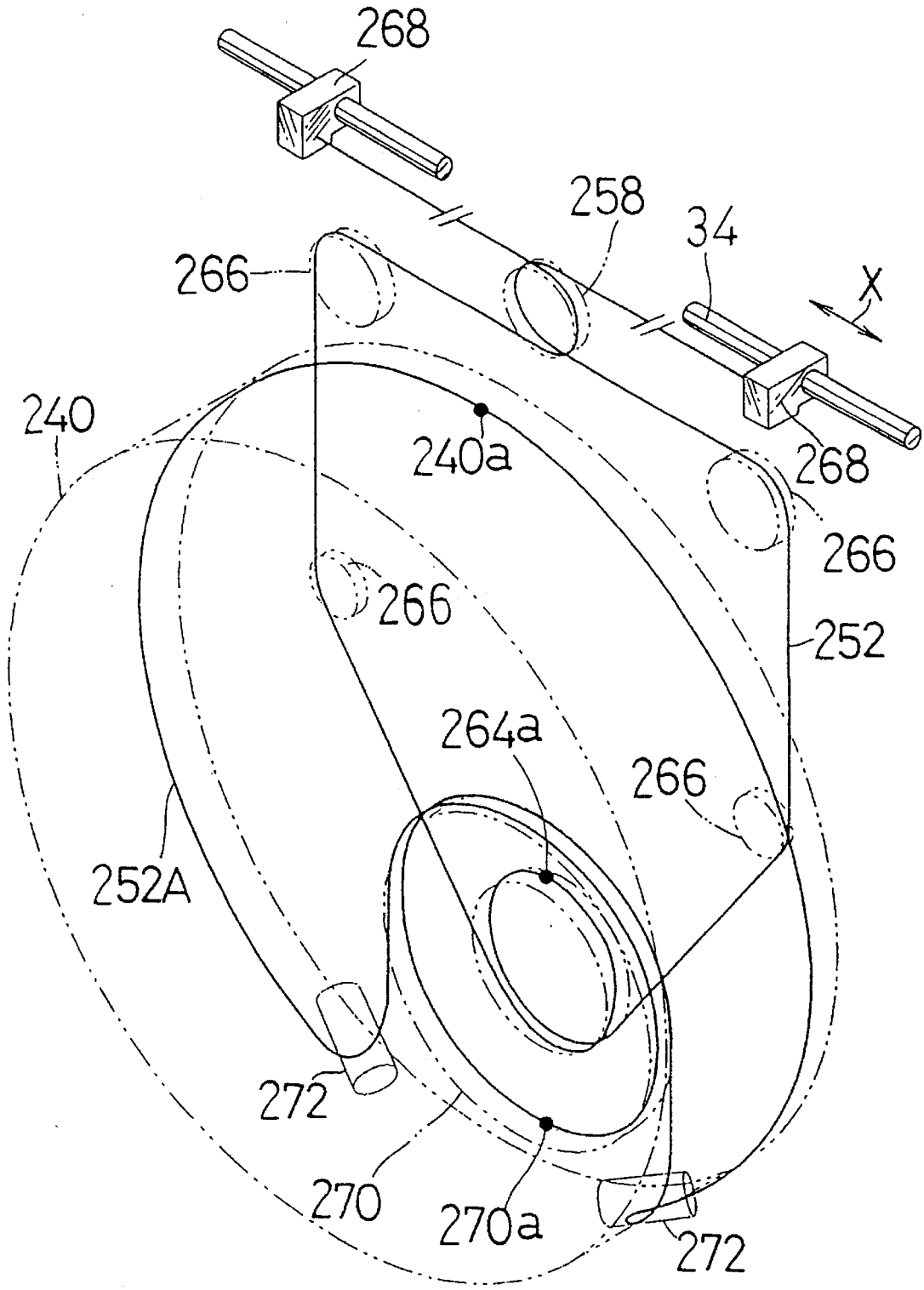
FIG. 40 is a perspective view showing a modification of the path of the cord-like member shown in FIG. 39.
Figure 41:
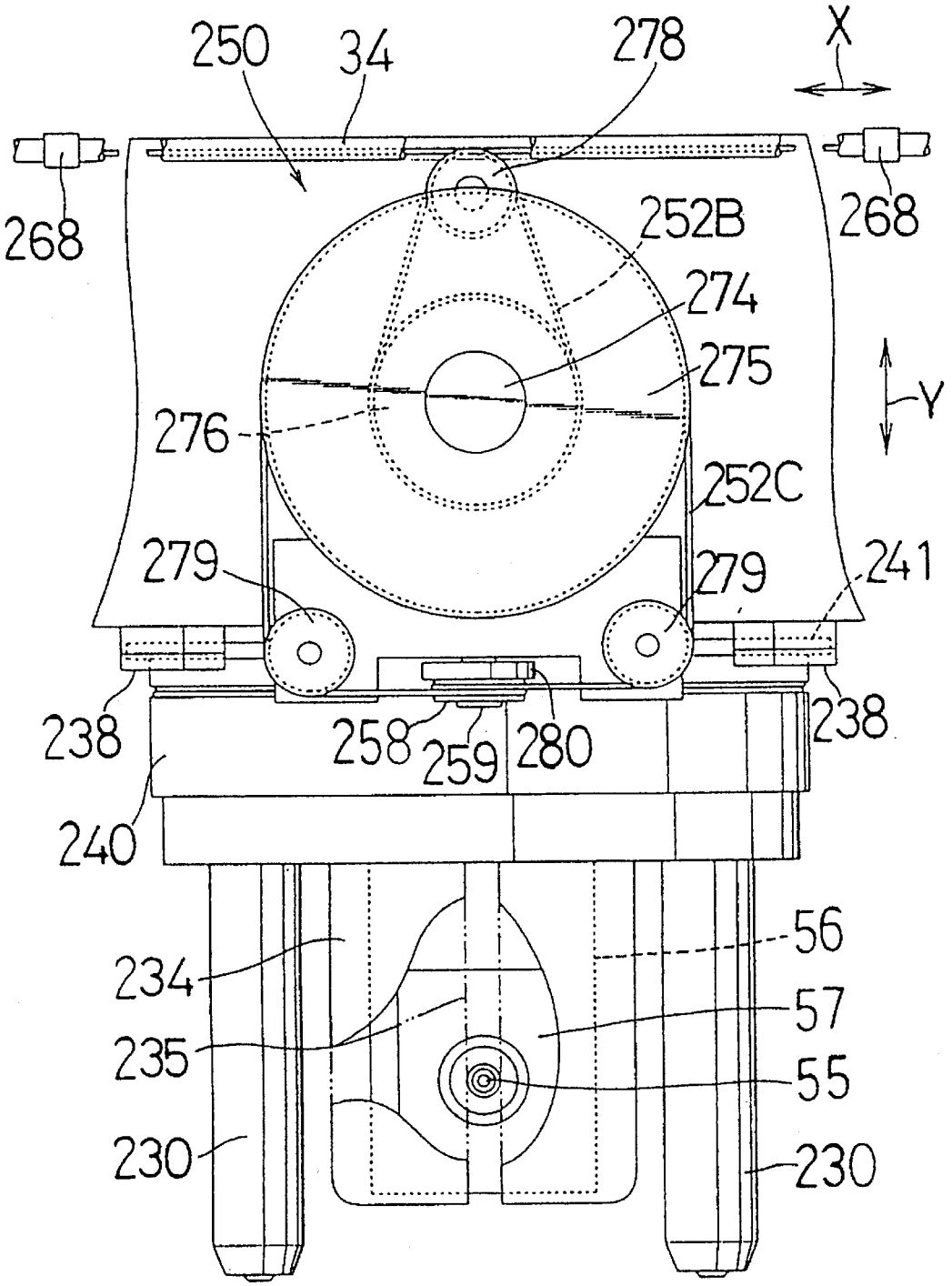
FIG. 41 is a plan view of the essential parts of a multi-head embroidery machine according to a 14th embodiment of the present invention.

This embodiment can be modified as shown in FIG. 40 in which a pulley 270 is incorporated in place of the drive gear 262. A second cord-like member 252A is passed over the pulley 270 and is fixed to the pulley 270 at a position 270*a* in the circumferential direction. The second cord-like member 252A is then passed over the outer periphery of the rotary member 240 via inclined rollers 272 to form a closed loop and is fixed thereto at a position 240*a*. With this construction, the final stage of transmission of driving from the X-axis drive devices 11 to the rotary member 240 can be performed by the second cord-like member 252A in place of the gear transmission of the above embodiment.

Further, in the 13th embodiment, a rack and pinion mechanism can be incorporated in place of the transmission mechanism between the rod 34 and the fixed pulley 258 of the Y-axis drive member 10. In this case, the cord-like member 252 is passed between the fixed pulley 258 and the drive pulley 264 via the pulleys 266 of the plate 16 to form a closed loop.

14TH EMBODIMENT

The 14th embodiment of the present invention will now be described with reference to FIGS. 41 to 44. In this embodiment, a pulley shaft 274 is fixed to the Y-axis drive member 10 at the central position corresponding to the rotational axis of the rotary member 240. A large pulley 275 and a small pulley 276 are mounted on the pulley shaft 274 and are rotatable together relative to the pulley shaft 274. The ratio of the diameter of the small pulley 276 to the diameter of the large pulley 275 is 1 to 2. An inverting pulley 278 and a pair of guide pulleys 279 are rotatably mounted on the upper surface of the Y-axis drive member 10 at a position rearward of the large pulley 275 and a position forward of the same, respectively. An abutting roller 280 is rotatably mounted on the pulley shaft 259 of the fixed pulley 258 which is mounted on the front surface of the Y-axis drive member 10. The abutting roller 280 serves to rotate through contact with the outer peripheral surface of the rotary member 240.

Figure 44:
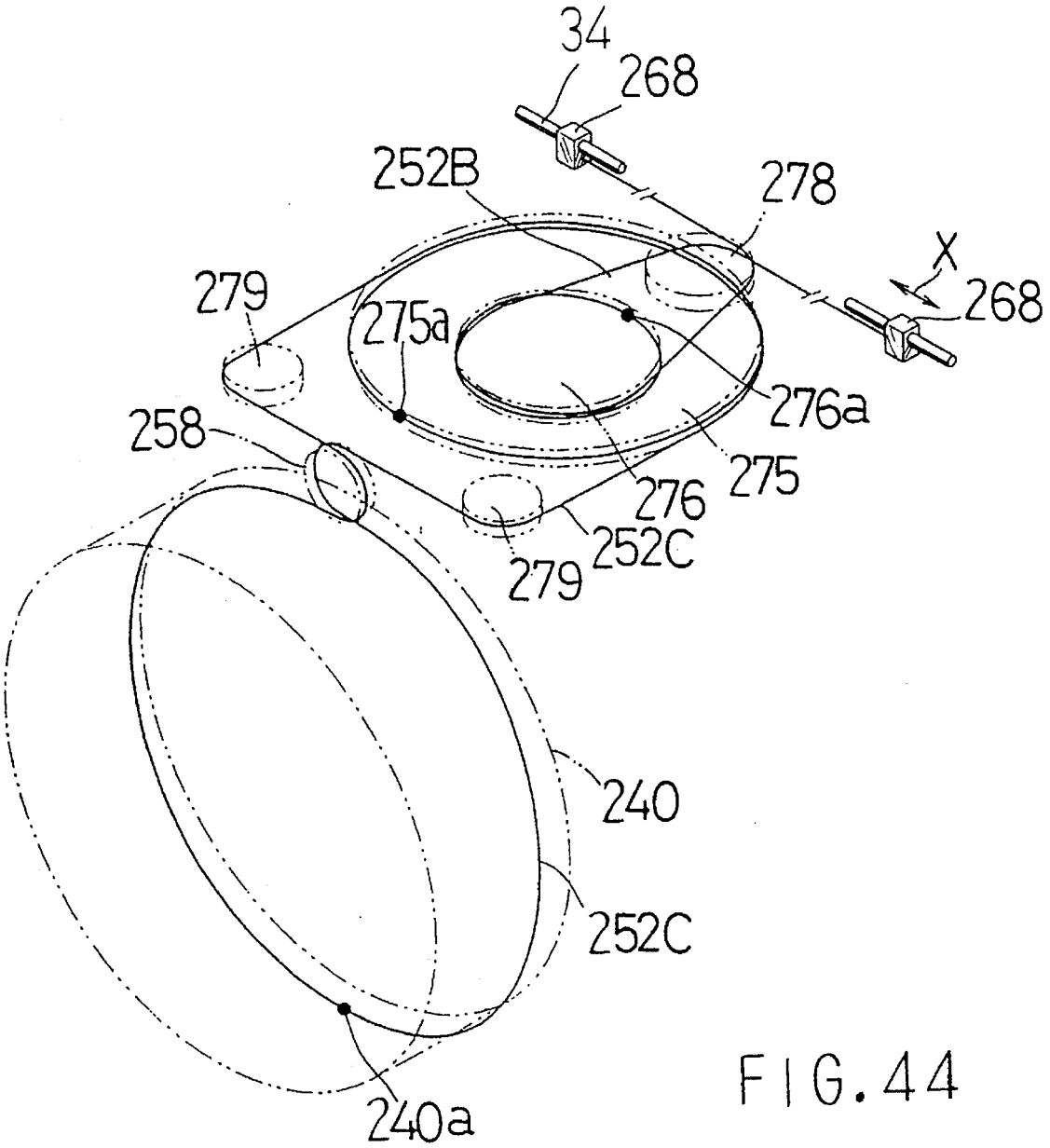
FIG. 44 is a perspective view showing the path of a cord-like member of the 14th embodiment.
Figure 45:
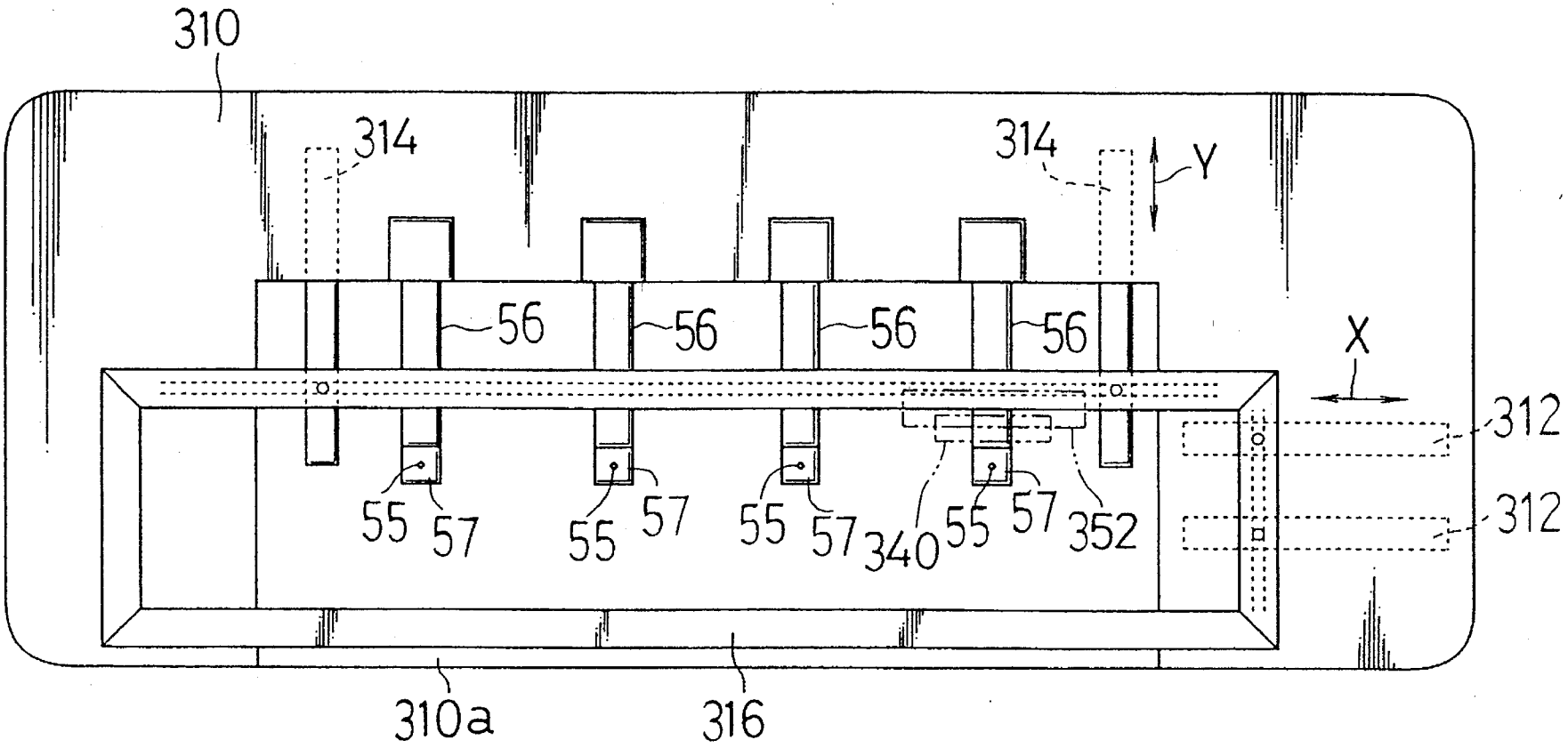
FIG. 45 is a plan view of a multi-head embroidery machine according to a 15th embodiment of the present invention.
Figure 46:
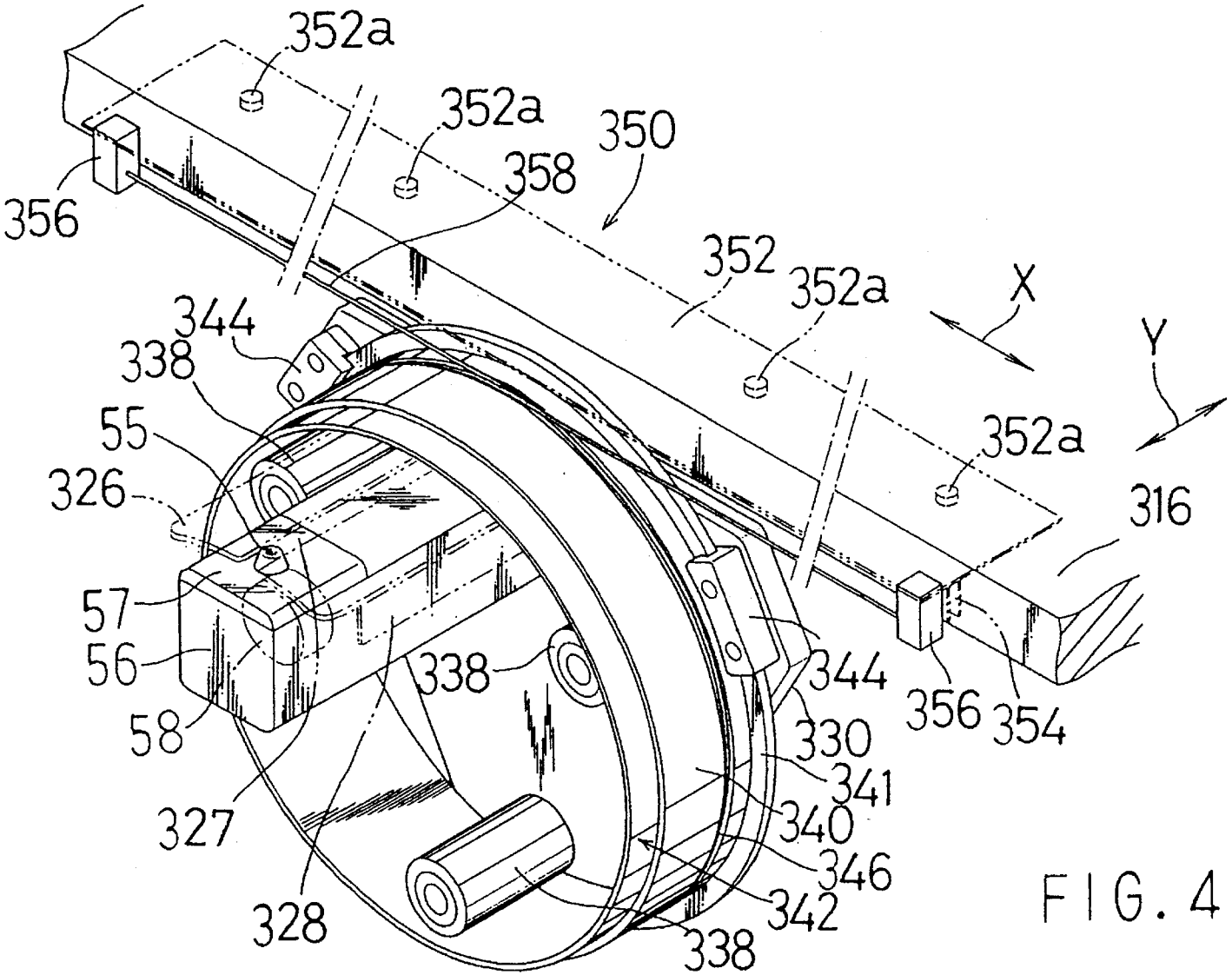
FIG. 46 is a perspective view showing a mechanism for driving a retainer device of the 15th embodiment.

In this embodiment, two cord-like members 252B and 252C are incorporated as shown in FIG. 44. The cord-like member 252B is passed over the small pulley 276 and is fixed thereto at a position 276*a* in the circumferential direction. Both ends of the cord-like member 252B are passed over the inverting pulley 278 from the opposite directions, so that their directions are inverted at the inverting pulley 278. The ends of the cord-like member 252B are connected to the blocks 268 fixed to the rod 34.

Figure 42:
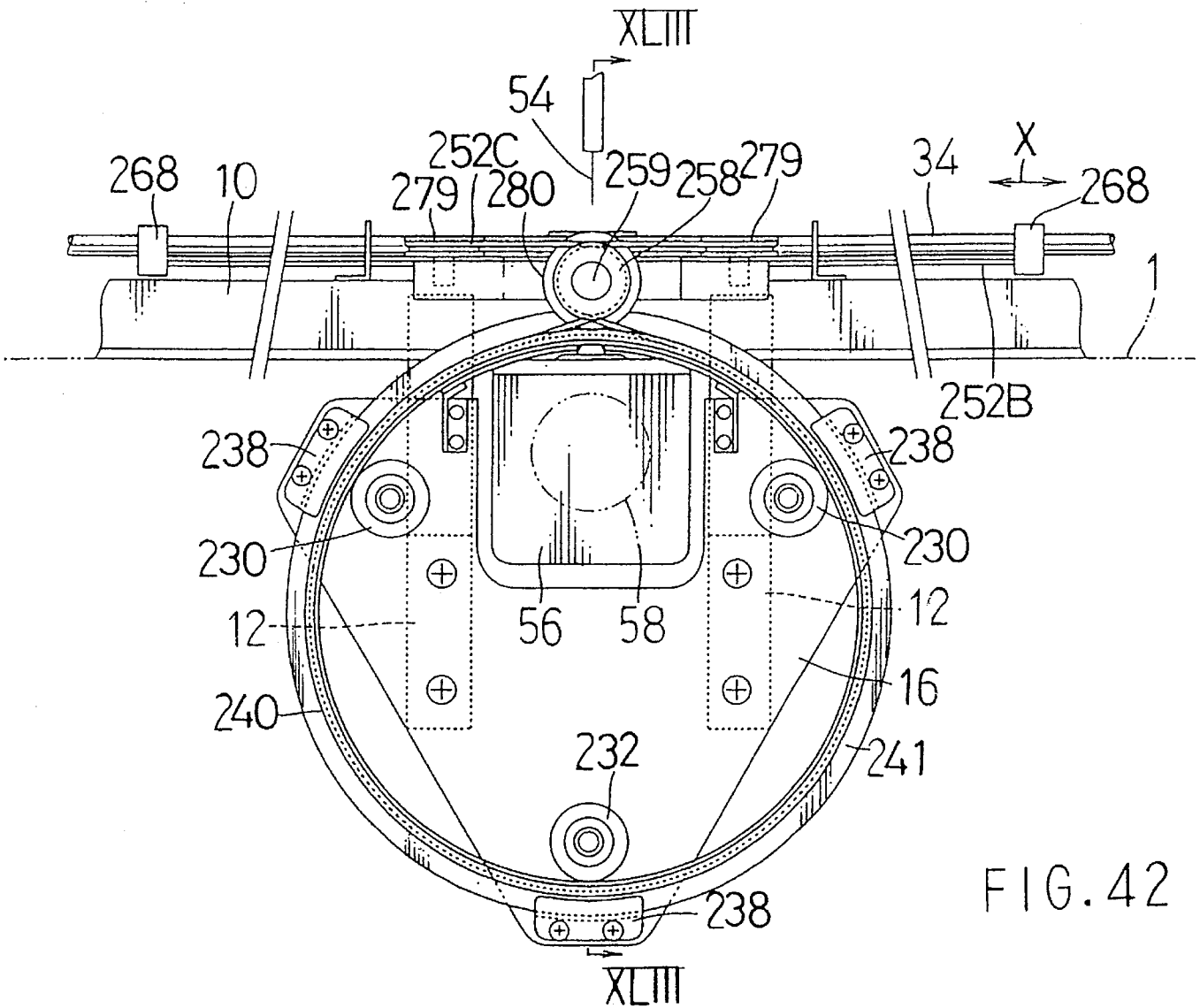
FIG. 42 is a front view of FIG. 41.
Figure 43:
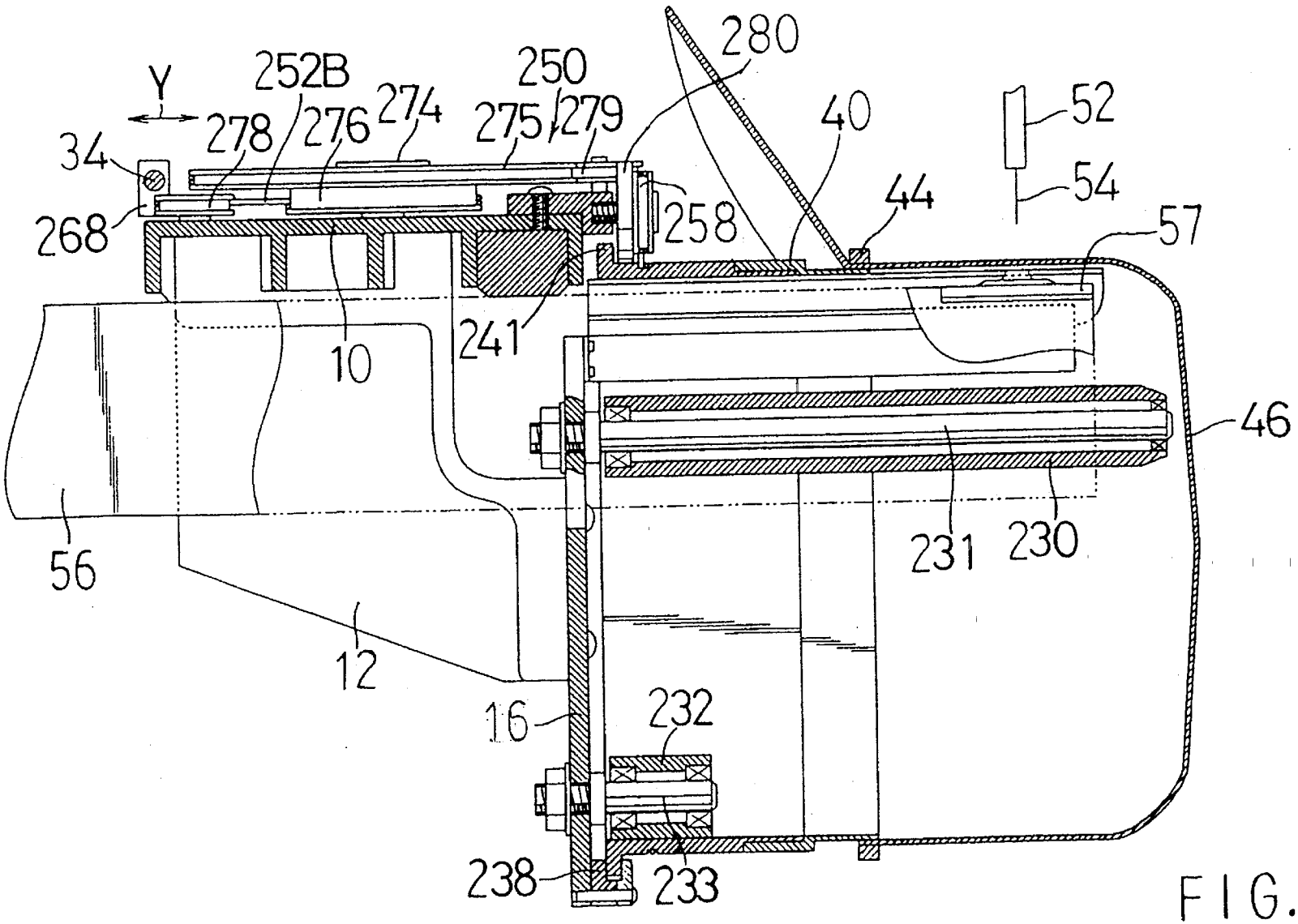
FIG. 43 is a sectional view taken along line XLIII—XLIII in FIG. 42.

As shown in FIGS. 42 and 43, the cord-like member 252C is passed over the circumferential recess formed on the rotary member 240 and is fixed thereto at the position 240*a* in the circumferential direction. As shown in FIG. 44, both ends of the cord-like member 252C extending from the rotary member 240 are then passed over the fixed pulley 258, so that the directions of the ends are inverted at the fixed pulley 258. The ends are thereafter passed over the large pulley 275 via the guide pulleys 279 so as to form a closed loop. The cord-like member 252C is fixed to the large pulley 275 at a position 275*a* in the circumferential direction.

In this embodiment, as the rod 34 is moved in the direction of X axis, the small pulley 276 rotates together with the large pulley 275 by means of the cord-like member 252B. The circumferential speed of the large pulley 275 is twice the circumferential speed of the small pulley 276 and the rotation of the large pulley 275 is then transmitted to the rotary member 240 via the cord-like member 252C. Consequently, twice the moving amount of the rod 34 (twice the driving amount of the X-axis drive devices 11) is transmitted to the rotary member 240. As previously explained, the abutting roller 280 normally abuts on the outer peripheral surface of the rotary member 240, and therefore, the rotary member 240 may not be lifted by the tension of the cord-like member 252C.

Also in this embodiment, the ratio of increase in driving amount of transmission from the X-axis drive devices 11 to the rotary member 240 can be selectively determined by varying the ratio of the diameter of the large pulley 275 relative to the diameter of the small pulley 276.

Further in this embodiment, a rack and pinion mechanism can be incorporated in place of the transmission mechanism between the rod 34 and the fixed pulley 278 of the Y-axis drive member 10. In this case, the cord-like member 252B is passed between the inverting pulley 278 and the small pulley 276 to form a closed loop.

15th to 17th embodiments of the present invention will now be described with reference to FIGS. 45 to 55. These embodiments relate mainly to improvements of a drive mechanism of a multi-head embroidery machine having a drive member such as an embroidery frame which is driven in both X-axis and Y axis directions, and in the drawings, the same numerals are affixed to the same parts (the parts of the sewing head and the shuttle base) as the first embodiment.

15TH EMBODIMENT

The 15th embodiment will now be explained with reference to FIGS. 45 to 50. A multi-head embroidery machine shown in FIG. 45 includes a machine table 310. Four shuttle bases 56 are arranged in row in the widthwise direction (longitudinal direction) of the machine table 310. The upper surface of each of the shuttle bases 56 is positioned at the same level as the upper surface of the machine table 310. The machine table 310 has an elevator portion 310*a* which covers an area including the area corresponding to the shuttle bases 56 and which is movable up and down relative to the machine table 310. The elevator portion 310*a* is normally positioned at the same level as the upper surfaces of the shuttle bases 56.

Although not shown in the drawings, the sewing heads 50 as described in connection with the first embodiment are positioned above the corresponding shuttle bases 56.

X-axis drive devices 312 and Y-axis drive devices 314 corresponding to the X-axis drive devices 11 and the Y-axis drive devices 13 of the first embodiment, respectively, are disposed below the machine table 310. Thus, each of the X-axis drive devices 312 includes a pulse motor and a belt (not shown) driven in the direction of X-axis by the pulse motor based on the data of pattern with respect to X axis, and each of the Y-axis drive devices 314 includes a pulse motor and a belt (not shown) driven in the direction of Y-axis by the pulse motor based on the data of pattern with respect to Y axis.

An embroidery frame 316 is mounted on the machine table 310 and is driven by both the X-axis drive devices 312 and the Y-axis drive devices 314. Thus, the embroidery frame 316 is moved in both directions of X-axis and Y-axis when the belts of the X-axis drive devices 312 and the Y-axis drive devices 314 are driven.

The embroidery frame 316 is adapted for setting a flat cloth thereon. In case of setting of a flat cloth having a large area, the embroidery frame 316 is constructed to have a single frame member. On the other hand, in case of setting of a plurality of flat cloths each having a small area, the embroidery frame 316 is constructed to have a plurality of frame members.

A motion conversion mechanism for converting the movement of the embroidery frame 316 into the movement of a rotary member 340 will now be explained.

Figure 47:
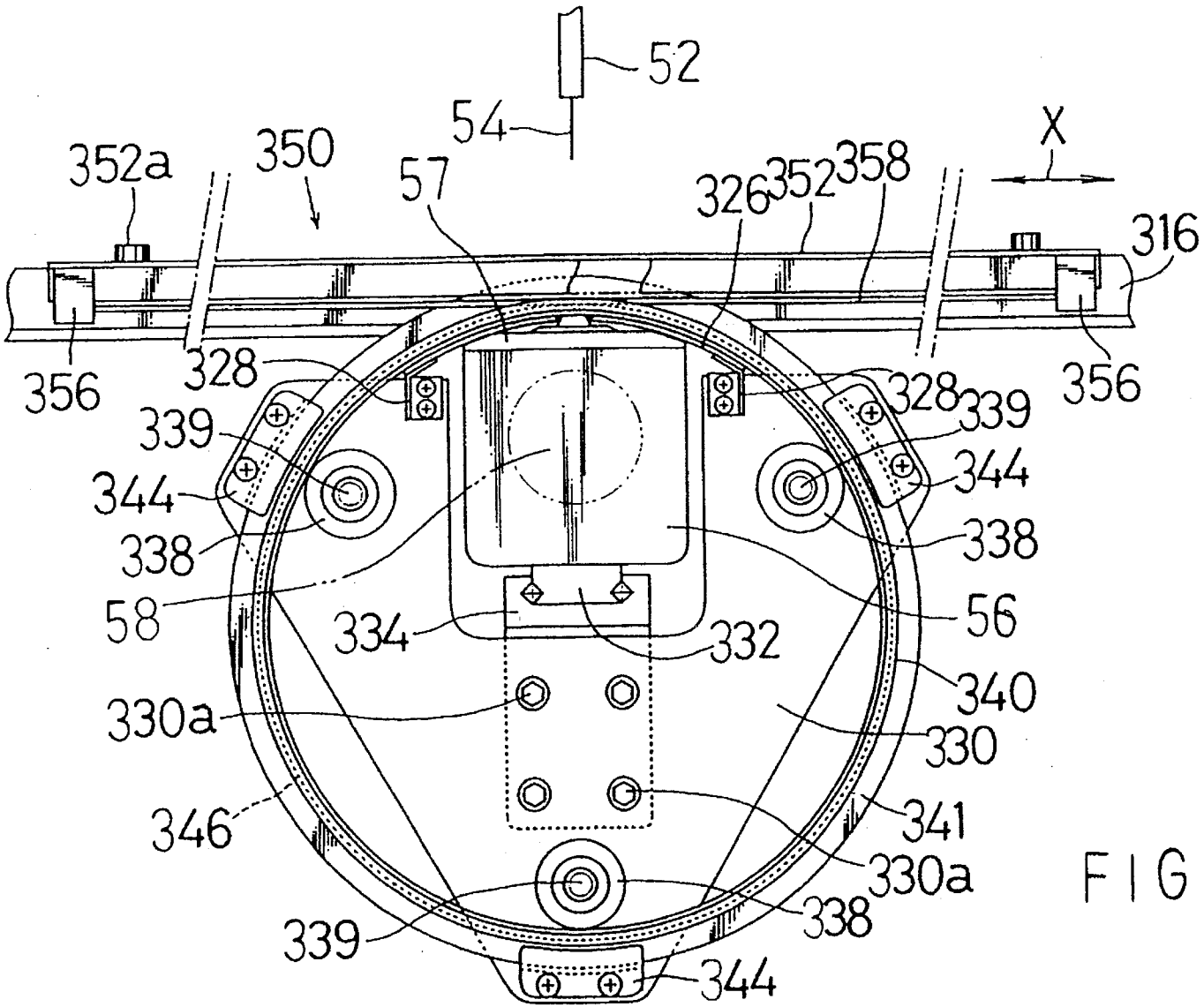
FIG. 47 is a front view of FIG. 46.
Figure 48:
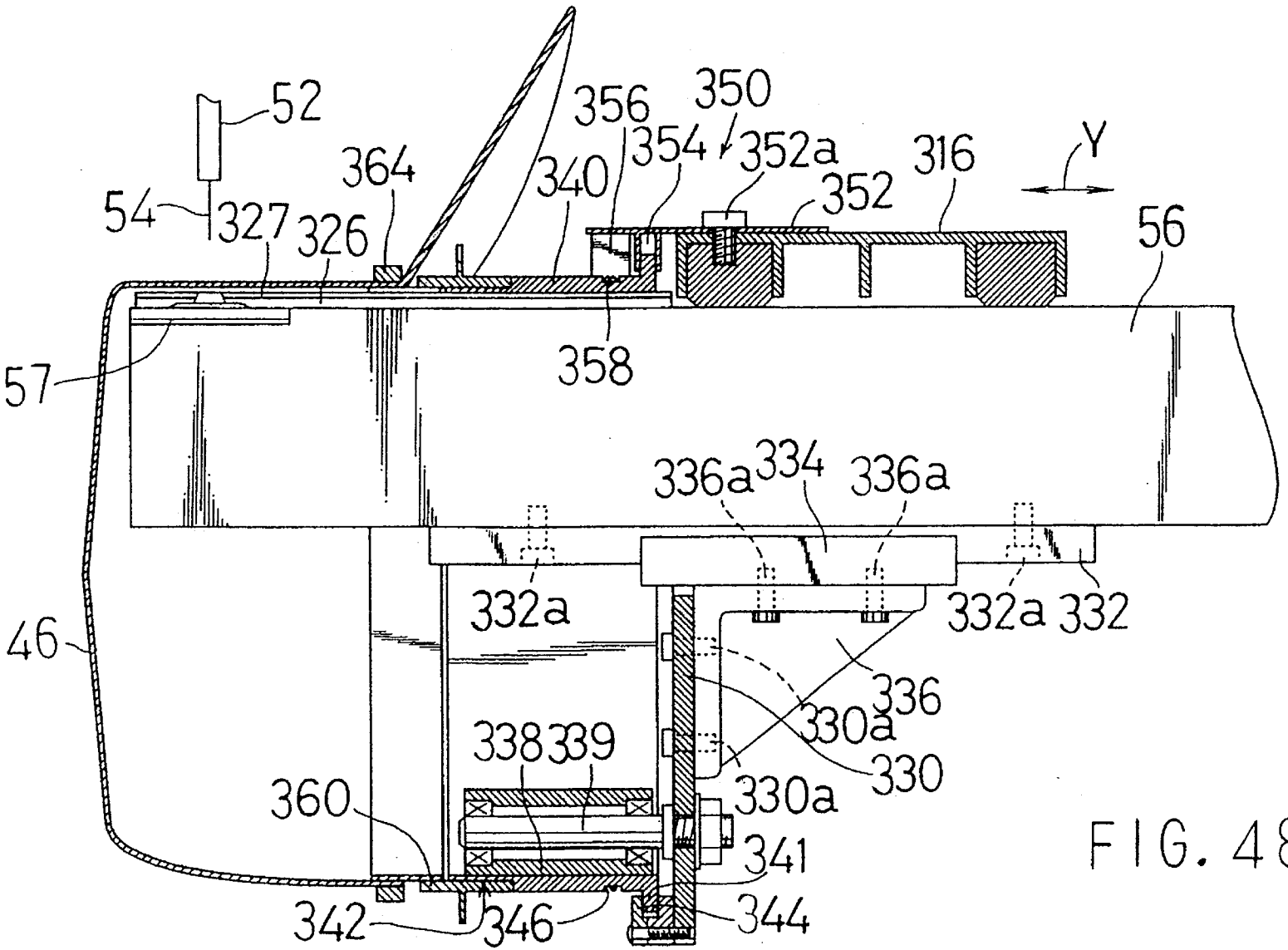
FIG. 48 is a sectional view of FIG. 47 showing a work fabric set on the retainer device.

As shown in FIGS. 47 and 48, a rail 332 is fixed to the lower surface of each of the shuttle bases 56 by bolts 332*a*. A slider 234 is mounted on the rail 332 and is slidably movable relative thereto in the direction of Y-axis. A bracket 336 is fixed below the slider 334 by bolts 336*a*. A plate 330 having a configuration not to interfere with the shuttle base 56 is fixed to the bracket 336 by bolts 330*a* as shown in FIG. 47.

Thus, the plate 330 is movable together with the slider 334 in the direction of Y-axis relative to the shuttle base 56.

A support plate 326 corresponding to the support plate 120 of the ninth embodiment and having an arcuate configuration in section is fixed to the front surface of the plate 330 by bolts 330*a* and is positioned to cover the upper portion of the shuttle base 56. Thus, the support plate 326 has an elongated s lot 327 extending in the direction of Y-axis within the range of at least the movement of the plate 330.

The construction of the rotary member 340 and a support device for supporting the rotary member 340 will now be explained. Such construction is substantially the same as the ninth embodiment.

Thus, as shown in FIG. 48, the inner peripheral surface of the rotary member 340 is supported by three support rollers 338 each rotatably supported by a roller shaft 339 which has one end fixed to the plate 330.

The rotary member 340 has a rear end (on the side of the plate 330) which is formed with an outer flange 341. The outer flange 341 is slidably received by three guide members 344 fixed to the plate 330.

Thus, the rotary member 340 is rotatable within a plane extending in the direction of X-axis by an angle of more than 360°. While, the rotary member 340 is movable together with the plate 330 in the direction of Y-axis. The rotary member 340 has a set surface 342 for mounting a retainer member 360 thereon at a position adjacent the forward end or a free end of the rotary member 340.

A transmission mechanism 350 for transmitting the driving movement of the embroidery frame 316 to the rotary member 340 will now be explained. The transmission mechanism 350 includes a mechanism for converting the liner movement of the embroidery frame 316 in the direction of X-axis into the rotational movement of the rotary member 340.

A transmission plate 352 is fixedly mounted on the upper surface of the embroidery frame 316 by bolts 352*a*. A pair of blocks 356 are fixed to the front surface of the transmission plate 352. A cord-like member 358 such as a wire and a steel belt is passed over an annular recess 346 formed on the outer peripheral surface of the rotary member 340. Both ends of the cord-like member 358 are connected to the blocks 356. The cord-like member 358 is fixed to the rotary member 340 at a point in the circumferential direction. Thus, as the embroidery frame 316 is moved in the direction of X-axis, the rotary member 340 is rotated relative to the plate 330 by means of the cord-like member 358. By suitably determining the distance between the blocks 356 and the number of turning of the cord-like member 358 around the rotary member 340, the rotary member 340 can be rotated by an angle of more than 360°.

As shown in FIG. 48, a recess 354 is formed on the lower surface of the transmission plate 352 and is in engagement with a part of the flange 341 of the rotary member 340, so that the transmission plate 353 transmits the movement of the embroidery frame 316 in the direction of Y axis to the rotary member 340 but that the transmission plate 353 does not transmit the movement of the embroidery frame 316 in the direction of X-axis to the rotary member 340. Consequently, the plate 330 moves together with the rotary member 340 relative to the shuttle base 56.

An annular retainer member 360 is detachably mounted on a mounting surface 342 of the rotary member 340 by means of a lock mechanism (not shown). The retainer member 360 has a set surface 361 formed on the side of the front end or free end thereof. The edge portion of the opening of the work fabric 46 is mounted on the set surface 361 by means of a pressing member 364 in the same manner as the first embodiment.

Figure 49:
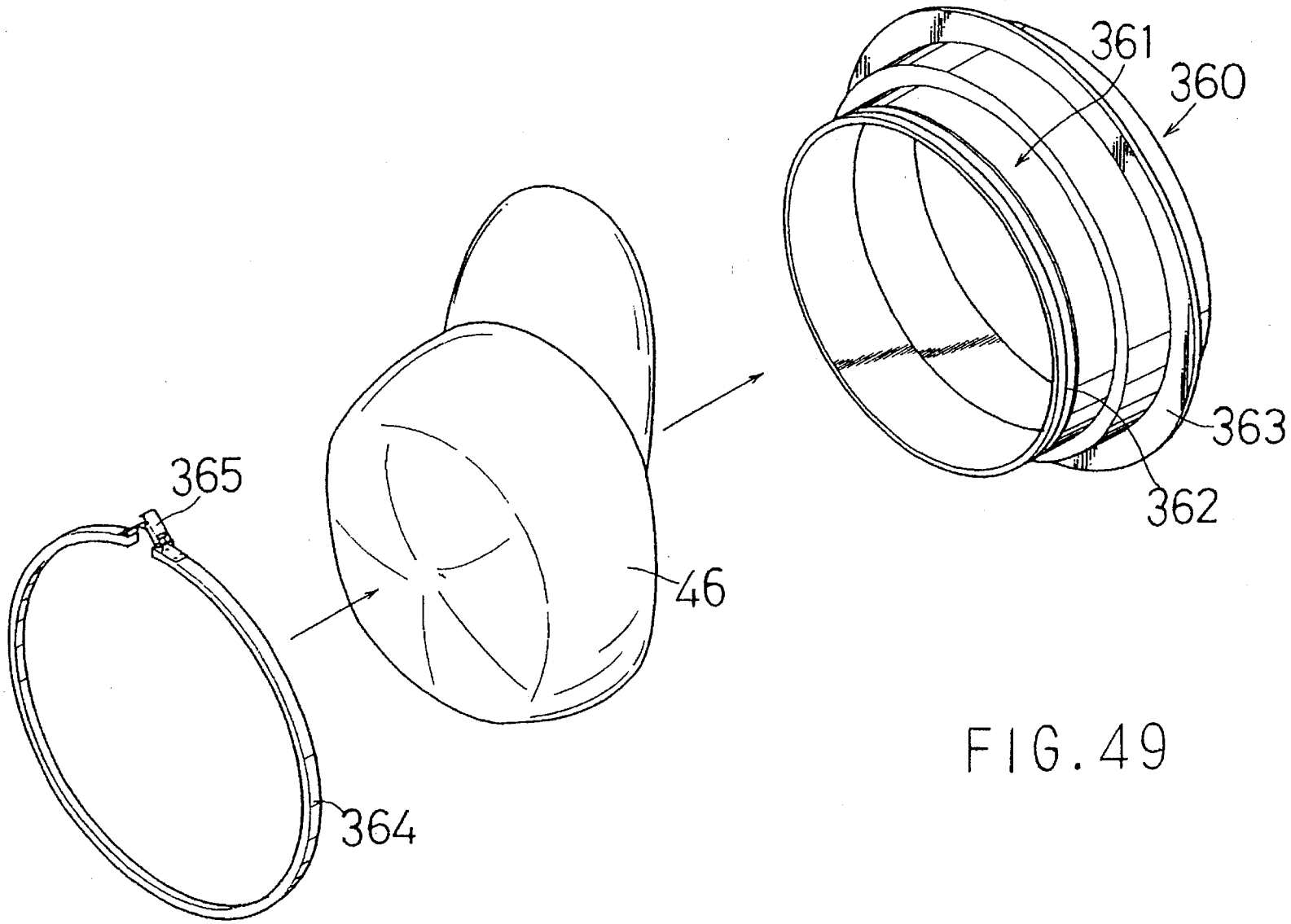
FIG. 49 is an exploded perspective view showing the state prior to setting the work fabric on the retainer device.
Figure 50:
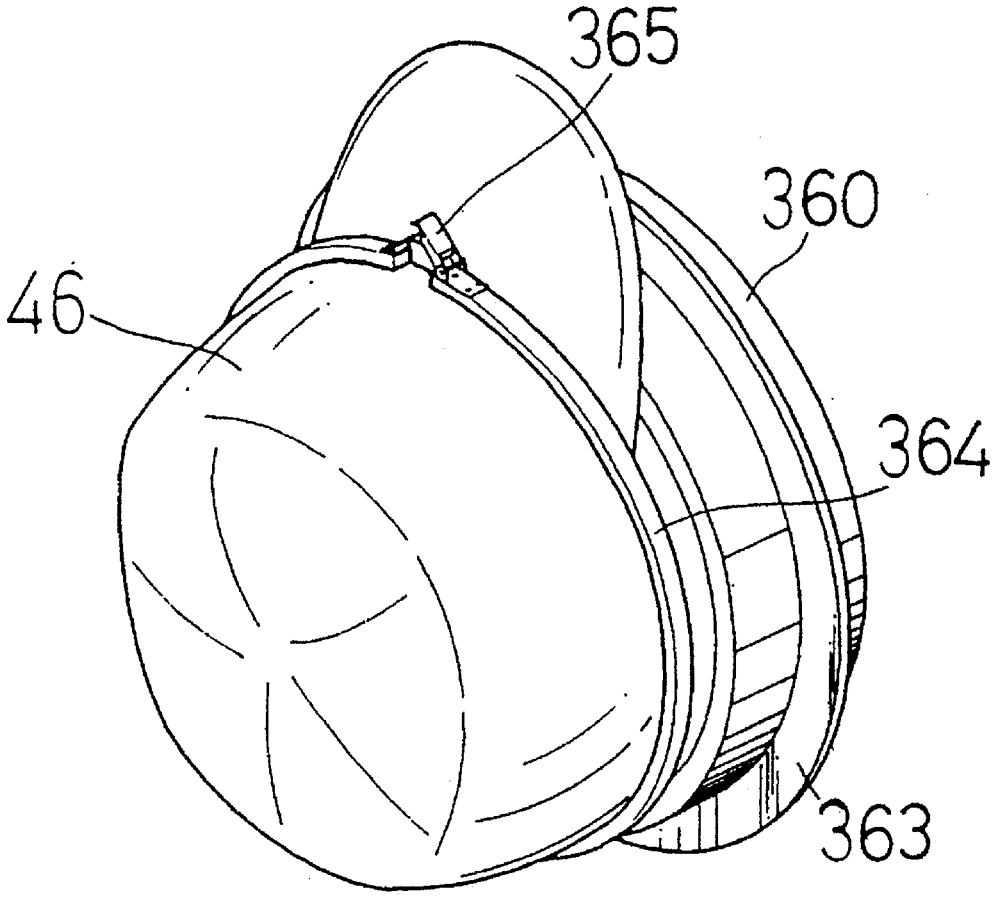
FIG. 50 is a perspective view showing the retainer device on which the work fabric is set.

As shown in FIGS. 49 and 50, the work fabric 46 is fixed in position relative to the retainer member 260 by the retainer member 364 through locking engagement of a hook member 365, and the embroidering operation can be performed on substantially the whole circumferential surface of the embroidery part of the work fabric 46.

As shown in FIG. 49, an annular recess 362 is formed on the set surface 361 of the retainer member 360 so as to prevent the work fabric 46 from moving in the direction of Y-axis relative to the set surface 361. The annular recess 362 can be omitted in response to the kind of embroidery operation or the area to be embroidered.

The operation of this embodiment will now be explained.

Firstly, the work fabric 46 is mounted on the retainer member 360 such that substantially the whole circumferential surface of the embroidery part of the work fabric 46 can be embroidered as described above. Then, the retainer member 360 is mounted on the mounting surface 342 of the rotary member 340. When the embroidery frame 316 is moved in both directions of X axis and Y-axis based on the data of pattern to be embroidered, the rotary member 340 is rotated in response to movement of the embroidery frame 316 in the direction of X-axis, while the rotary member 340 is moved together with the plate 330 in the direction of Y-axis in response to movement of the embroidery frame 316 in the direction of Y-axis.

The work fabric 46 is therefore rotated and is moved linearly in response to the data of pattern, so that the desired pattern is embroidered on the embroidery part of the work fabric 46 through cooperation of the sewing needle 54 and the shuttle 58. As described above, also in this embodiment, the pattern can be embroidered on substantially the whole circumferential surface of the embroidery part of the work fabric 46, and the rotary member 340 can be rotated by an angle of more than 360° through movement of the embroidery frame 316 in the direction of X-axis, so that the embroidery operation can be performed on the embroidery part of the work fabric 46 having a large area.

Further, as described above, a part of the work fabric 46 positioned adjacent and above the throat plate 57 is supported by the support plate 326, so that the embroidery part can be appropriately tensioned without wrinkles. The support plate 326 can however be omitted when an annular core is positioned within the work fabric 46 during the embroidering operation.

If a flat work fabric such as a flat cloth is set on the embroidery frame 316 for embroidering on the flat work fabric, the plate 330 is removed from the shuttle base 56 on the condition that the retainer member 360 is removed from the rotary member 340. Such removal of the plate 330 is performed by loosening the bolts 332*a* which fix the rail 332 as shown in FIG. 48 or by loosening the bolts 336*a* which fix the bracket 336 so as to remove the brackets 336 from the slider 334. At the same time therewith, the transmission plate 352 of the transmission mechanism 350 is removed from the embroidery frame 316 by loosening the bolts 352*a*.

Thus, the plate 330, the rotary member 340 and the cord-like member 358 of the transmission mechanism 350 can be removed together from the embroidery machine. The elevator portion 310*a* of the machine table 310 is then lifted to the same level as the upper surface of the shuttle base 56, so that the embroidery machine can be operated to perform the embroidery operation on the flat work fabric.

16TH EMBODIMENT

The 16th embodiment will now be explained with reference to FIGS. 51 and 52. This embodiment differs from the 15th embodiment in the construction of a retainer member 360A which corresponds to the retainer member 460 of the 15th embodiment but which is similar to the retainer member 40 of the fourth embodiment. Thus, in this embodiment, the retainer member 360A includes a pair of pins 366 in place of the set arms 60 of the fourth embodiment.

Figure 51:
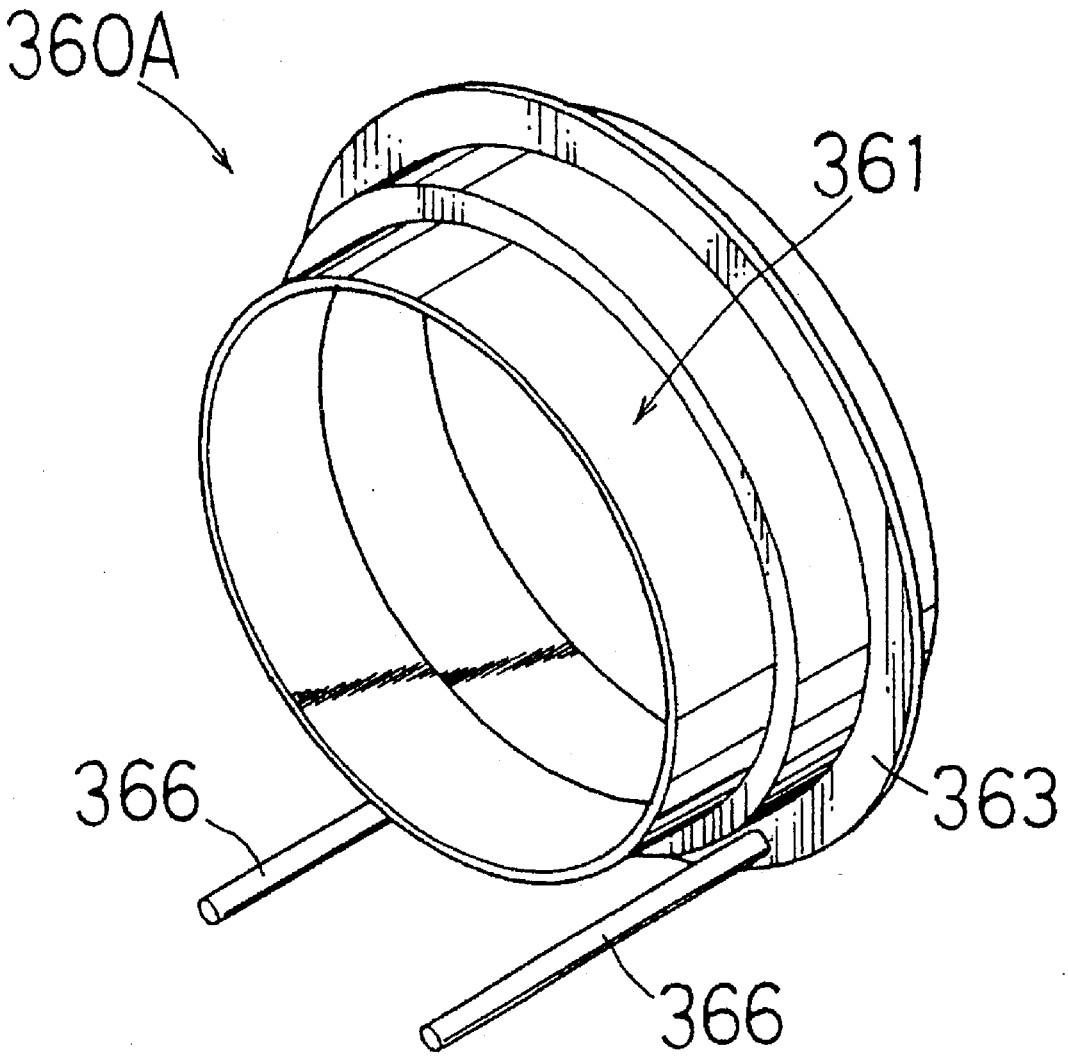
FIG. 51 is a perspective view of a retainer device of a multi-head embroidery machine according to a 16th embodiment of the present invention.
Figure 52:
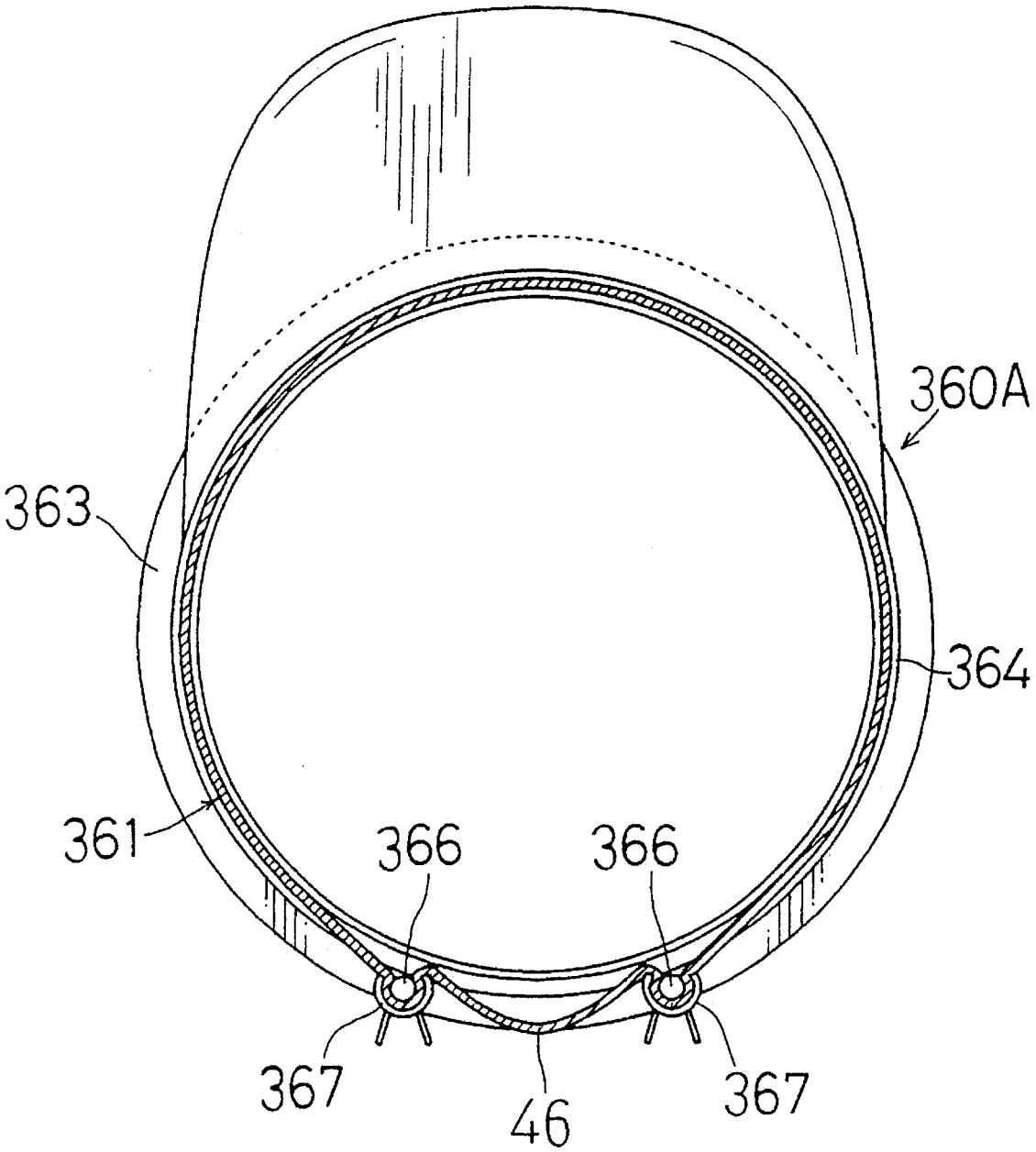
FIG. 52 is a sectional view showing a work fabric set on the retainer device of FIG. 51.

As shown in FIGS. 51 and 52, the pins 366 extend in parallel from the flange 336 in the direction of Y axis. When the work fabric 46 is mounted on the retainer member 360A, the pins 336 are positioned inwardly of the work fabric 46, so that the work fabric 46 can be clamped at positions corresponding to the pins 336 by means of clips 367 as shown in FIG. 52.

With the position of the work fabric 46 thus fixed relative to the retainer member 360, the edge portion of the opening of the work fabric 46 is set on the set surface 361 of the retainer member 360, and the work fabric 46 is thereafter fixed by pressing member 364, so that the work fabric can be correctly set on the retainer member 360.

17TH EMBODIMENT

Figure 53:
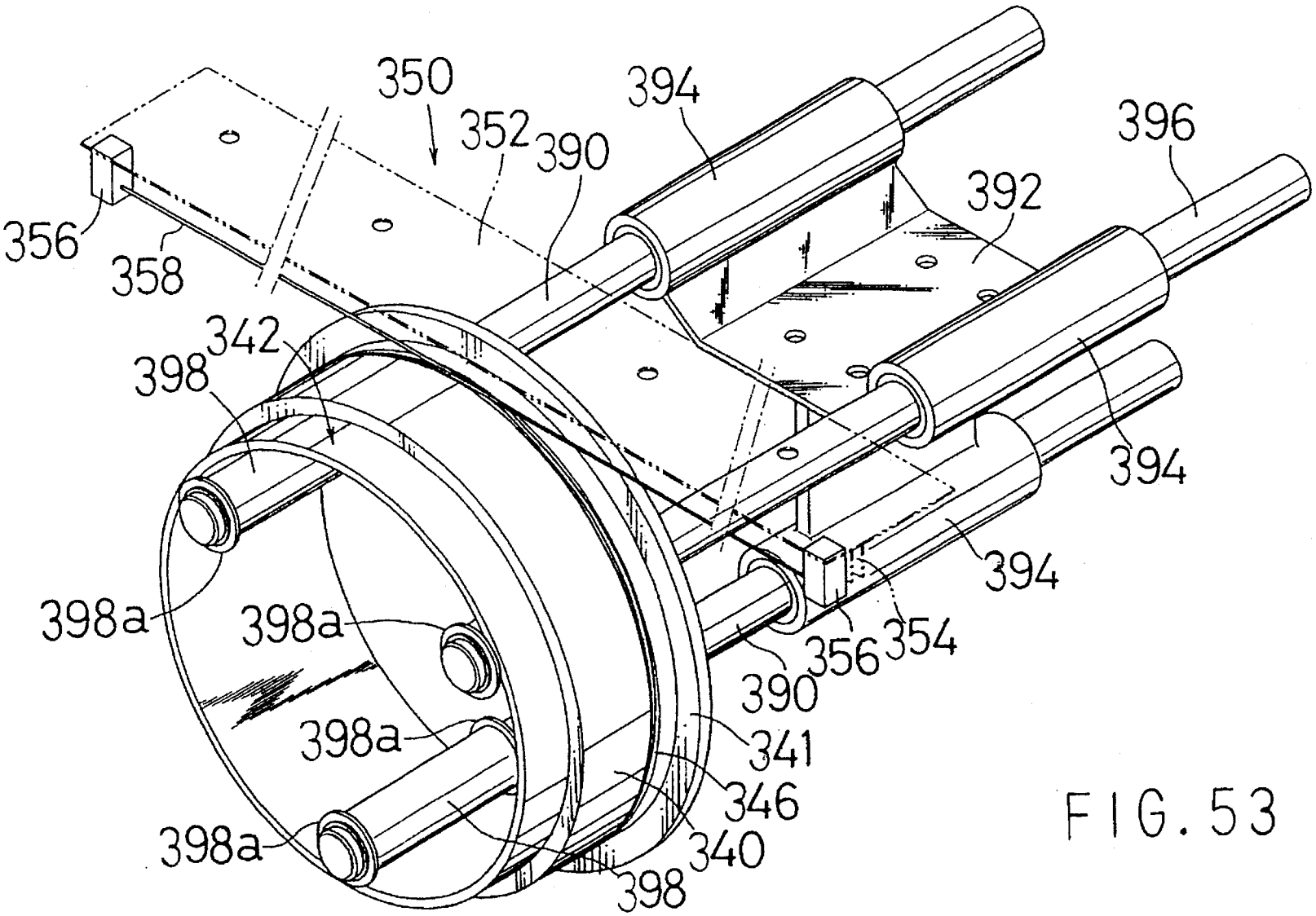
FIG. 53 is a perspective view of a mechanism for driving a retainer device of a multi-head embroidery machine according to a 17th embodiment of the present invention.
Figure 54:
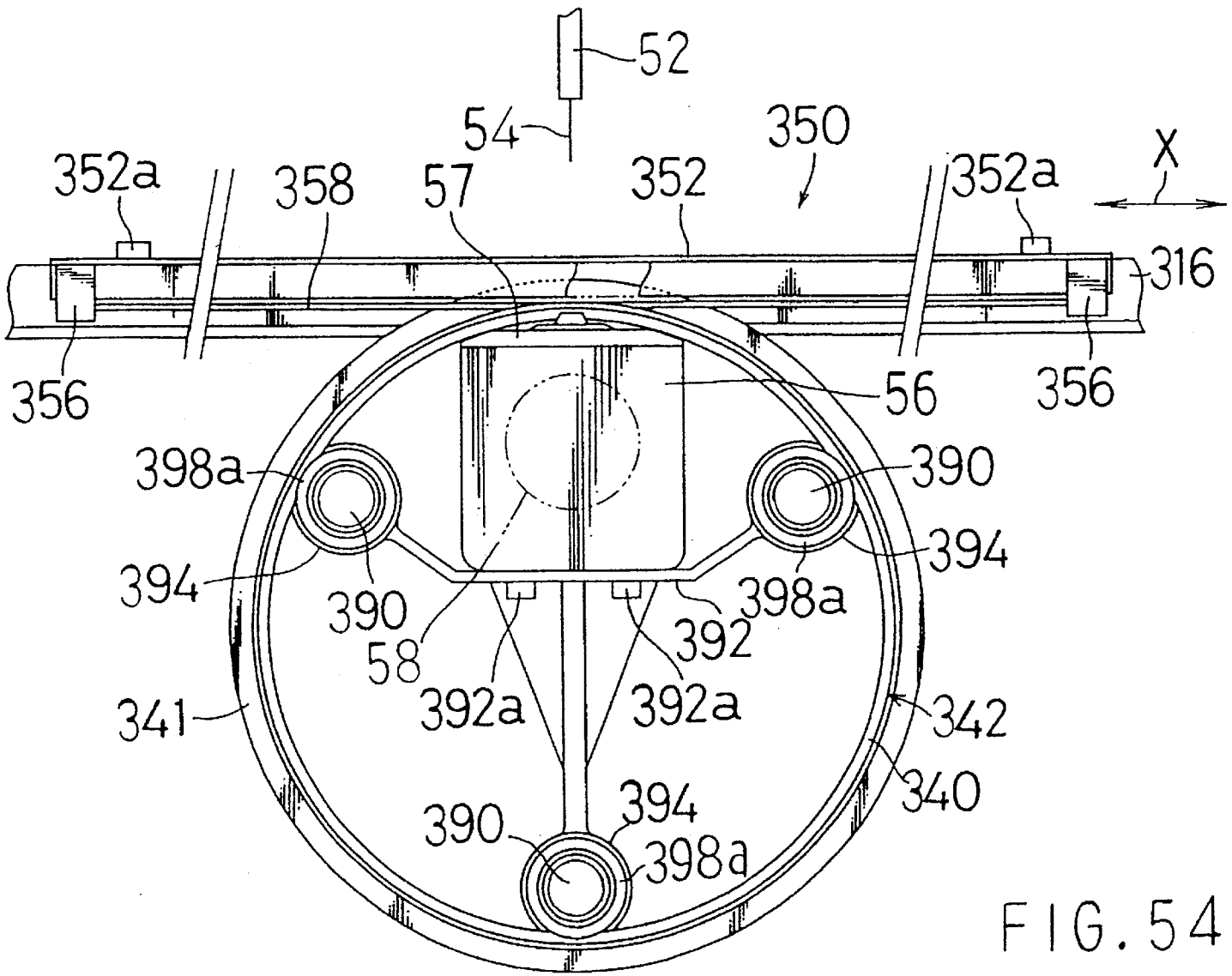
FIG. 54 is a front view of FIG. 53.

The 17th embodiment will now be explained with reference to FIGS. 53 to 55. In this embodiment, a holder 392 is fixed to the lower surface of the shuttle base 56 by bolts 392*a*. The holder 392 includes three sleeve portions 394 which are formed integrally with the holder 392 and are positioned at an upper right and left positions and a lower central position. The sleeve portions 394 extend in parallel to Y-axis.

Figure 55:
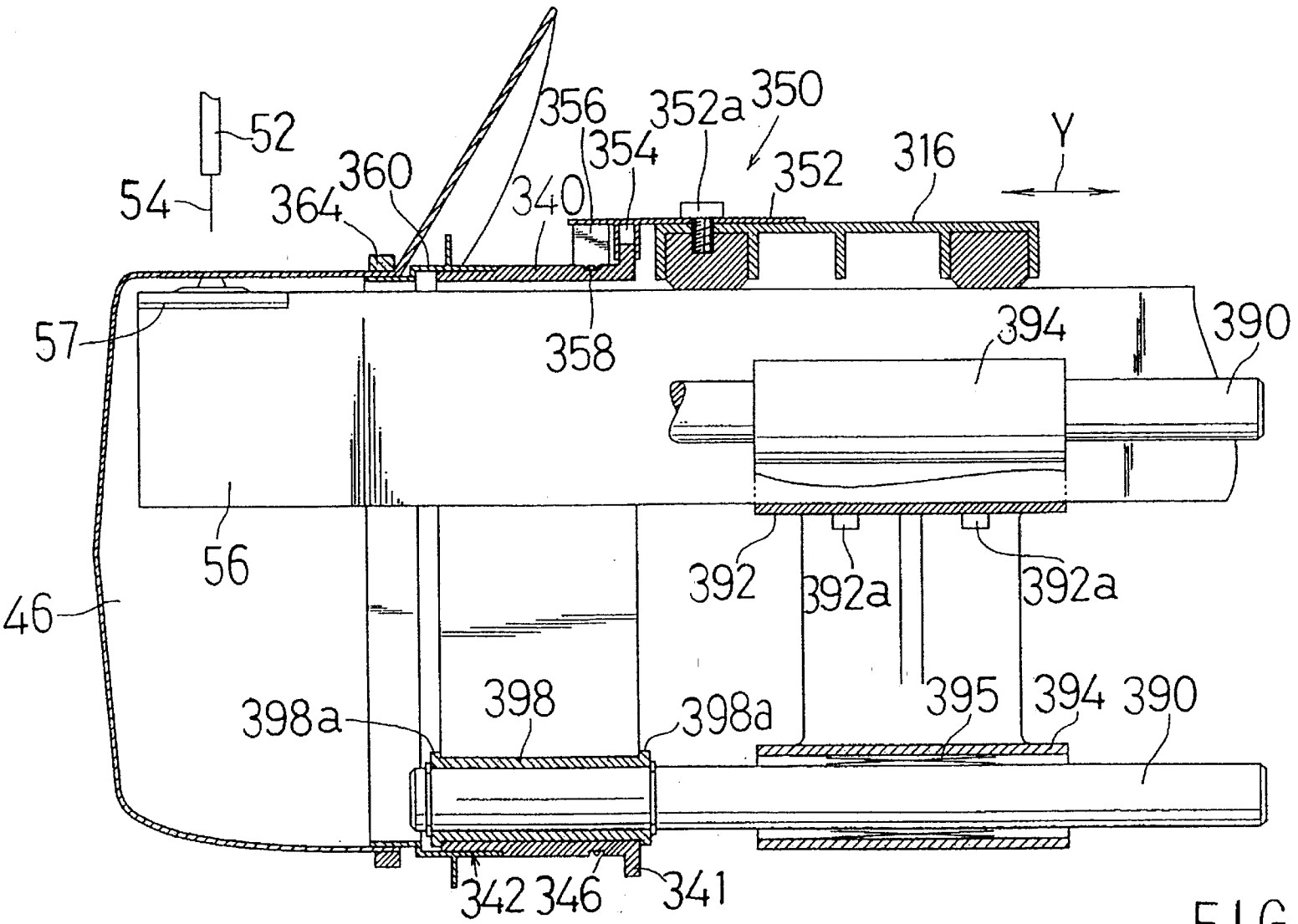
FIG. 55 is a vertical sectional view of FIG. 53.

As shown in FIG. 55, a rod-like support member 390 is supported by each of the sleeve portions 394 by means of a linear bearing 395, so that the support members 390 are linearly slidably movable relative to the holder 392 in the direction of Y-axis. A roller 398 is mounted on the forward end of each of the support members 390 and is rotatable around the axis of the corresponding rod-like member 390. The movement of the roller 398 in the axial direction is restrained by snap rings (not shown). The rollers 398 serve to rotatably support the rotary member 340. Each of the rollers 398 has outer flanges 398*a* formed on both ends thereof, so that the movement of the rotary member 340 in the direction of Y-axis relative to the rollers 98 or the support members 390 is restrained by the flanges 398*a*. The other construction is the same as the 15th embodiment.

In this embodiment, when the embroidery frame 316 is moved in the direction of X-axis, the rotary member 340 is rotated relative to the support members 390 by means of the cord-like member 358 of the transmission mechanism 350. The movement of the embroidery frame 316 in the direction of Y-axis is transmitted to the support members 390 via the rotary member 340 and the rollers 398, so that the support members 390 are moved together with the rotary member 340 in the direction of Y-axis relative to the holder 392. Consequently, similar to the 15th embodiment, when the embroidery frame 316 is moved in the directions of X-axis and Y-axis, the rotary member 340 is rotated within the plane in parallel to X-axis in response to movement of the embroidery frame 316 in the direction of X-axis, and the support members 390 are linearly moved together with the rotary member 340 in the direction of Y-axis in response to the movement of the embroidery frame 316 in the direction of Y-axis.

Although in the transmission mechanism 350 of the above 15th to 17th embodiments, the cord-like member 358 is used for converting the movement of the embroidery frame 316 with respect to X-axis to the rotary member 340, a metal belt, a timing belt, or a gear mechanism including a rack formed on the transmission plate 352 and a ring gear formed on the outer peripheral surface of the rotary member 340 for engagement with the rack may be used.

Additionally, the transmission mechanism 350 utilizing the cord-like member 358 may incorporate the mechanism for increasing the driving amount as described in connection with 12th to 14th embodiments. Further, the retainer member 360 or 360A and the pressing ring 364 may incorporate various improvements as described in connection with 1st to 13th embodiments.

18th to 20th embodiments of the present invention will now be described with reference to FIGS. 56 to 71. These embodiments relate to an improvement of a multi-head embroidery machine in which a cord-like member is incorporated to convert the linear movement of a rotary member as described in some of the above embodiments. More specifically, the 18th to 20th embodiments permit the multi-head embroidery machine to have sewing heads spaced from each other by a smaller distance, so that the embroidery machine may have a smaller size.

18TH EMBODIMENT

Figure 56:
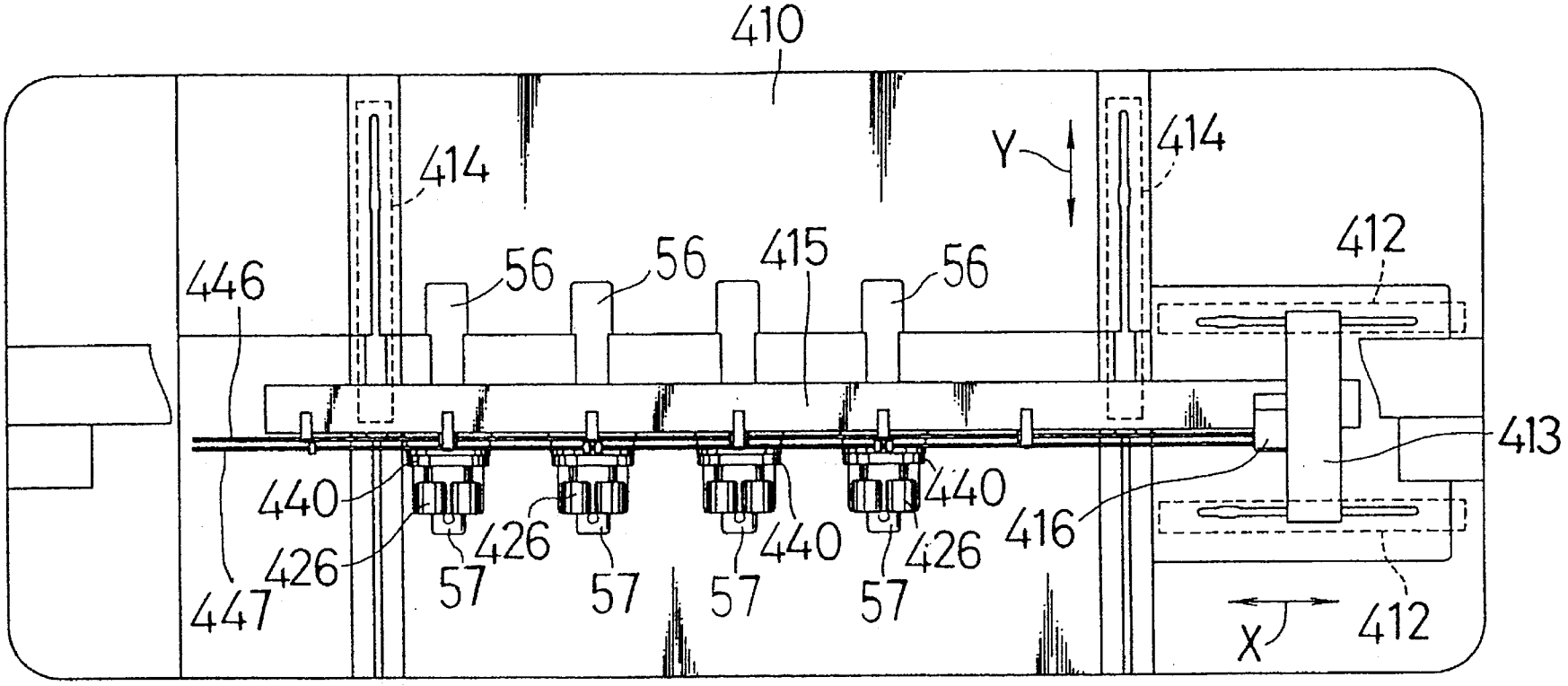
FIG. 56 is a plan view of a multi-head embroidery machine according to an 18th embodiment of the present invention.
Figure 57:
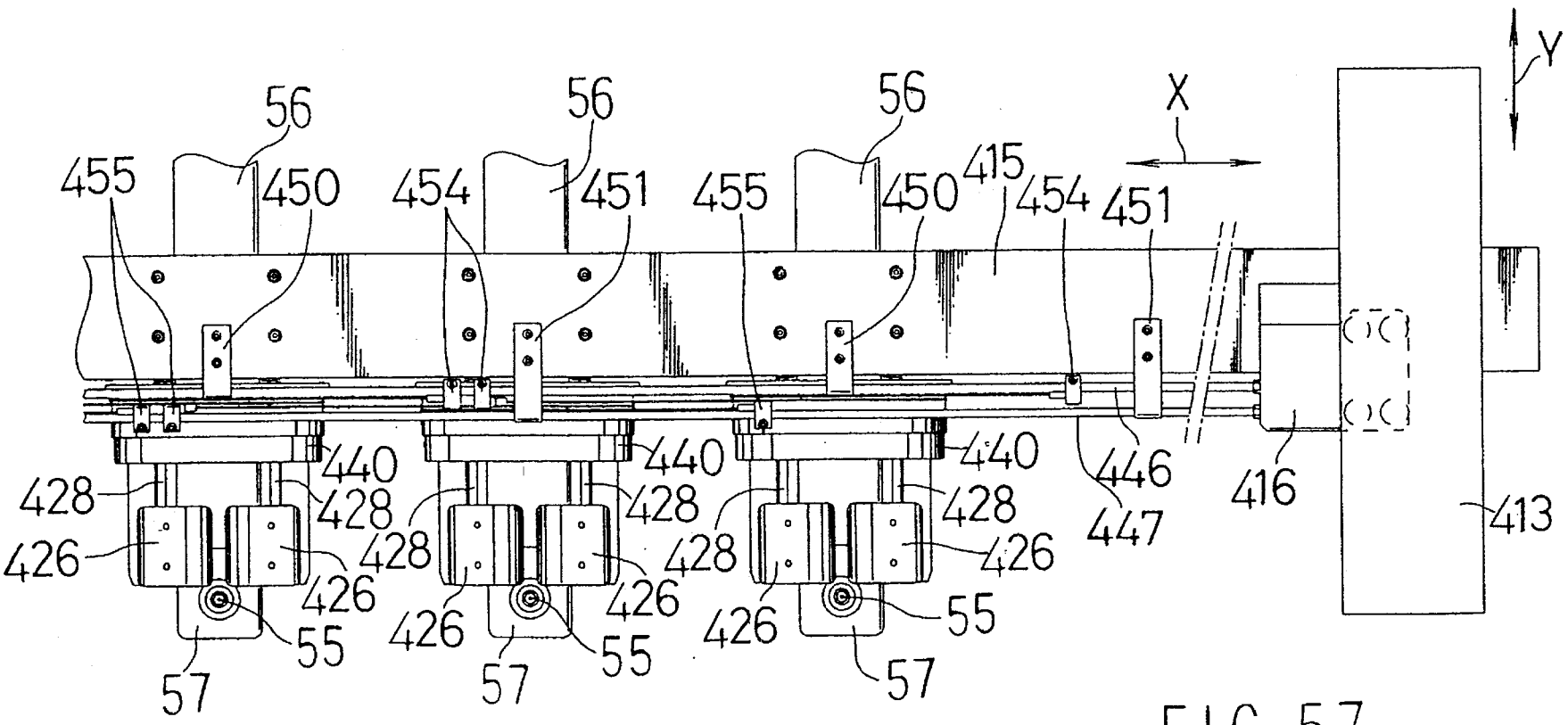
FIG. 57 is an enlarged plan view of a part of the embroidery machine shown in FIG. 56.

The 18th embodiment will now be explained with reference to FIGS. 56 to 65. As shown in FIG. 56, a multi-head embroidery machine of this embodiment includes X-axis drive devices 412 and Y-axis drive devices 414 which correspond to the X-axis drive devices 11 and the Y-axis drive devices 13 of the first embodiment, respectively, and which are disposed below a machine table 410. An X-axis drive member 413 and a Y-axis drive member 415 corresponding to the X-axis drive member 2 and the Y-axis drive member 10 of the first embodiment are disposed on the machine table 10. As shown in FIG. 57, the X-axis drive member 413 has a drive block 416 corresponding to the drive block 17 of the first embodiment. The drive block 416 is movable together with the X-axis drive member 413 in the direction of X-axis, but is movable together with the Y-axis drive member 415 in the direction of Y-axis relative to the X-axis drive member 413.

Figure 58:
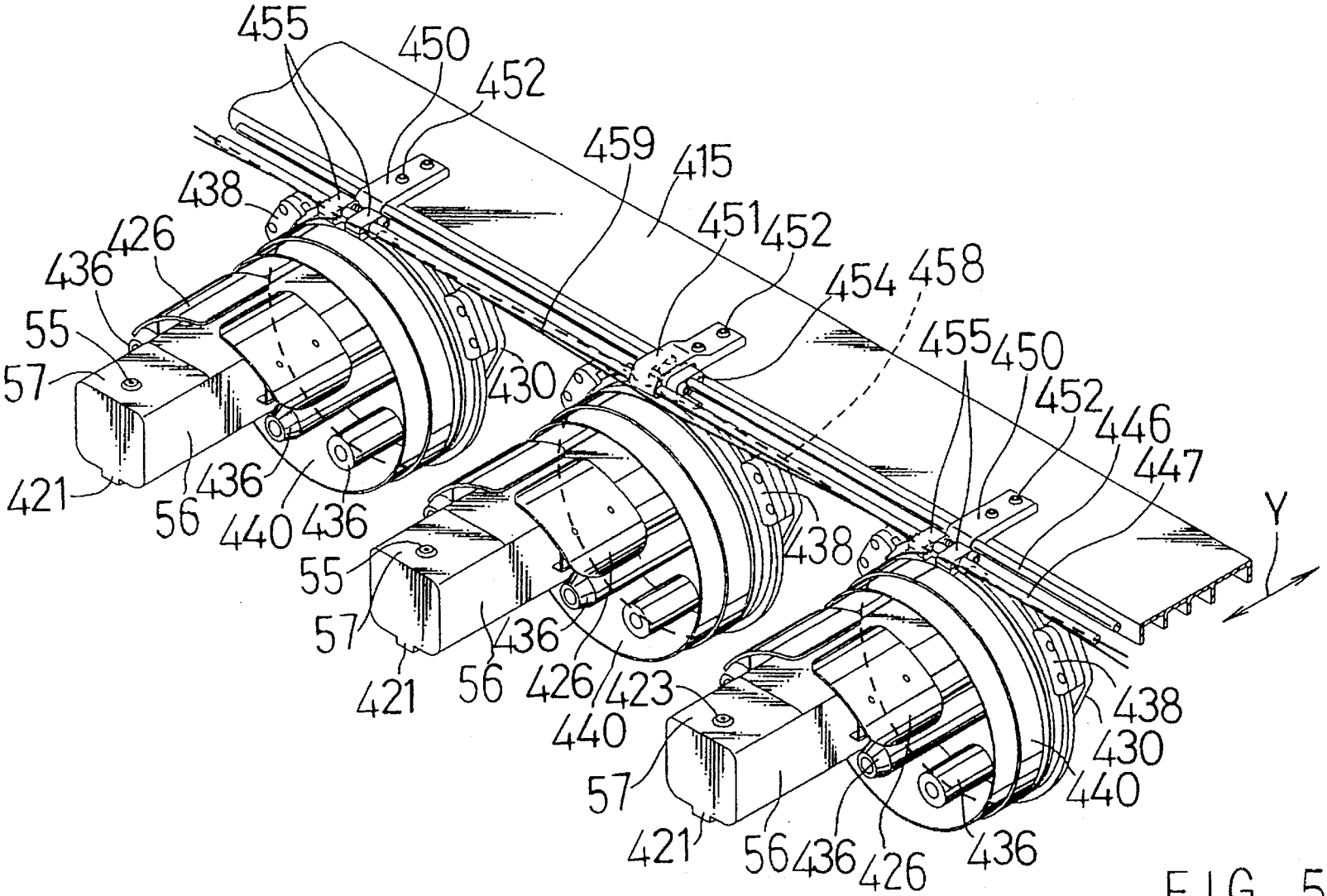
FIG. 58 is an enlarged perspective view of a part of FIG. 57.

As shown in FIGS. 57 and 58, similar to the first embodiment, the shuttle bases 56 (four in number in this embodiment) are disposed below the Y-axis drive member 415.

Further, a plurality of sewing heads each including the needle bar 52 and the sewing needle 54 as the first embodiment are positioned above the corresponding shuttle bases 56. Thus, in the drawings of this embodiment, the same numerals are affixed to the same parts as the first embodiment.

Figure 59:
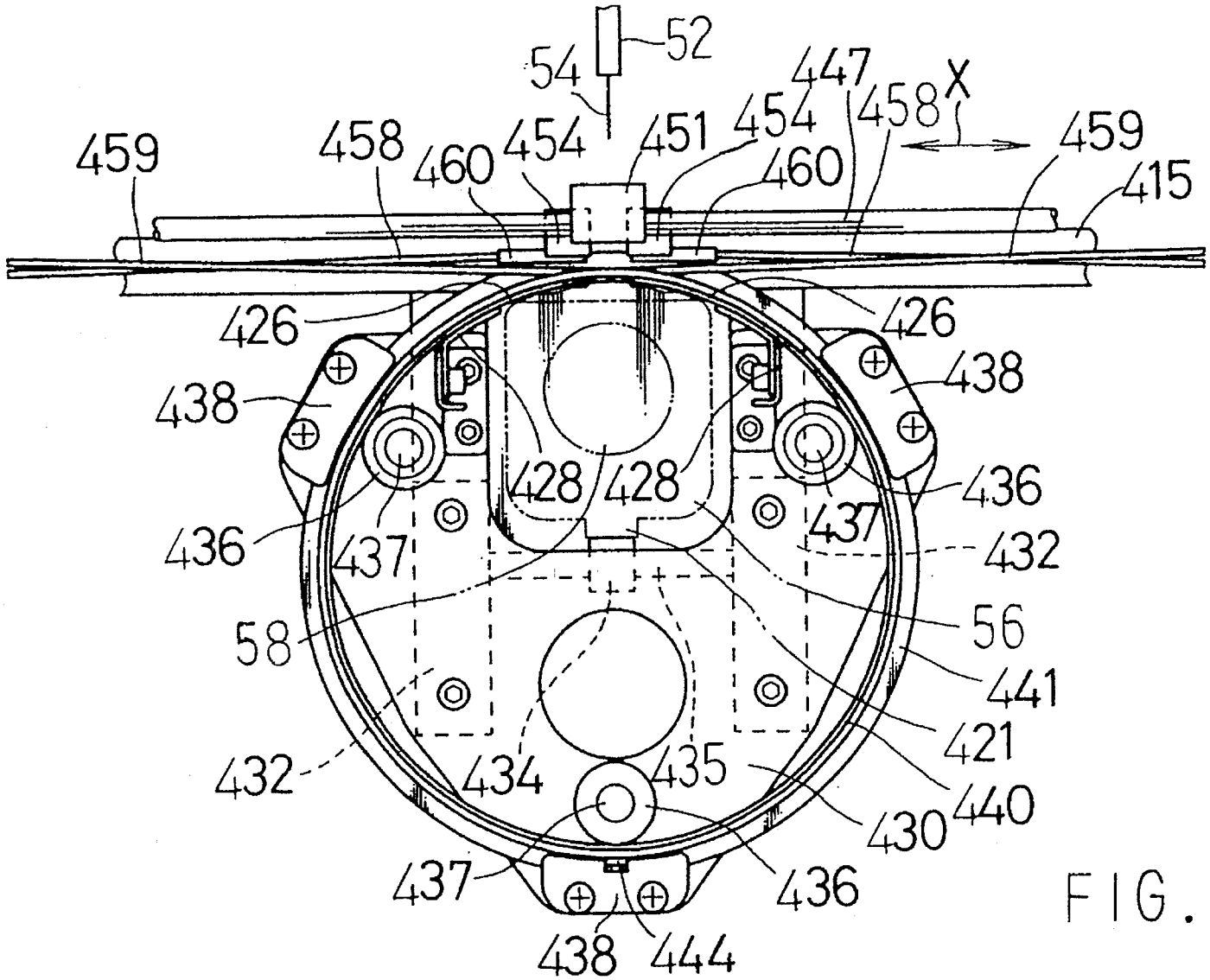
FIG. 59 is a front view of a mechanism for driving a retainer device shown in FIG. 58.
Figure 60:
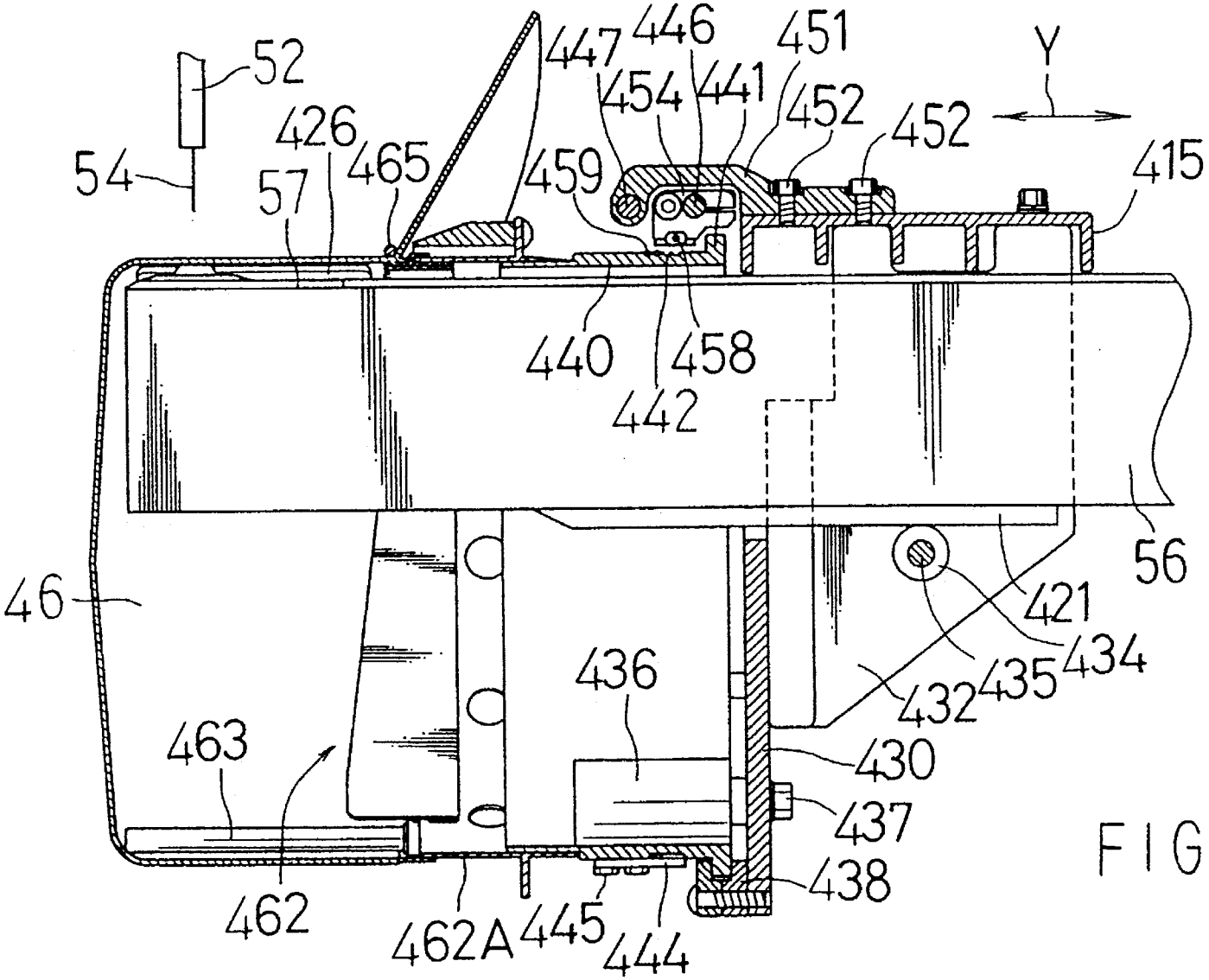
FIG. 60 is a vertical sectional view of FIG. 59.

As shown in FIGS. 59 and 60, brackets 432 are fixed to the lower surface of the Y-axis drive member 415 on both sides of each of the shuttle bases 56. A plate 430 is fixed to the front surfaces of the brackets 432, so that the brackets 432 and the plate 430 are movable together with the Y-axis drive member 415 in the direction of Y-axis. A roller shaft 435 has both ends supported by the brackets 432 at a position below the shuttle base 56. A roller 434 is rotatably supported on the roller shaft 435 and is in abutment on a rail 421 formed on the central portion of the lower surface of the shuttle base 56. Thus, when the Y-axis drive member 415 is moved, the roller 434 rotates along the rail 421, so that the plate 430 can be stably moved in the direction of Y-axis.

A pair of support plates 426 are positioned above the shuttle 56 and are fixed to the front surface of the plate 430 by brackets 428. These support plates 426 serve to partly receive the inner peripheral surface of the work fabric 46 and are spaced from each other such that the support plates 430 cover the upper surface of the shuttle 56 except the area corresponding to the needle hole 55 of the throat plate 57. The function of the support plates 426 is the same as the support plate 120 of the ninth embodiment.

Similar to the ninth embodiment, three rollers 436 are positioned in front of the plate 430 for supporting a rotary member 440. Each of the rollers 436 is rotatably supported by a roller shaft 437 having one end connected to the plate 430.

Also similar to the ninth embodiment, an outer flange 441 is formed integrally with the rear end of the rotary member 440. The outer flange 441 is slidably rotatably held by three guide members 438 fixed to the plate 430. Thus, the rotary member 440 is rotatable within a plane extending in parallel to the X-axis by an angle of more than 360°, and the rotary member 440 is movable together with the plate 430 in the direction of Y-axis so as to move linearly in the direction of Y-axis in response to movement of the Y-axis drive member 415.

Two rods 446 and 447 are disposed in front of the Y-axis drive member 415 and above the rotary member 440. These rods 446 and 447 extend in parallel to each other in the direction of X-axis or the longitudinal direction of the Y-axis drive member 415. One end of each of the rods 446 and 447 is connected to the drive block 416 as described above, so that the rods 446 and 447 are moved in the direction of X-axis when the X-axis drive member 413 is moved. Further, these rods 446 and 447 are slidably supported in the direction of X-axis by support arms 450 and support arms 451, respectively. The support arms 450 and 451 are fixed to the upper surface of the Y-axis drive member 415 by bolts 452.

Figure 61:
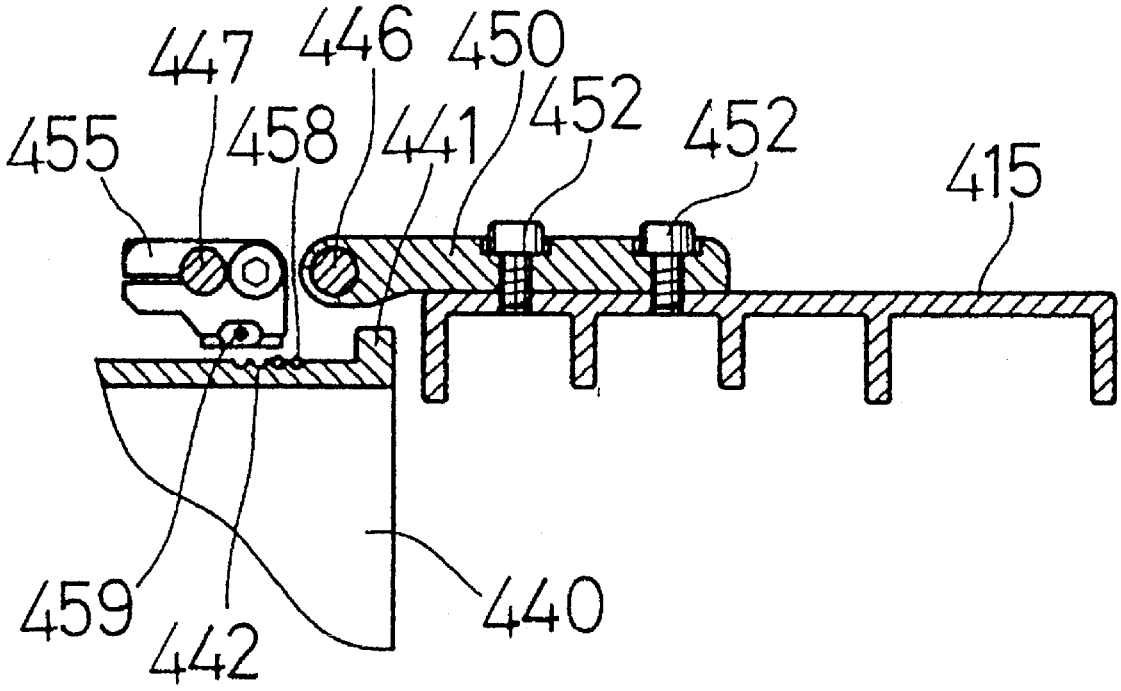
FIG. 61 is a sectional view corresponding to a part of FIG. 60 but showing a support arm different from a support arm shown in FIG. 60.

One of the support arms 451 of the rod 447 and one of the support arms 450 of the rod 446 are best shown in FIGS. 60 and 61, respectively.

A plurality of cord-like members 458 such as wires and steel belts are connected to the rod 446. Each of the cord-like members 458 has both ends connected to the rod 446 by connecting members 454. A plurality of cord-like members 459 such as wires and steel belts are connected to the rod 447. Each of the cord-like members 459 has both ends connected to the rod 447 by connecting members 455. The cord-like members 458 and 459 are passed one after another over the rotary members 440 which are positioned in series in the direction of X-axis. As shown in FIG. 60, each of the cord-like members 458 and 459 is fixed to the lower part of the corresponding rotary member 440 by a fixing member 444. Thus, as the rods 446 and 447 are moved in the direction of X-axis, the rotary members 440 are rotated by means of the cord-like members 458 and 459.

Figure 62A:
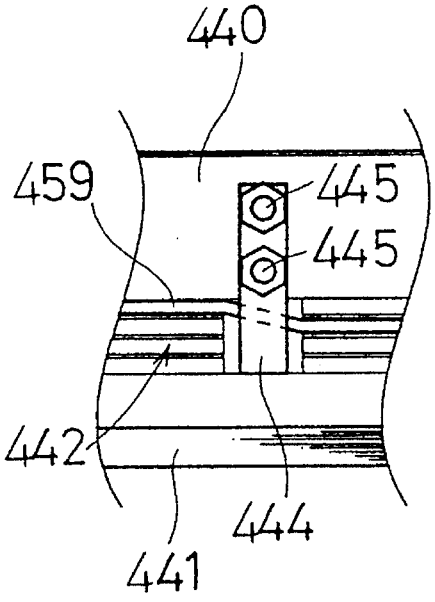
FIGS. 62(A) and 62(B) are enlarged views of bottom surfaces of two adjacent rotary members shown in FIG. 58.
Figure 62B:
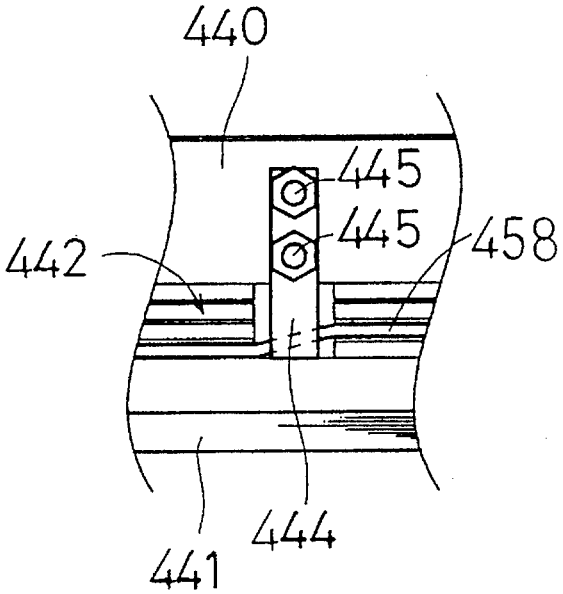

The lower surfaces of the two adjacent rotary members 440 are shown in FIGS. 62(A) and 62(B), respectively. As will be seen from FIGS, 62(A) and 62(B), the fixing member 444 is fixed to the rotary member 440 with the cord-like member 458 or the cord-like member 459 being pressed on the rotary member 440.

Since the rods 446 and 447 are spaced from each other in the direction of Y-axis, the cord-like members 458 and 459 are passed over the rotary members 440 at positions spaced from each other in the direction of Y-axis. To this end, four independent annular circumferential recesses 442 are formed on the outer peripheral surface of each of the rotary members 440. Thus, each of the cord-like members 458 of the rod 446 is passed through two of the recesses 442 as shown in FIG. 62(B), while each of the cord-like members 59 of the rod 447 is passed through the other two of the recesses 442 as shown in FIG. 62(A).

Figure 63:
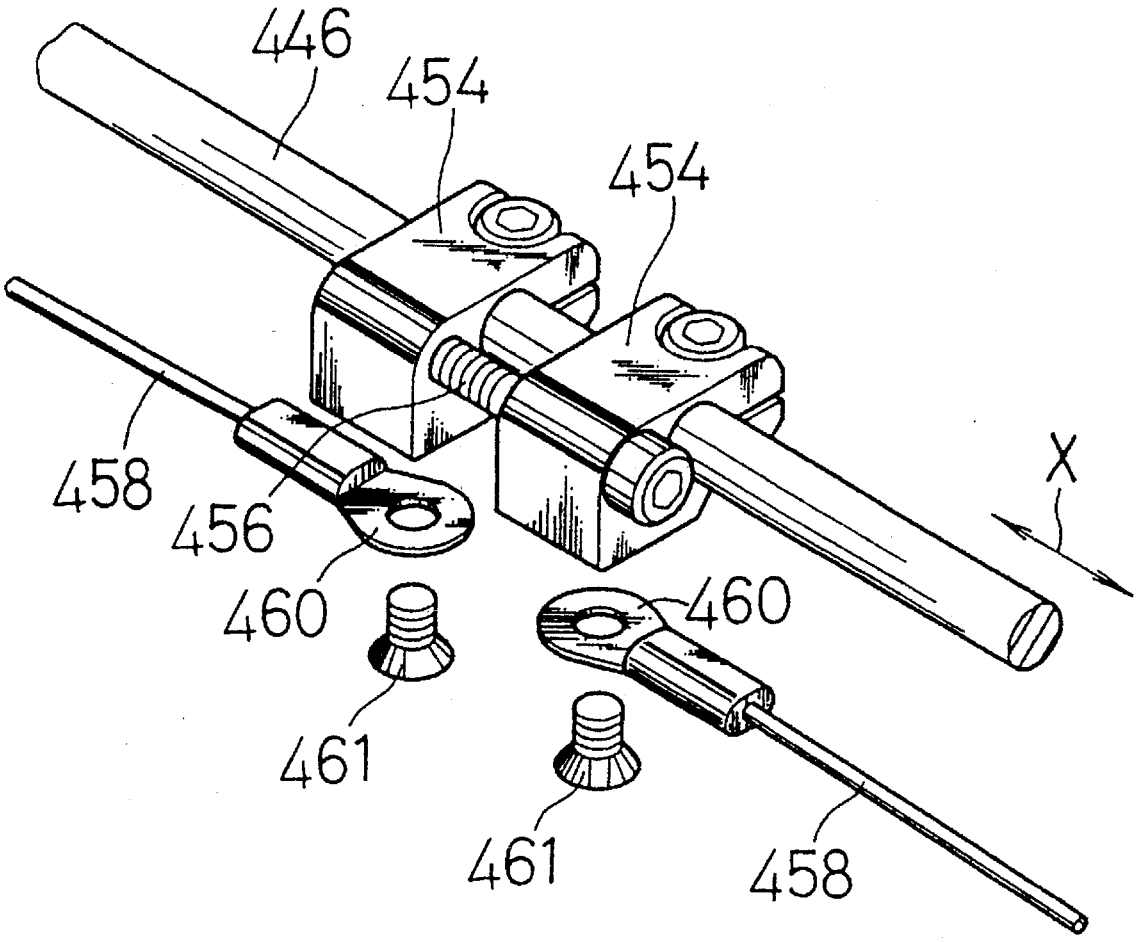
FIG. 63 is an exploded perspective view showing a mechanism for connection of cord-like members to one of rods shown in FIG. 58.

The relationship between the rod 446 and two of the cord-like members 458 connected to the rod 446 is shown in FIG. 63. The connecting members 454 for connecting the cord-like members 458 serve to clamp the rod 446 so as to be fixed in position relative to the rod 446. The connecting members 454 are connected by an adjusting bolt 456 disposed therebetween. A connector 460 is fixed to the end of each cord-like member 458, and the connector 460 is connected to the corresponding connecting member 454 by a screw 461. Therefore, by adjusting the driving amount of the adjusting bolt 456 on the condition that the connecting members 454 are loosened not to apply the clamping forces to the rod 446, the tension applied to the cord-like members 458 can be adjusted. This relationship can be applied to the relationship between the rod 447 and two of the cord-like members 459 connected to the cord-like members 459.

Further, as will be seen from FIGS. 60 and 61, the movement of the connecting members 454 of the rod 446 is not interfered by the support arms 451 of the rod 44, and the movement of the connecting members 455 of the rod 447 is not interfered by the support arm 450 of the rod 446, so that the connecting members 454 and the connecting members 455 can be moved in the direction of X-axis with the path of movement of each connecting members 454 partly overlapped with the path of movement of any of the connecting members 455. Therefore, the distance between the rotational axes of two adjacent rotary members 440 or the distance between the axes of two adjacent shuttle bases 56 can be determined to be smaller than the maximum amount of movement of the connecting members 454 or 455. Here, in order to rotate each rotary members 440 by an angle of more than 360°, the maximum amount of movement of the connecting members 454 or 455 is determined to be longer than the circumferential length of the recesses 442 of the rotary member 440.

As shown in FIG. 60, a retainer device 462 for setting the work fabric 46 thereon is mounted on the outer peripheral surface of the rotary member 440 at a position adjacent the forward end. the retainer device 462 is fixed in position by means of a lock mechanism (not shown). The retainer device 462 includes a retainer member 462A and a pressing member 462B. Similar to the above embodiments, the retainer member 462A serves to receive the edge portion of the opening of the work fabric 46, and the pressing member 462B serves to press the edge portion on the retainer member 462A.

Figure 64:
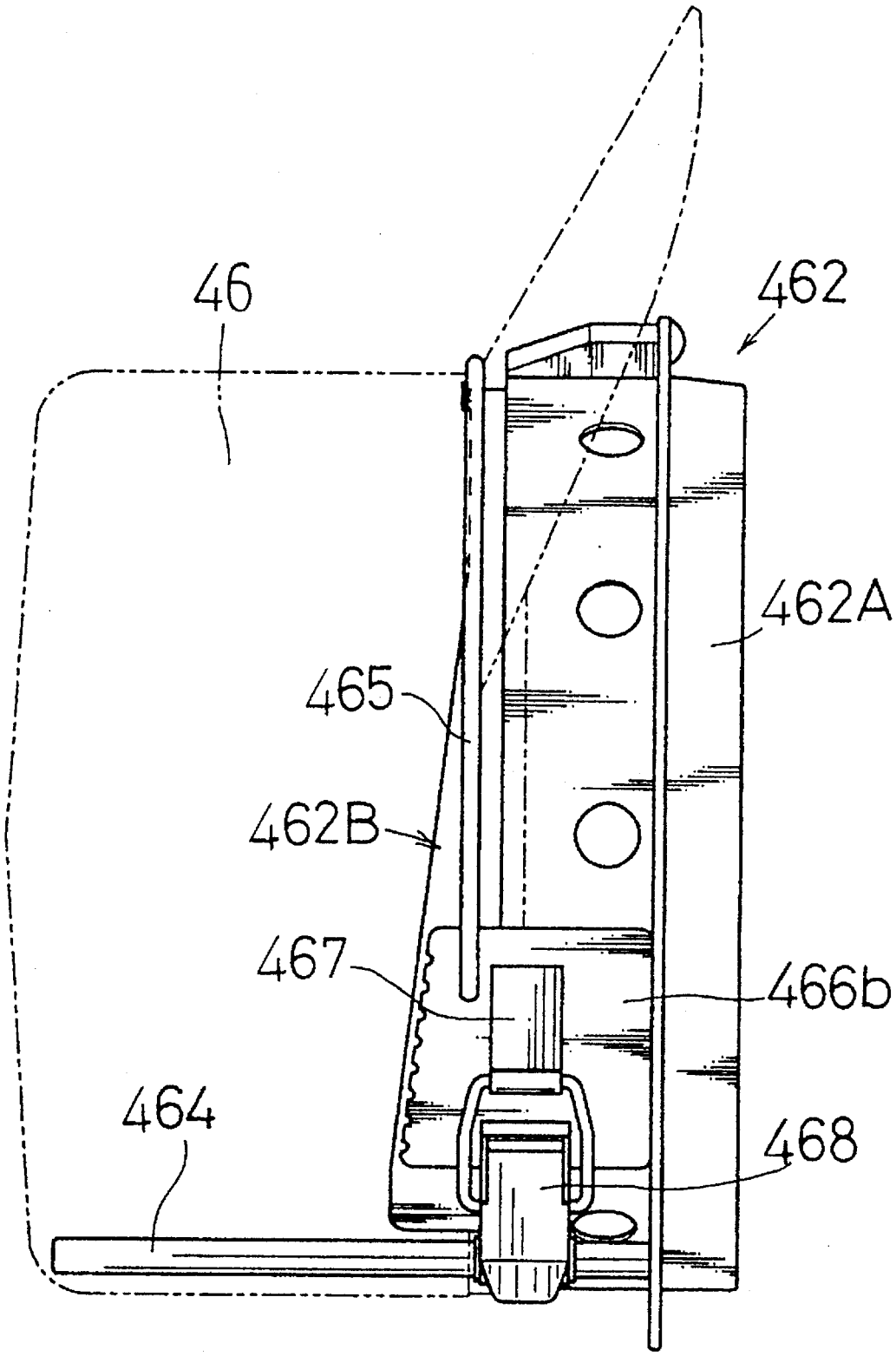
FIG. 64 is a side view of a retainer device shown in FIG. 60.
Figure 65:
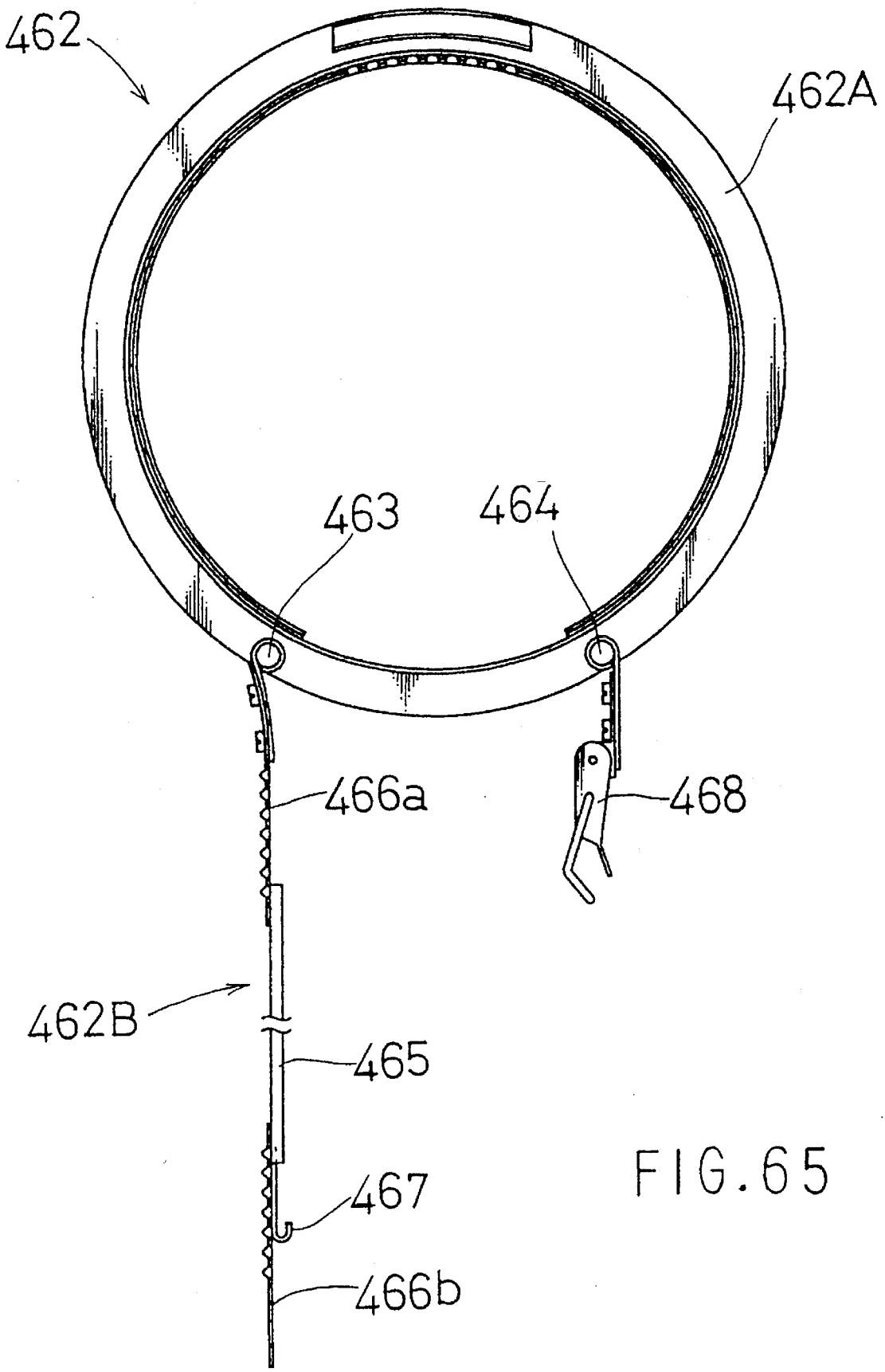
FIG. 65 is a front view of the retainer device.

As shown in FIGS. 64 and 65, the retainer member 462A has an annular configuration, and the pressing member 462B includes a cord-like member 465 such as a wire and a steel belt. Plates 466*a* and 466*b* are connected to both ends of the cord-like member 465. The plate 466*a* has one end pivotally connected to a bar 463 which is fixed to the retainer member 462A. A hook 467 is fixed to the plate 466*b*. A second bar 464 is fixed to the retainer member 462A. A lock member 468 for engagement with the hook 467 is pivotally connected to the second bar 464.

In order to set the work fabric 46 on the retainer device 462, the edge portion of the work fabric 46 is set on the retainer member 462A, and the pressing member 462B is then bent around the embroidery part of the work fabric 46 at a position adjacent the visor part. The hook 467 is thereafter brought to engage the lock member 468. The setting operation of the work fabric 46 on the retainer device 462 is thus completed to permit the embroidery operation to be performed on substantially the whole embroidery part of the work fabric 46.

The embroidery operation of this embodiment will now be explained. After the retainer device 462 on which the work fabric 46 is set as described above is mounted on each of the rotary members 440, the X-axis drive devices 412 and the Y-axis drive devices 414 are driven based on data of the pattern to be embroidered.

The X-axis drive member 13 is then moved together with the drive block 416 in the direction of X-axis by the X-axis drive devices 412, so that the rods 46 and 47 are moved in the direction of X-axis to rotate the rotary member 440 by means of the cord-like members 458 and 459. On the other hand, the rotary members 440 are moved in the direction of Y-axis by the Y-axis drive devices 414 through the Y-axis drive member 415.

The work fabric 46 mounted on each of the rotary members 440 by means of the retainer device 462 is rotated and is linearly moved according to the data of pattern to be embroidered, so that the desired pattern is embroidered on the embroidery part of the work fabric 46 through cooperation of the sewing needle 54 and the shuttle 58.

The pattern can be embroidered on substantially the whole embroidery part of the work fabric 46 by determining the moving amount of the connecting members 454 and 455 to be longer than the circumferential length of the recesses 412 of each rotary members 440. The connecting members 454 and 455 connect the ends of the cord-like members 458 and the ends of the cord-like members 459 to the rod 446 and the rod 447, respectively. Further, by determining the distance between the rotational axes of two adjacent rotary members 440 to be smaller than the maximum moving amount of the connecting members 454 and 455, there exist no idle space between the sewing heads of the multi-head embroidery machine.

19TH EMBODIMENT

Figure 66A:
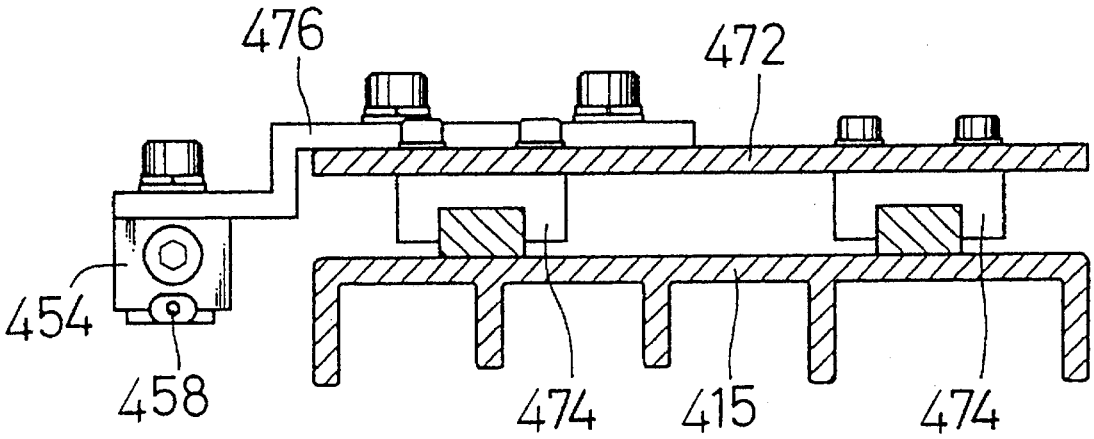
FIGS. 66(A) and 66(B) are sectional views, corresponding to a part of FIG. 60 and a part of FIG. 61, respectively, of the essential parts of a multi-head embroidery machine according to a 19th embodiment of the present invention.
Figure 66B:
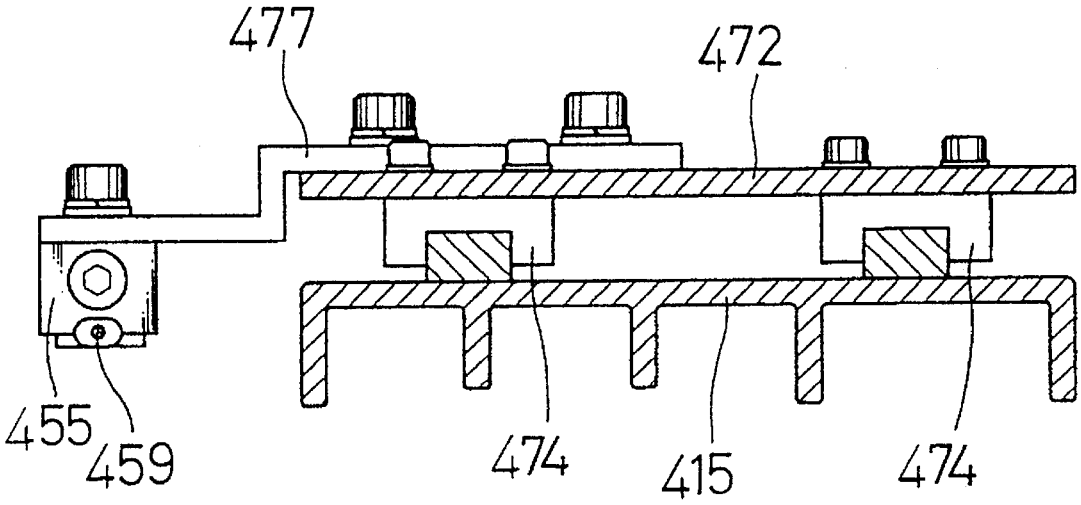

The 19th embodiment of the present invention will now be explained with reference to FIGS. 66(A) and 66(B) which show a construct ion corresponding to a part of the embroidery machine shown in FIGS. 60 and 61 of the 18th embodiment. In this embodiment, a travel plate 472 is incorporated in place of two rods 446 and 447 of the 18th embodiment. The travel plate 472 is supported by linear ways 474 such that the travel plate 472 can be moved relative to the upper surface of the Y-axis drive member 415 only in the direction of X-axis. One end of the travel plate 472 is connected to the drive block 416 as described in the 18th embodiment. The connecting member 454 to which each end of the cord-like member 458 is connected is fixed to the travel plate 472 via a bracket 476 as shown in FIG. 66(A). On the other hand, the connecting member 455 to which each end of the cord-like member 459 is connected is fixed to the travel plate 472 via a bracket 477.

In this embodiment, only the single travel plate 472 can be used in place of the rods 446 and 447, and therefore, the construction can be simplified.

20TH EMBODIMENT

The 20th embodiment of the present invention will now be explained with reference to FIGS. 67 to 71. This embodiment relates to a multi-head embroidery machine having the same embroidery frame 316 and its associated drive mechanism as described in connection with the 15th embodiment, and therefore, in the drawings, the same numerals are affixed to the same parts as the 15th embodiment.

Figure 67:
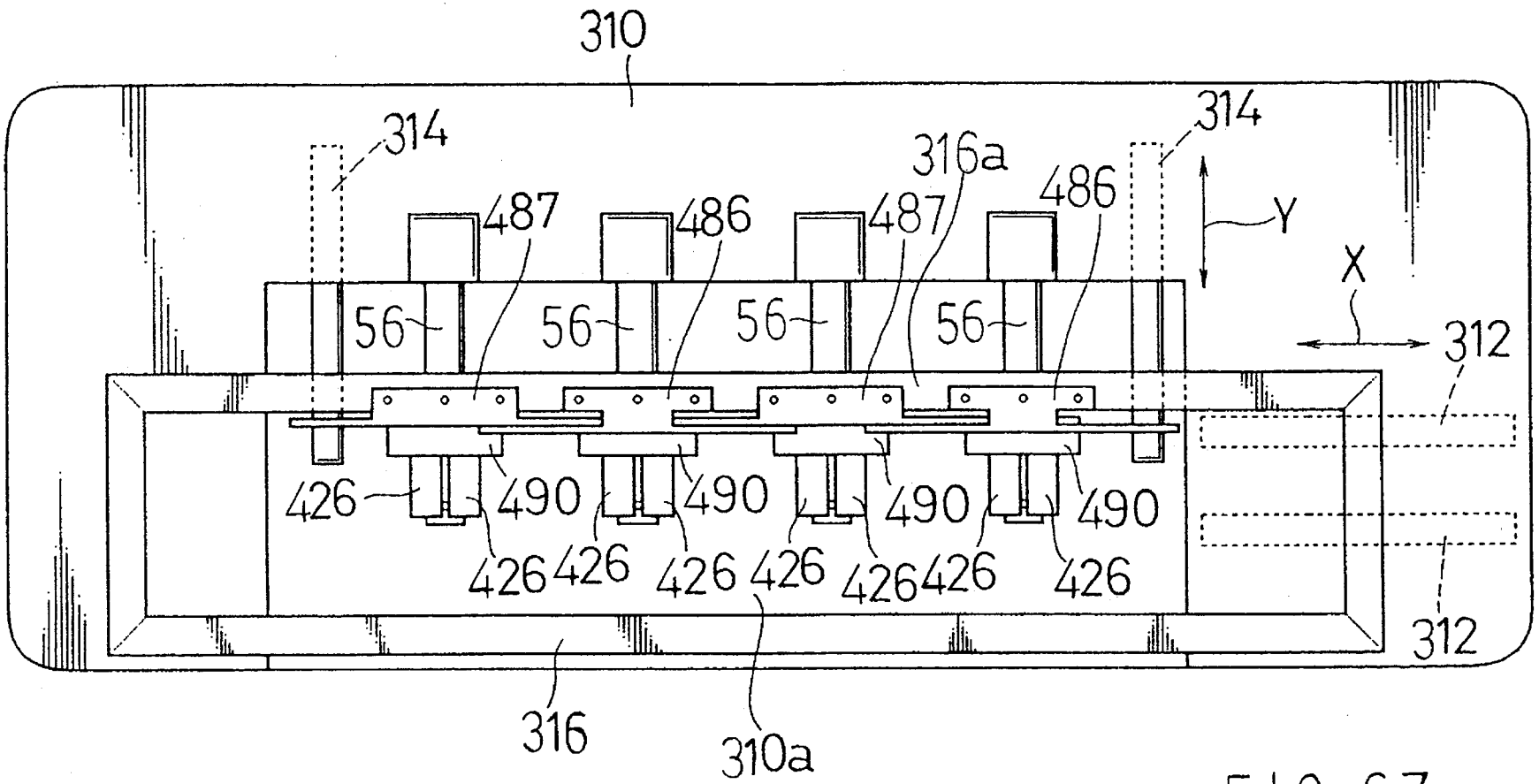
FIG. 67 is a plan view of a multi-head embroidery machine according to a 20th embodiment of the present invention.

Thus, as shown in FIG. 67, the embroidery machine of this embodiment includes the embroidery frame 316 which is moved in both directions of X axis and Y axis by the X axis drive devices 312 and the Y-axis drive devices 324.

Figure 68:
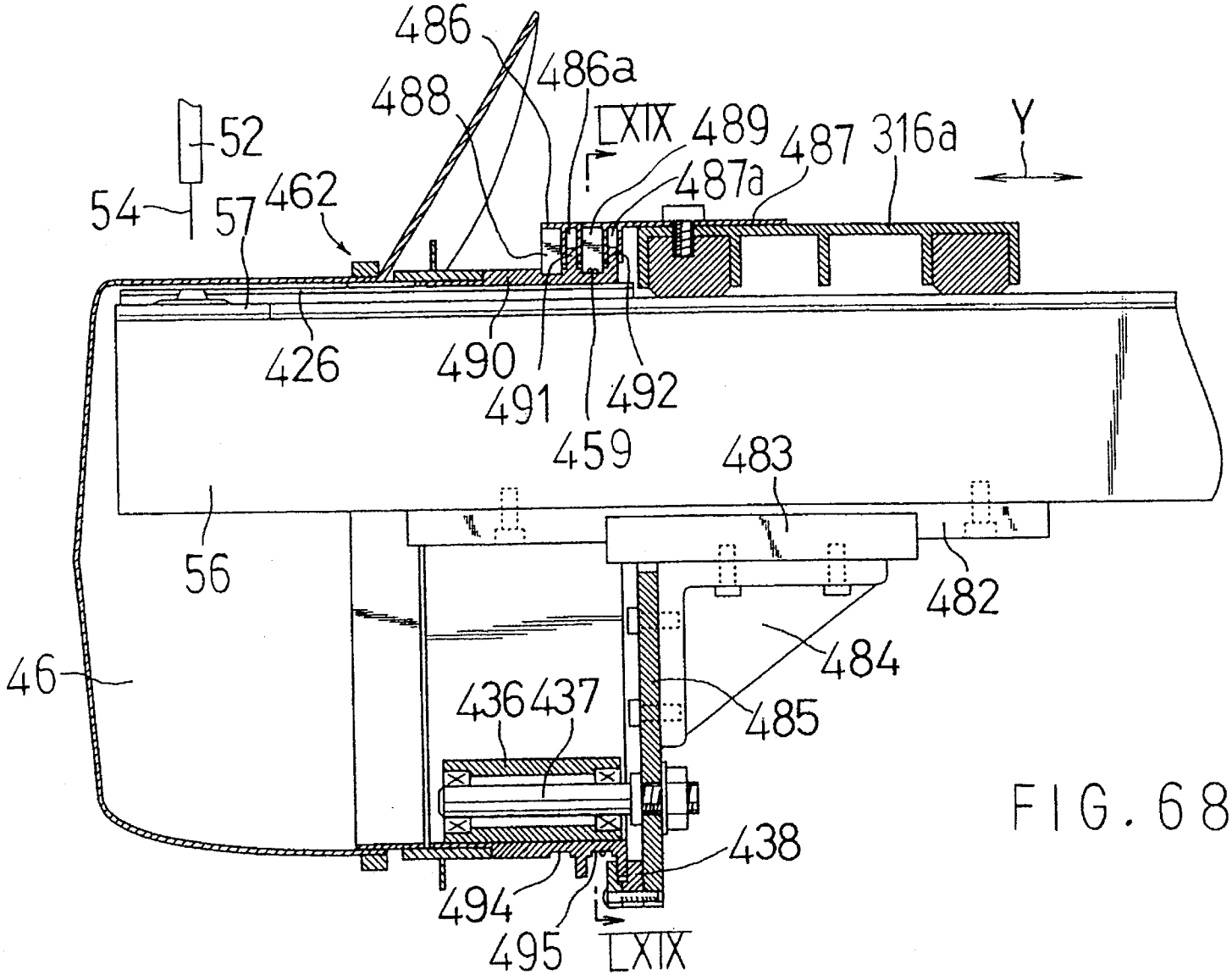
FIG. 68 is a sectional view of a mechanism for driving a retainer device shown in FIG. 67.
Figure 69:
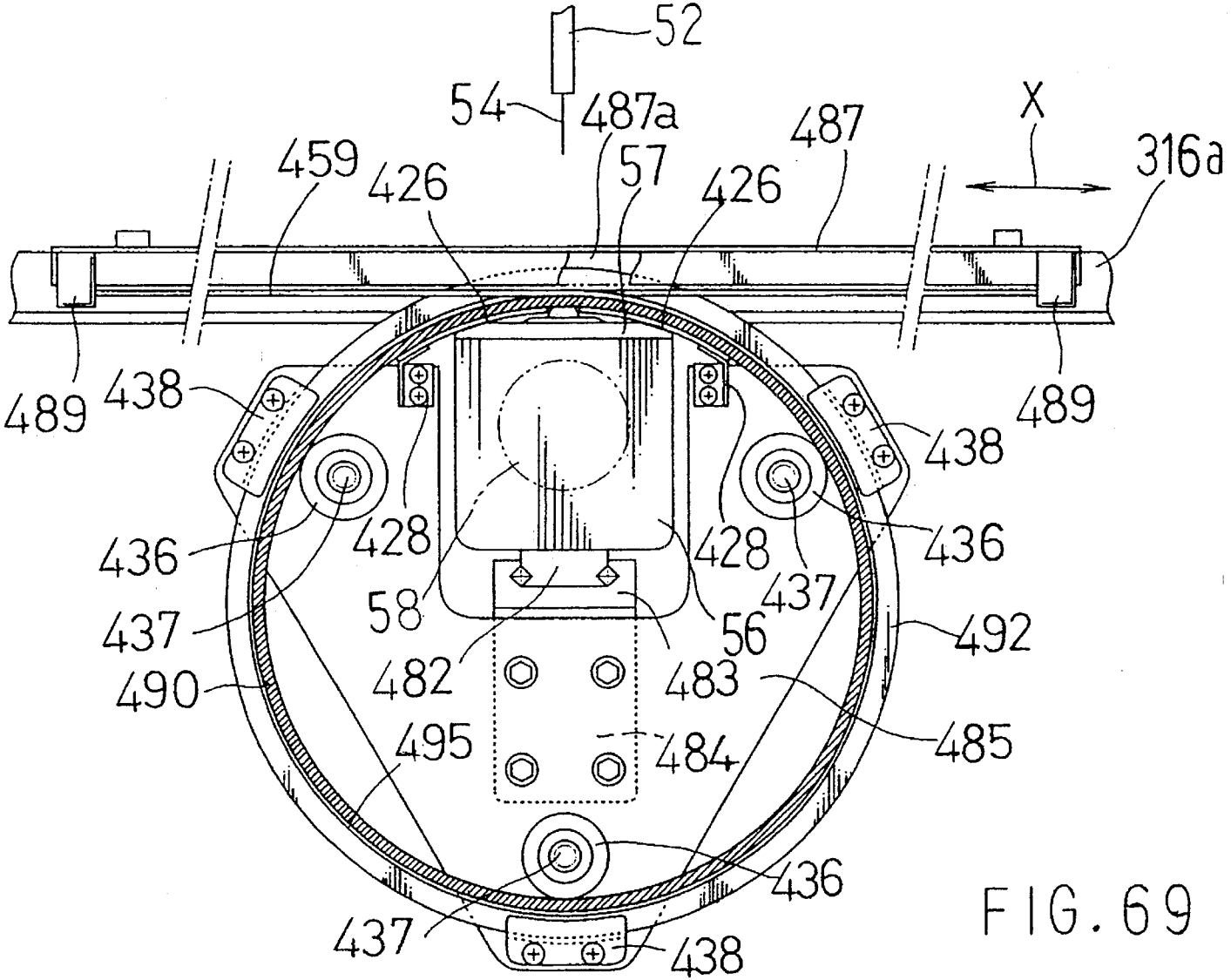
FIG. 69 is a sectional view taken along line LXIX—LXIX in FIG. 68.

As shown in FIGS. 68 and 69, a rail 482 is mounted on the lower surface of each of the shuttle bases 56. A slider 483 is mounted on the rail 482 and is slidably movable relative to the rail 482 in the direction of Y-axis. A plate 485 similar to the plate 430 of the 19th embodiment is fixed to a bracket 484 which is fixed to the lower surface of the slider 483. Thus, the plate 485 is not directly supported by the embroidery frame 316 but is movable in the direction of Y-axis relative to the shuttle base 56 in the same manner as the plate 330 of the 15th embodiment.

Each of rotary members 490 has an annular configuration and is rotatably supported by rollers 436 mounted on the plate 485. Two flanges 491 and 492 and two annular recesses 494 and 495 are formed on the outer peripheral surface of the rear end of each of the rotary members 490. The flange 492 is slidably held by three guide members 438 fixed to the plate 485 in the same manner as the 18th embodiment, so that the rotary member 490 can be rotated relative to the plate 485 within the plane extending in parallel to X-axis and that the rotary member 490 can be moved in the direction of Y-axis together with the plate 485.

As shown in FIG. 67, transmission plates 486 and transmission plates 487 having different configurations from each other are mounted on an upper surface of a rearward frame part 316a one after another in the direction of X-axis. As shown in FIG. 68, a recess 486*a* is formed on the lower surface of a front portion of the transmission plate 486. A recess 487*a* is formed on the lower surface of a front portion of the transmission plate 487. The recess 486*a* and the recess 487*a* are formed at different positions from each other in the direction of Y-axis. Thus, the recess 486*a* of the transmission plate 486 is in engagement with the flange 491 of one of two adjacent rotary members 490, while the recess 487*a* of the transmission plate 487 is in engagement with the flange 492 of the other of two adjacent rotary members 490.

Through engagement of the recess 486*a* of the transmission plate 486 with the flange 491 and through engagement of the recess 487*a* of the transmission plate 487 with the flange 492, only the movement in the direction of Y-axis of the embroidery frame 316 is transmitted to each rotary member 490, so that each rotary member 490 is linearly moved together with its corresponding plate 285 in the direction of Y axis.

Figure 70:
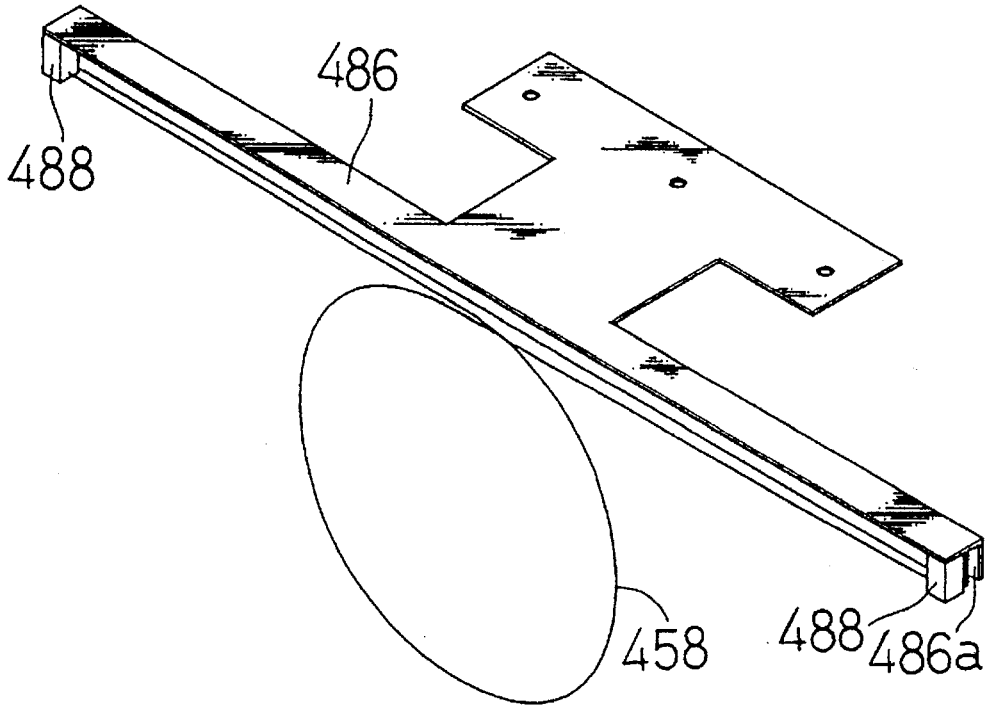
FIGS. 70 and 71 are perspective views showing two different kinds of transmission plates shown in FIG. 67.
Figure 71:
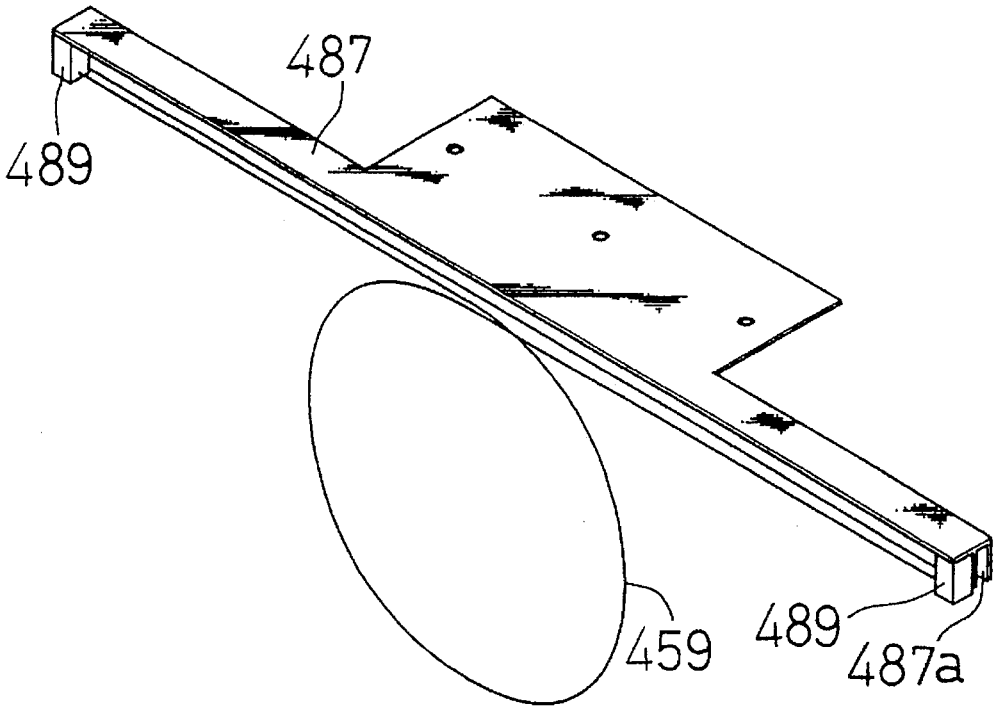

As shown in FIGS. 70 and 71, blocks 488 are fixed to both ends of the lower surface of the transmission plate 486. Further, blocks 489 are fixed to both ends of the lower surface of the transmission plate 487. Both ends of the cord-like member 458 passed over one of the recesses 494 and 495 of the rotary member 490 are connected to the blocks 488. Both ends of the cord-like member 459 passed over the other of the recesses 494 and 495 are connected to the blocks 489.

Since the position of the blocks 488 of the transmission plate 486 and the position of the blocks 489 of the transmission plate 487 are displaced from each other in the direction of Y-axis, the position where the cord-like member 458 of the transmission plate 486 is passed over one of two adjacent rotary members 490 is displaced in the direction of Y-axis from the position where the cord-like member 459 is passed over the other of two adjacent rotary members 490. Thus, the cord-like member 458 of the transmission plate 486 is passed over the recess 494 of one of two adjacent rotary members 490 and the cord-like member 459 of the transmission plate 487 is passed over the other of two adjacent rotary members 490.

The rotary members 490 are thus rotated relative to their corresponding plates 485 through the cord-like members 458 and 459.

As shown in FIG. 68, the retainer device 462 on which the work fabric 46 is set is mounted on each rotary member 490, and the embroidery frame 316 is moved in both directions of X-axis and Y-axis by the X-axis drive devices 312 and the Y-axis drive devices 314 based on the data of pattern to be embroidered. Each rotary member 490 is rotated together with the work fabric 46 in response to movement of the embroidery frame 316 in the direction of X-axis, while each rotary member 490 is linearly moved together with the work fabric 46 in the direction of Y axis in response to movement of the embroidery frame 316 in the direction of Y-axis, so that the desired pattern can be embroidered on the embroidery part of the work fabric 46.

Meanwhile, as will be seen from FIGS. 67 and 68, the path of movement of the blocks 488 of the transmission plate 486 and the path of movement of the blocks 489 of the transmission plate 487 can be partly overlapped with each other in the direction of X-axis. Therefore, similar to the 18th embodiment, the distance between the rotational axes of two adjacent rotary members 490 or the distance between the axes of two adjacent shuttle bases 56 can be determined to be shorter than the maximum amount of movement of the connecting member 454 or 455.

Further, by determining the maximum amount of movement of the blocks 488 of the transmission plate 486 or the blocks 489 of the transmission plate 487, to be greater than the circumferential length of the recess 494 or 495 of each rotary member 490, the embroidery operation can be performed on substantially the whole embroidery part of the work fabric 46 in the circumferential direction.

If the embroidery operation is performed on a flat work fabric such as a flat cloth which is set on the embroidery frame 316, the plate 485 is removed from each shuttle base 56, and the transmission plates 486 and 487 are removed from the embroidery frame 316, so that the rotary members 490, and the cord-like members 458 and 459 connected to the rotary members 490 can be removed together from the embroidery machine. Then, the elevator portion 310 of the machine table 310 shown in FIG. 67 is lifted to the same level as the upper surfaces of the shuttle base 56, so that the embroidery operation can be performed on the flat work fabric.

In the above 18th and 19th embodiments, the engagement between the flange 441 and the guide member 438 is used to move the rotary member 440 together with the plate 430 in the direction of Y-axis. Further in the 20th embodiment, the engagement between the flange 492 and the guide member 438 is used to move the rotary member 490 together with the guide member 438. In place of such engagement between the flanges 441 or flange 492 and the guide member 438, an annular recess (not shown) may be formed on the inner peripheral surface of the rotary member 440 or 490 for engagement with guide pieces (not shown) which are fixed to the plate 430 or 485 and are spaced from each other in the rotational direction of the rotary member 440 or 490 by a predetermined angle such as an angle of 120°. In place of the guide pieces, the annular recess may be in engagement with a collar (not shown) formed on the outer surface of each of the rollers 436.

While the invention has been described with reference to preferred embodiments thereof, it is to be understood that modifications or variation may be easily made without departing from the spirit of this invention which is defined by the appended claims.

What is claimed is:

1. A sewing machine for forming stitches on a curved work fabric by an upper and a lower thread through cooperation of a shuttle and a needle vertically reciprocally driven, comprising:

holder means for retaining the work fabric to be sewn;

support means for rotatably supporting said holder means within a plane in parallel to X axis, said support means being movable in a direction of Y axis, said X axis and said Y axis being perpendicular to each other within a plane extending substantially perpendicular to the driving direction of the needle;

X axis drive means for rotating said holder means within said plane in parallel to said X axis; and Y axis drive means for moving said support means in the direction of said Y axis, so that said holder means is moved in said Y axis as said support means is moved in said Y axis;

said holder means having a supporting surface for supporting the work fabric thereon, said supporting surface having a circumferential length corresponding to substantially the circumferential length of the work fabric; and said X axis drive means being operable to rotate said holder means by about at least one revolution.

2. The sewing machine as defined in claim 1 wherein said Y axis drive means includes a Y axis drive member movable in a direction of said Y axis, said X axis drive means includes an X axis drive member and a motion converting mechanism, said X axis drive member is mounted on said Y axis drive member and is movable relative to said Y axis drive member in a direction of said X axis, and said motion conversion mechanism is operable to convert the movement of said X axis drive member into rotational movement of said holder means.

3. The sewing machine as defined in claim 1 wherein said Y axis drive means includes a Y axis drive member movable in a direction of said Y axis, said X axis drive means includes a motor for rotatably driving said holder means.

4. The sewing machine as defined in claim 1 wherein said X axis drive means and said Y axis drive means include an X-Y axis drive member and a motion converting mechanism, said X-Y axis drive member is movable in both directions of said X axis and Y axis, and said motion converting mechanism converting the movement of said X-Y axis drive member in the direction of said X axis into rotational movement of said holder means.

5. The sewing machine as defined in claim 1 wherein said X axis drive means includes an X axis drive member and a motion converting mechanism, said X axis drive member is movable in a direction of said X axis, said motion converting mechanism is operable to convert the movement of said X axis drive member into rotational movement of said holder means, said motion converting mechanism includes a cord-like or belt-like transmission member and at least one rotary member, said transmission member has both ends fixed to said X axis drive member and has a middle portion passed over said at least one rotary member.

6. The sewing machine as defined in claim 5 wherein said motion converting mechanism serves to transmit the movement of said X axis drive member to said holder means and includes means for increasing the distance of movement of the work fabric retained by said holder means to be greater than the distance of movement of said X axis drive member.

7. The sewing machine as defined in claim 1 wherein said support means includes a support member positioned above the shuttle and having a needle hole extending in parallel to said Y axis, said support member includes an upper surface for supporting thereon at least a part of the work fabric, and said upper surface has a configuration substantially corresponding to at least a part of a cylinder around the rotational axis of said holder means.

8. A multi-head sewing machine comprising:

a plurality of sewing heads each operable to form stitches on a curved work fabric by an upper and a lower thread through cooperation of a shuttle and a needle vertically reciprocally driven;

holder means and support means associated with each of said sewing heads;

said holder means being operable to retain the work fabric to be sewn;

said support means being operable to rotatably support said holder means within a plane in parallel to X axis, said support means being movable in a direction of Y-axis, said X axis and said Y axis being perpendicular to each other within a plane extending substantially perpendicular to the driving direction of the needle;

said holder means having a supporting surface for supporting the work fabric thereon, said supporting surface having a circumferential length corresponding to substantially the circumferential length of the work fabric;

X axis drive means for rotating said holder means within said plane in parallel to said X axis; and Y axis drive means for moving said support means in the direction of said Y axis;

said X axis drive means including an X axis drive member and a motion converting mechanism, said X axis drive member being movable in the direction of said axis, said motion converting mechanism converting the movement of said X axis drive member into rotational movement of said holder means;

said motion converting mechanism including pulleys each mounted on said holder means and cord-like members each having both ends fixed to said X axis drive member and having a middle portion passed over corresponding one of said pulleys;

the positions of passing of said cord-like members over two adjacent said pulleys are displaced from each other in the direction of said Y axis.

9. The multi-head sewing machine as defined in claim 8 wherein said Y axis drive means includes a Y axis drive member movable in a direction of said Y axis, said X axis drive means includes an X axis drive member mounted on said Y axis drive member and movable relative to said Y axis drive member in the direction of said X axis.

10. The multi-head sewing machine as defined in claim 9 wherein said X axis drive member includes a two parallel rods spaced from each other in the direction of said Y axis, and said cord-like members passed over two adjacent said pulleys are alternately fixed to one of said rods and the other of the same.

11. The multi-head sewing machine as defined in claim 8 wherein said X axis drive member is a plate extending in parallel to said plane of said X axis and Y axis.

12. The multi-head sewing machine as defined in claim 8 wherein said X axis drive member and said Y axis drive member are fixed to each other to form an X-Y axis drive member which serves as a frame member for retaining a flat work fabric.

13. A holder device for holding a curved work fabric to be sewn by a sewing machine which is operable to form stitches on the curved work fabric by an upper and a lower thread through cooperation of a shuttle and a needle vertically reciprocally driven, comprising;

a retainer member having a tubular retainer surface for supporting the lower surface of the work fabric;

pressing means for pressing the work fabric on said retainer surface of said retainer member so as to fix the work fabric in position; and said retainer member being rotatable around a rotational axis extending substantially vertically relative to the moving direction of the needle;

said retainer member including a free forward end positioned rearwardly of the driving path of the needle.

14. A holder device for holding a curved work fabric to be sewn by a sewing machine which is operable to form stitches on the curved work fabric by an upper and a lower thread through cooperation of a shuttle and a needle vertically reciprocally driven, comprising;

a retainer member having a tubular retainer surface for supporting the lower surface of the work fabric;

pressing means for pressing the work fabric on said retainer surface of said retainer member so as to fix the work fabric in position; and said retainer member being rotatable around a rotational axis extending substantially vertically relative to the moving direction of the needle;

said retainer member including a free forward end positioned rearwardly of the driving path of the needle;

said free forward end of said retainer member having a configuration conforming to a configuration of an edge of an opening of the work fabric having a truncated conical sewing part when the work fabric is mounted on said retainer member with an axis of the truncated conical sewing part inclined relative to the rotational axis of said retainer member by a predetermined angle.

15. The holder device as defined in claim 14 wherein said pressing means includes a belt-like pressing member to be tightened around the work fabric, said pressing member includes a front side edge having a configuration conforming to said free forward end of said retainer member, so that said pressing member is adapted to press the work fabric on said retainer member within an area not to exceed forwardly of said free forward end of said retainer member.

16. The holder device as defined in claim 13 wherein said pressing means includes a belt-like pressing member to be tightened around the work fabric, said pressing member includes a plurality of teeth for engagement with the work fabric when said pressing member is tightened around the work fabric.

17. The holder device as defined in claim 13 wherein said pressing means includes a belt-like pressing member to be tightened around the work fabric, and further including engaging means disposed between said pressing member and said retainer member for preventing movement of said pressing member in the direction of said rotational axis when said pressing member is tightened to press the work fabric on said retainer member.

18. A holder device for holding a curved work fabric to be sewn by a sewing machine which is operable to form stitches on the curved work fabric by an upper and a lower thread through cooperation of a shuttle and a needle vertically reciprocally driven, comprising;

a retainer member having a tubular retainer surface for supporting the lower surface of the work fabric;

pressing means for pressing the work fabric on said retainer surface of said retainer member so as to fix the work fabric in position;

said retainer member being rotatable around a rotational axis extending substantially vertically relative to the moving direction of the needle;

said retainer member including a free forward end positioned rearwardly of the driving path of the needle;

and an auxiliary retainer member for supporting the lower surface of the work fabric at a position forwardly of a sewable surface of the work fabric and spaced from said free forward end of said retainer member, so that the work fabric is retained also between said auxiliary retainer member and said pressing means.

19. The holder device as defined in claim 18 wherein said pressing means includes a pressing member and an auxiliary pressing member both having belt-like configurations to be tightened around the work fabric supported by said retainer member and said auxiliary retainer member, respectively.

20. The holder device as defined in claim 13 wherein said holder device is adapted to be rotatably mounted on a support member said support member has a forward end extending beyond said free end of said retainer member and includes a support surface for supporting the work fabric positioned forwardly of said free end of said retainer member.

* * * * *

US005553560C1

(12) EX PARTE REEXAMINATION CERTIFICATE (4845th)

United States Patent

Tajima et al.

(10) Number: US 5,553,560 C1

(45) Certificate Issued: Sep. 9, 2003

(54) SEWING MACHINE AND WORK FABRIC HOLDER DEVICE THEREOF

(75) Inventors: Ikuo Tajima, Kasugai (JP); Terutada Kojima, Kasugai (JP); Tomoaki Anezaki, Kasugai (JP); Masayoshi Hirate, Kasugai (JP); Shigeo Suzuki, Kasugai (JP)

(73) Assignee: Tokai Kogyo Mishin Kabushiki Kaisha, Kasugai (JP)

Reexamination Request:
No. 90/005,701, Apr. 7, 2000

Reexamination Certificate for:

| | |
|---|---|
| Patent No.: | **5,553,560** |
| Issued: | **Sep. 10, 1996** |
| Appl. No.: | **08/319,038** |
| Filed: | **Oct. 6, 1994** |

(30) Foreign Application Priority Data

| | | |
|---|---|---|
| Oct. 8, 1993 | (JP) | 5-253118 |
| Jan. 19, 1994 | (JP) | 6-004158 |
| Mar. 17, 1994 | (JP) | 6-047160 |
| Feb. 25, 1994 | (JP) | 6-028397 |
| Apr. 15, 1994 | (JP) | 6-077454 |

(51) Int. Cl.[7] ..... D05C 9/04

(52) U.S. Cl. ..... 112/103; 112/470.18; 112/309

(58) Field of Search ..... 112/103, 470.18, 112/470.06, 470.09, 470.14, 102, 102.5, 475.11

(56) References Cited

U.S. PATENT DOCUMENTS

| | | | | |
|---|---|---|---|---|
| 2,189,045 | A | 2/1940 | Prazak | 112/104 |
| 4,117,790 | A | 10/1978 | Hasegawa et al. | 112/205 |
| 4,241,681 | A | 12/1980 | Porter | 112/322 |
| 4,429,651 | A | 2/1984 | Tajima | 112/273 |
| 4,461,226 | A | 7/1984 | Tajima | 112/98 |
| 4,598,488 | A | 7/1986 | Inteso | 38/102.3 |
| 4,606,285 | A | 8/1986 | Tajima | 112/98 |
| 4,622,907 | A | 11/1986 | Kimura | 112/112.12 |
| 4,628,843 | A | 12/1986 | Tajima | 112/121.12 |
| 4,665,844 | A | 5/1987 | Shibata | 112/103 |
| 4,776,291 | A | 10/1988 | Tajima et al. | 112/98 |
| 4,781,130 | A | 11/1988 | Badowski | 112/121.12 |

(List continued on next page.)

FOREIGN PATENT DOCUMENTS

| | | | |
|---|---|---|---|
| JP | 6-162853 | 8/1985 | D05C/9/04 |
| JP | 60-252759 | 12/1985 | D05C/9/06 |
| JP | 61-284288 | 12/1985 | D05B/23/00 |

(List continued on next page.)

*Primary Examiner*—Peter P. Nerbun

(57) ABSTRACT

A sewing machine serves to form stitches on a curved work fabric by an upper and a lower thread through cooperation of a shuttle and a needle vertically reciprocally driven. The sewing machine includes a holder device for retaining the work fabric to be sewn. The holder device is supported by a support device and is rotatably within a plane in parallel to X axis. The support device is movable in a direction of Y axis. The X axis and the Y axis are perpendicular to each other within a plane extending substantially perpendicular to the driving direction of the needle. The holder device is rotated by an X axis drive mechanism within the plane in parallel to the X axis. The support device is moved by a Y axis drive mechanism in the direction of the Y axis. The holder device serves to retain the work fabric so as to provide a sewable area for substantially the entire circumferential surface of the work fabric.

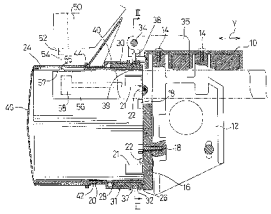

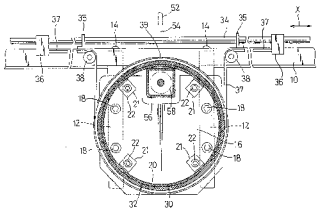

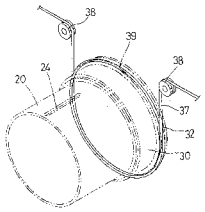

U.S. PATENT DOCUMENTS

| | | | | |
|---|---|---|---|---|
| 4,936,233 | A | 6/1990 | Tajima et al. | 112/103 |
| 4,943,906 | A | 7/1990 | Tajima et al. | 364/188 |
| 4,960,061 | A | 10/1990 | Tajima et al. | 112/103 |
| 4,998,964 | A | 3/1991 | Golia | 112/121.12 |
| 5,001,996 | A | 3/1991 | Tajima et al. | 112/103 |
| 5,052,315 | A | 10/1991 | Tajima et al. | 112/103 |
| 5,065,682 | A | 11/1991 | Tajima et al. | 112/103 |
| 5,131,340 | A | 7/1992 | Tajima et al. | 112/292 |
| 5,167,194 | A | 12/1992 | Nakagaki | 112/103 |
| 5,261,338 | A | 11/1993 | Tajima et al. | 112/103 |
| 5,277,140 | A | 1/1994 | Nakagaki | 112/121.12 |
| 5,327,840 | A | 7/1994 | Tajima et al. | 112/121.11 |
| 5,331,909 | A | 7/1994 | Tajima et al. | 112/103 |
| 5,383,412 | A | 1/1995 | Sakakibara et al. | 112/78 |
| 5,415,116 | A | 5/1995 | Nishio | 112/103 |
| 5,474,001 | A | 12/1995 | Tajima et al. | 112/102.5 |
| 5,507,241 | A | 4/1996 | Evans | 112/470.18 |
| 5,553,560 | A | 9/1996 | Tajima et al. | 112/103 |
| 5,598,797 | A | 2/1997 | Patterson | 112/103 |
| 5,615,628 | A | 4/1997 | Tajima et al. | 112/220 |
| 5,623,887 | A | 4/1997 | Tajima et al. | 112/291 |
| 5,628,263 | A | 5/1997 | Tajima et al. | 112/98 |
| 5,649,496 | A | 7/1997 | Morita et al. | 112/103 |
| 5,655,470 | A | 8/1997 | Tajima et al. | 112/236 |
| 5,655,471 | A | 8/1997 | Tajima | 112/261 |
| 5,664,511 | A | 9/1997 | Tajima et al. | 112/292 |
| 5,701,831 | A | 12/1997 | Morita | 112/103 |
| 5,701,832 | A | 12/1997 | Tajima et al. | 112/155 |
| 5,706,747 | A | 1/1998 | Tajima et al. | 112/258 |
| 5,755,170 | A | 5/1998 | Tajima et al. | 112/292 |
| 5,809,918 | A | 9/1998 | Tajima et al. | 112/103 |
| 5,832,853 | A | 11/1998 | Pokrishevsky et al. | 112/475.11 |
| 5,915,316 | A | 6/1999 | Tajima et al. | 112/470.05 |
| 6,152,058 | A | 11/2000 | Tajima et al. | 112/292 |
| 6,247,419 | B1 | 6/2001 | Tajima et al. | 112/98 |
| 6,263,817 | B1 | 7/2001 | Tajima et al. | 112/475.22 |

FOREIGN PATENT DOCUMENTS

| | | | | |
|---|---|---|---|---|
| JP | 63-120158 | | 5/1988 | D05C/9/06 |
| JP | 1-229858 | | 9/1989 | D05C/9/04 |
| JP | 01229859 | A | 9/1989 | D05C/9/04 |
| JP | 01229860 | A | 9/1989 | D05C/9/04 |
| JP | 01229861 | A | 9/1989 | D05C/9/04 |
| JP | 01229862 | A | 9/1989 | D05C/9/04 |
| JP | 01229863 | A | 9/1989 | D05C/9/06 |
| JP | 01229864 | A | 9/1989 | D05C/9/06 |
| JP | 01239151 | A | 9/1989 | D05C/9/04 |
| JP | 1-53384 | | 11/1989 | D05C/9/04 |
| JP | 2-251660 | | 10/1990 | D05C/9/04 |
| JP | 02251661 | A | 10/1990 | D05C/9/04 |
| JP | 02251662 | A | 10/1990 | D05C/9/04 |
| JP | 4-40467 | | 7/1992 | D05C/9/06 |
| JP | 05117957 | A | 5/1993 | D05C/9/06 |
| JP | 05321123 | A | 12/1993 | D05C/9/04 |
| JP | 06015073 | A | 1/1994 | D05B/21/00 |
| JP | 06128860 | A | 5/1994 | D05C/9/04 |
| JP | 06136657 | A | 5/1994 | D05C/9/04 |
| JP | 06142359 | A | 5/1994 | D05B/21/00 |
| JP | 06142360 | A | 5/1994 | D05B/21/00 |
| JP | 06142361 | A | 5/1994 | D05B/21/00 |
| JP | 06142362 | A | 5/1994 | D05B/21/00 |
| JP | 06142363 | A | 5/1994 | D05B/21/00 |
| JP | 06257057 | A | 9/1994 | D05C/9/04 |
| JP | 06257058 | A | 9/1994 | D05C/9/04 |
| JP | 6-257059 | | 9/1994 | D05C/9/04 |

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 8, lines 11–18:

As shown in FIG. 2, [the] *a* retainer member 40 having a cylindrical configuration is detachably mounted on the mounting surface 31 of the rotary member 30. The retainer member 40 includes a set surface 42 on which the work fabric 46 (a cap in this embodiment) is retained by means of a pressing ring 44. Thus, the rotary member 30, the retainer member [30] *40* and the pressing ring 44 form a holder device for rotatably retaining the work fabric 46.

Column 8, lines 19–37:

The work fabric 46 prior to mounting on the retainer member 40 is shown in FIG. 5(A). The retainer member 40 prior to mounting on the rotary member 30 is shown in FIG. 6. As will be seen from these drawings, the work fabric 46 is set on the set surface 42 of the retainer member 40, and the pressing ring 44 is thereafter set around the outer surface of the work fabric 46. The pressing ring 44 is then tightened by locking [engagement of] a hook device 44a, so that the work fabric 46 is pressed on the set surface 42 of the retainer member 40. The retainer member 40, on which the work fabric 46 is thus retained is mounted on the mounting surface 31 of the rotary member 30 and is then fixed in position by means of a lock mechanism (not shown). As shown in FIG. 2, the inner peripheral surface of the retainer member 40 [opposed to] *that is opposite of* the set surface [40] *42* is stably supported by the outer peripheral surface of the support member [40] *20*. The pressing ring 44 may be made of a resilient member such as a rubber-belt ring 44A shown in FIG. 5(B) [and] *or* a garter ring 44B shown in FIG. 5(C).

Column 8, lines 38–60:

In order to perform a sewing operation on the work fabric 46, the work fabric 46 is set on the retainer member 40 and is then mounted on the rotary member 30 as described above. The rotary member 30 is moved in the direction of *the* Y axis together with the support member 20 when the Y-axis drive member 10 is moved by the Y-axis drive devices 13 based on the data of *the* pattern to be sewn with respect to *the* Y axis, while the rotary member 30 is rotated relative to the support member 20 [the] when rod 34 is moved together with the X-axis drive member 2 by the X-axis drive devices 11 based on the data of *the* pattern to be sewn with respect to *the* X axis. Thus, the work fabric 46 mounted on the rotary member 30 by means of the retainer member 40 is moved together with the support member 20 in the direction of *the* Y axis and is rotated within a plane which is perpendicular to *the* Y axis and extends in the direction of *the* X axis. The needle bar 52 and the shuttle 58 are synchronously driven with such movement of the work fabric 46 to form stitches of *a* desired pattern on a part of the work fabric 46 (hereinafter called "embroidery part") to be embroidered by the upper and lower threads. In this embodiment, the embroidery part is a side portion of the cap having a substantially cylindrical configuration.

Column 11, line 57–column 12, line 8:

A cord-like member 126, such as a wire [and] *or* a steel belt, is passed over the outer periphery of the rotary ring 122 in the same manner as the cord-like member 37 of the first embodiment. [The] *Both ends of the* cord-like member 126 [has both ends which] are passed over a pulley 128 *that is* supported by the Y axis drive member 10 and are fixed to the rod 34 by means of the blocks 36. Thus, as the rod 34 is moved in the direction of X axis based on the [date of] pattern *data* with respect to *the* X axis, the rotary member 122 is rotatably driven within the plane in parallel to *the* X axis. On the other hand, as the Y axis drive member 10 is moved in the direction of *the* Y axis based on the [data of] pattern *data* with respect to *the* Y axis, the rotary member 122 is moved in the direction of *the* Y axis together with the support base 12 and the plate 114. In this embodiment, although the cord-like member 126 is passed over the rotary member 122 [by] one time, the rotary member 122 can be rotated by an angle of more than 360° by appropriately determining the distance between the blocks 36 to which both ends of the cord-like member 126 are connected.

Column 14, lines 28–36:

Since the retainer device comprising the retainer member 140 and the pressing member 150 of this embodiment serves to provide a broader sewing area for the embroidery part, [the limitation of kind of pattern to be sewn can be improved] *limitations on the types of patterns that can be sewn are reduced*. Further, since the work fabric 46A can be rotated by an angle of more then 360° due to the rotation of the rotary member 122, [with] *in addition to* the improved sewable area as described above, the embroidery machine can [cope with demand of various kind] *handle various kinds* of patterns.

Column 16, lines 24–32:

12th to 14th embodiments of the present invention will now be explained with reference to FIGS. 33 to 44. These embodiments relate to improvements [of] *in* a motion conversion device incorporating the cord-like member 37 for converting the [liner] *linear* movement of the X-axis drive member 2 into the rotational movement of the rotary member 30 as described in the first embodiment. In FIGS. 33 to 44, the same numerals are affixed to the same parts as the first embodiment.

Column 21, lines 7–14:

As shown in FIGS. 47 and 48, a rail 332 is fixed to the lower surface of each of the shuttle bases 56 by bolts 332a. A slider [234] *334* is mounted on the rail 332 and is slidably movable relative thereto in the direction of Y-axis. A bracket 336 is fixed below the slider 334 by bolts 336a. A plate 330 having a configuration not to interfere with the shuttle base 56 is fixed to the bracket 336 by bolts 330a as shown in FIG. 47.

Column 21, lines 17–24:

A support plate 326 corresponding to the support plate 120 of the ninth embodiment and having an arcuate [configuration in] *cross*-section is fixed to the front surface of the plate 330 by bolts 330a and is positioned to cover the upper portion of the shuttle base 56. Thus, the support plate 326 has an elongated [s lot] *slot* 327 extending in the direction of *the* Y-axis within the range of at least the movement of the plate 330.

Column 21, lines 37–43:

Thus, the rotary member 340 is rotatable within a plane extending in the direction of *the* X-axis by an angle of more than 360°. [While] *At the same time*, the rotary member 340 is movable together with the plate 330 in the direction of *the* Y-axis. The rotary member 340 has a set surface 342 for mounting a retainer member 360 thereon at a position adjacent *to* the forward end or a free end of the rotary member 340.

Column 21, lines 44–50:

A transmission mechanism 350 for transmitting the driving movement of the embroidery frame 316 to the rotary member 340 will now be explained. The transmission mechanism 350 includes a mechanism for converting the [liner] *linear* movement of the embroidery frame 316 in the direction of *the* X-axis into the rotational movement of the rotary member 340.

Column 23, lines 28–34:

As shown in FIGS. 51 and 52, the pins 366 extend in parallel from the flange [336] *363* in the direction of *the* Y axis. When the work fabric 46 is mounted on the retainer member 360A, the pins [336] *366* are positioned inwardly of the work fabric 46, so that the work fabric 46 can be clamped at positions corresponding to the pins [336] *366* by means of clips 367 as shown in FIG. 52.

AS A RESULT OF REEXAMINATION, IT HAS BEEN DETERMINED THAT:

The patentability of claims 1–20 is confirmed.

New claims 21–77 are added and determined to be patentable.

*21. A holder device adapted to retain a cap having a visor to be sewn by a sewing machine that is adapted to form stitches on the cap using an upper and a lower thread through cooperation of a shuttle and a vertically reciprocally driven needle, comprising:*

*a retainer adapted to rotate around a rotational axis that is substantially perpendicular to the moving direction of the needle, said retainer comprising a cylindrical retainer surface for supporting an inner surface of the cap and a free forward end positioned rearwardly of the moving direction of the needle, and*

*a belt-like resiliently flexible material adapted to be pressed and tightened around the cap, whereby the cap is fixed in position with respect to the retainer, said belt-like resiliently flexible material comprising a front edge having a configuration substantially conforming to said free forward end of said retainer and said belt-like resiliently flexible material being pivotably coupled to the retainer, wherein the free forward end of the retainer and the belt-like resiliently flexible material are adapted to not interfere with the needle when the holder device rotates with respect to the needle during an embroidery operation.*

*22. A holder device as in claim 21, wherein said belt-like resiliently flexible material comprises an insertion slot adapted to receive the visor.*

*23. A holder device as in claims 21 or 22, wherein said belt-like resiliently flexible material further comprises a plurality of teeth adapted to engage the cap when said belt-like resiliently flexible material is tightened around the cap.*

*24. A holder device as in any of claims 21–23, wherein said belt-like resiliently flexible material further comprises engaging means disposed between said belt-like resiliently flexible material and said retainer for preventing said belt-like resiliently flexible material from moving in the direction of said rotational axis when said belt-like resiliently flexible material is tightened to press the cap on said retainer.*

*25. A holder device as in any of claims 21–24 wherein said holder device is adapted to be rotatably mounted with respect to an arched support plate, said support plate having a forward end that extends beyond said free forward end of said retainer member, a support surface adapted to support a portion of the cap that is positioned forwardly of said free forward end of said retainer and a needle slot adapted to receive the needle during a sewing operation.*

*26. A holder adapted to retain a curved fabric, whereby an upper thread and a lower thread can form stitches in the curved fabric through cooperation of a shuttle and a sewing needle, the sewing needle being vertically and reciprocally driven by a sewing machine, comprising:*

*a cylindrical retainer adapted to rotate around a rotational axis that extends substantially perpendicularly relative to the moving direction of the sewing needle, the retainer comprising a free forward end constructed so as not to extend forwardly of the driving path of the sewing needle and a needle hole that receives the sewing needle and a cylindrical retainer surface adapted to support an inner surface of the curved fabric and*

*means for pressing the curved fabric on the cylindrical retainer surface so as to retain and fix the curved fabric in position, the pressing means comprising a front edge having a configuration substantially conforming to said free forward end of said retainer.*

*27. A holder adapted to retain a cap having a visor, whereby an upper thread and a lower thread can form stitches in the cap through cooperation of a shuttle and a sewing needle, the sewing needle being vertically and reciprocally driven by a sewing machine, comprising:*

*a cylindrical retainer adapted to rotate around a rotational axis that extends substantially perpendicularly relative to the moving direction of the sewing needle, the retainer comprising a free forward end constructed so as not to extend forwardly of the driving path of the sewing needle and a needle hole that receives the sewing needle and a cylindrical retainer surface adapted to support an inner surface of the cap and*

*means for pressing the cap on the cylindrical retainer surface so as to retain and fix the cap in position, the pressing means comprising a front edge having a configuration substantially conforming to said free forward end of said retainer.*

*28. A holder adapted to retain a cap having a visor, whereby an upper thread and a lower thread can form stitches in the cap through cooperation of a shuttle and a sewing needle, the sewing needle being vertically and reciprocally driven by a sewing machine, comprising:*

*a cylindrical retainer adapted to rotate around a rotational axis that extends substantially perpendicularly relative to the moving direction of the sewing needle, the retainer comprising a free forward end constructed so as not to extend forwardly of the driving path of the sewing needle and a needle hole that receives the sewing needle and a cylindrical retainer surface adapted to support an inner surface of the cap and*

*means for pressing the cap on the cylindrical retainer surface so as to retain and fix the cap in position, the pressing means comprising a belt-like resiliently flex-*

*ible material having an insertion slot adapted to receive the cap visor and a front edge having a configuration substantially conforming to said free forward end of said retainer member.*

*29. A holder adapted to retain a cap having a visor, whereby an upper thread and a lower thread can form stitches in the cap through cooperation of a shuttle and a sewing needle, the sewing needle being vertically and reciprocally driven by a sewing machine, comprising:*

*a cylindrical retainer adapted to rotate around a rotational axis that extends substantially perpendicularly relative to the moving direction of the sewing needle, the retainer comprising a free forward end constructed so as not to extend forwardly of the driving path of the sewing needle and a needle hole that receives the sewing needle, a cylindrical retainer surface adapted to support an inner surface of the cap, a first support pin and a second support pin, the support pins also being adapted to support the inner surface of the cap and*

*means for pressing the cap on the cylindrical retainer surface so as to retain and fix the cap in position, the pressing means comprising a belt-like resiliently flexible material having an insertion slot adapted to receive the cap visor and a front edge having a configuration substantially conforming to said free forward end of said retainer member, wherein one end of the pressing means is pivotably coupled to the first support pin, and the other end of the pressing means comprises a lock adapted to couple to the second support pin.*

*30. A holder adapted to retain a cap having a visor, whereby an upper thread and a lower thread can form stitches in the cap through cooperation of a shuttle and a sewing needle, the sewing needle being vertically and reciprocally driven by a sewing machine, comprising:*

*a cylindrical retainer adapted to rotate around a rotational axis that extends substantially perpendicularly relative to the moving direction of the sewing needle, the retainer comprising a free forward end constructed so as not to extend forwardly of the driving path of the sewing needle and a needle hole that receives the sewing needle, a cylindrical retainer surface adapted to support an inner surface of the cap, a flange and a first support pin and a second support pin fixed to the flange, the support pins also being adapted to support the inner surface of the cap and*

*means for pressing the cap on the cylindrical retainer surface so as to retain and fix the cap in position, the pressing means comprising a belt-like resiliently flexible material having an insertion slot adapted to receive the cap visor and a front edge having a configuration substantially conforming to said free forward end of said retainer member, the insertion slot comprising a set of teeth adapted to secure the cap to the retainer, wherein one end of the pressing means is pivotably coupled to the first support pin, and the other end of the pressing means comprises a lock adapted to couple to the second support pin.*

*31. A holder adapted to retain a curved fabric, whereby an upper thread and a lower thread can form stitches in the curved fabric through cooperation of a shuttle and a sewing needle, the sewing needle being vertically and reciprocally driven by a sewing machine, comprising:*

*a cylindrical retainer adapted to rotate around a rotational axis that extends substantially perpendicularly relative to the moving direction of the sewing needle, the retainer comprising a free forward end constructed so as not to extend forwardly of the driving path of the sewing needle and a needle hole that receives the sewing needle and a cylindrical retainer surface adapted to support an inner surface of the curved fabric and*

*means for pressing the curved fabric on the cylindrical retainer surface so as to retain and fix the curved fabric in position, the pressing means comprising a pressing ring made of a resilient material and a front edge having a configuration substantially conforming to said free forward end of said retainer.*

*32. A holder adapted to retain a curved fabric having a visor, whereby an upper thread and a lower thread can form stitches in the curved fabric through cooperation of a shuttle and a sewing needle, the sewing needle being vertically and reciprocally driven by a sewing machine, comprising:*

*a cylindrical retainer adapted to rotate around a rotational axis that extends substantially perpendicularly relative to the moving direction of the sewing needle, the retainer comprising a free forward end constructed so as not to extend forwardly of the driving path of the sewing needle and a needle hole that receives the sewing needle and a cylindrical retainer surface adapted to support an inner surface of the curved fabric and*

*means for pressing the curved fabric on the cylindrical retainer surface so as to retain and fix the curved fabric in position, the pressing means comprising a pressing ring made of a resilient material, a front edge having a configuration substantially conforming to said free forward end of said retainer, and a means for locking the pressing ring to tighten the pressing ring around the curved fabric.*

*33. A holder adapted to retain a curved fabric having a visor, whereby an upper thread and a lower thread can form stitches in the curved fabric through cooperation of a shuttle and a sewing needle, the sewing needle being vertically and reciprocally driven by a sewing machine, comprising:*

*a cylindrical retainer adapted to rotate around a rotational axis that extends substantially perpendicularly relative to the moving direction of the sewing needle, the retainer comprising a free forward end constructed so as not to extend forwardly of the driving path of the sewing needle and a needle hole that receives the sewing needle, a cylindrical retainer surface adapted to support an inner surface of the curved fabric, a flange and a pair of support pins fixed to the flange, extending forwardly of the free forward end and adapted to support the inner surface of the curved fabric and*

*means for pressing the curved fabric on the cylindrical retainer surface so as to retain and fix the curved fabric in position, the pressing means comprising a pressing ring made of a resilient material, a front edge having a configuration substantially conforming to said free forward end of said retainer and a means for locking the pressing ring to tighten the pressing ring around the curved fabric.*

*34. A holder adapted to retain a curved fabric, whereby an upper thread and a lower thread can form stitches in the curved fabric through cooperation of a shuttle and a sewing needle, the sewing needle being vertically and reciprocally driven by a sewing machine, comprising:*

*a cylindrical retainer adapted to rotate around a rotational axis that extends substantially perpendicularly relative to the moving direction of the sewing needle,*

*the retainer comprising a free forward end constructed so as not to extend forwardly of the driving path of the sewing needle and a needle hole that receives the sewing needle and a cylindrical retainer surface adapted to support an inner surface of the curved fabric and*

*means for pressing the curved fabric on the cylindrical retainer surface so as to retain and fix the curved fabric in position, the pressing means comprising a cord-like member having a configuration substantially conforming to said free forward end of said retainer.*

*35. A holder adapted to retain a cap having a visor, whereby an upper thread and a lower thread can form stitches in the cap through cooperation of a shuttle and a sewing needle, the sewing needle being vertically and reciprocally driven by a sewing machine, comprising:*

*a cylindrical retainer adapted to rotate around a rotational axis that extends substantially perpendicularly relative to the moving direction of the sewing needle, the retainer comprising a free forward end constructed so as not to extend forwardly of the driving path of the sewing needle and a needle hole that receives the sewing needle and a cylindrical retainer surface adapted to support an inner surface of the cap and*

*means for pressing the cap on the cylindrical retainer surface so as to retain and fix the cap in position, the pressing means comprising a cord-like member having a configuration substantially conforming to said free forward end of said retainer.*

*36. A holder adapted to retain a cap having a visor, whereby an upper thread and a lower thread can form stitches in the cap through cooperation of a shuttle and a sewing needle, the sewing needle being vertically and reciprocally driven by a sewing machine, comprising:*

*a cylindrical retainer adapted to rotate around a rotational axis that extends substantially perpendicularly relative to the moving direction of the sewing needle, the retainer comprising a free forward end constructed so as not to extend forwardly of the driving path of the sewing needle and a needle hole that receives the sewing needle, a cylindrical retainer surface adapted to support an inner surface of the cap, a first support pin and a second support pin, the support pins adapted to support the inner surface of the cap and*

*means for pressing the cap on the cylindrical retainer surface so as to retain and fix the cap in position, the pressing means comprising a cord-like member having a configuration substantially conforming to said free forward end of said retainer member, wherein one end of the pressing means is pivotably coupled to the first support pin, and the other end of the pressing means comprises a lock adapted to couple to the second support pin.*

*37. A holder as in any of claims 26–36, wherein the pressing means is made of stainless steel.*

*38. A sewing machine comprising:*

*a sewing head comprising a vertically and reciprocally driven sewing needle,*

*a shuttle base extending substantially perpendicularly relative to the sewing needle, the shuttle base comprising a shuttle that cooperates with the sewing needle to form stitches in the curved fabric using an upper thread and a lower thread and*

*a holder adapted to retain a curved fabric comprising:*

*a cylindrical retainer adapted to rotate around a rotational axis that extends substantially perpendicularly relative to the sewing needle, the retainer comprising a free forward end that does not extend forwardly of the moving direction of the needle and a cylindrical retainer surface adapted to support an inner surface of the curved fabric and*

*means for pressing the curved fabric on the cylindrical retainer surface so as to retain and fix the curved fabric in position.*

*39. A sewing machine adapted to embroider a curved fabric comprising:*

*a sewing head comprising a vertically and reciprocally driven sewing needle,*

*a shuttle base extending substantially perpendicularly relative to the sewing needle, the shuttle base comprising a shuttle that cooperates with the sewing needle to form stitches in the curved fabric using an upper thread and a lower thread,*

*a holder adapted to retain the curved fabric comprising:*

*a cylindrical retainer adapted to rotate around a rotational axis that extends substantially perpendicularly relative to the sewing needle, the retainer comprising a free forward end that does not extend forwardly of the moving direction of the needle and a cylindrical retainer surface adapted to support an inner surface of the curved fabric and*

*means for pressing the curved fabric on the cylindrical retainer surface so as to retain and fix the curved fabric in position, and*

*an arched support plate disposed between the shuttle base and the sewing needle and extending forwardly of the free forward end of the retainer, the support plate comprising a needle slot that extends substantially in parallel with the shuttle base, wherein the needle slot is adapted to permit the needle to pass through the support plate during an embroidering operation and the support plate is adapted to support a portion of the inner surface of the curved fabric that is proximal to the area being sewn.*

*40. A sewing machine adapted to embroider a curved fabric comprising:*

*a sewing head comprising a vertically and reciprocally driven sewing needle,*

*a shuttle base extending substantially perpendicularly relative to the sewing needle, the shuttle base comprising a shuttle that cooperates with the sewing needle to form stitches in the curved fabric using an upper thread and a lower thread,*

*a holder adapted to retain the curved fabric comprising:*

*a cylindrical retainer adapted to rotate around a rotational axis that extends substantially perpendicularly relative to the sewing needle, the retainer comprising a free forward end that does not extend forwardly of the moving direction of the needle and a cylindrical retainer surface adapted to support an inner surface of the curved fabric and*

*means for pressing the curved fabric on the cylindrical retainer surface so as to retain and fix the curved fabric in position,*

*a rotary member, wherein the holder device is mounted on the outer surface of the rotary member and*

*a plurality of rollers mounted in parallel with the shuttle base and supporting an inner surface of the rotary member.*

*41. A sewing machine as in claim 40, wherein at least two rollers contact the rotary member at an upper portion and*

*extend forwardly of the free forward end of the retainer, the at least two rollers further comprising a tapered front end adapted to support a portion of the inner surface of the curved fabric that is proximal to the area being sewn.*

*42. A sewing machine adapted to embroider a curved fabric comprising:*

*a sewing head comprising a vertically and reciprocally driven sewing needle,*

*a shuttle base extending substantially perpendicularly relative to the sewing needle, the shuttle base comprising a shuttle that cooperates with the sewing needle to form stitches in the curved fabric using an upper thread and a lower thread,*

*a holder adapted to retain the curved fabric comprising:*

*a cylindrical retainer adapted to rotate around a rotational axis that extends substantially perpendicularly relative to the sewing needle, the retainer comprising a free forward end that does not extend forwardly of the needle hole and a cylindrical retainer surface adapted to support an inner surface of the curved fabric and*

*means for pressing the curved fabric on the cylindrical retainer surface so as to retain and fix the curved fabric in position, the pressing means comprising a front edge having a configuration substantially conforming to said free forward end of said retainer,*

*a rotary member, wherein the holder device is mounted on the outer surface of the rotary member and*

*a first roller, a second roller and a third roller, each mounted in parallel with the shuttle base and supporting an inner surface of the rotary member.*

*43. A sewing machine adapted to embroider a curved fabric comprising:*

*a sewing head comprising a vertically and reciprocally driven sewing needle,*

*a shuttle base extending substantially perpendicularly relative to the sewing needle, the shuttle base comprising a shuttle that cooperates with the sewing needle to form stitches in the curved fabric using an upper thread and a lower thread,*

*a holder adapted to retain a curved fabric comprising:*

*a cylindrical retainer adapted to rotate around a rotational axis that extends substantially perpendicularly relative to the sewing needle, the retainer comprising a free forward end that does not extend forwardly of the needle hole and a cylindrical retainer surface adapted to support an inner surface of the curved fabric and*

*means for pressing the curved fabric on the cylindrical retainer surface so as to retain and fix the curved fabric in position, the pressing means comprising a front edge having a configuration substantially conforming to said free forward end of said retainer, wherein the free forward end of the retainer and the pressing means are adapted to not interfere with the needle when the pressing means fixes the curved fabric in position on the retainer and the holder is rotated with respect to the needle during an embroidery operation,*

*a rotary member, wherein the holder device is detachably mounted on the outer surface of the rotary member,*

*a first roller, a second roller and a third roller, each mounted in parallel with the shuttle base and supporting an inner surface of the rotary member and*

*an arched support plate disposed between the shuttle base and the sewing needle and extending forwardly of the free forward end of the retainer, the support plate comprising a needle slot that extends substantially in parallel with the shuttle base, wherein the needle slot is adapted to permit the needle to pass through the support plate during an embroidering operation and the support plate is adapted to support a portion of the inner surface of the curved fabric that is proximal to the area being sewn.*

*44. A sewing machine as in claim 42 or 43, wherein the first roller and the second roller extend forwardly of the free forward end of the retainer and each comprises a tapered front end adapted to support a portion of the inner surface of the curved fabric that is proximal to the area being sewn.*

*45. A sewing machine adapted to embroider a cap having a visor comprising:*

*a sewing head comprising a vertically and reciprocally driven sewing needle,*

*a shuttle base extending substantially perpendicularly relative to the sewing needle, the shuttle base comprising a shuttle that cooperates with the sewing needle to form stitches in the curved fabric using an upper thread and a lower thread,*

*a holder adapted to retain the cap comprising:*

*a cylindrical retainer adapted to rotate around a rotational axis that extends substantially perpendicularly relative to the sewing needle, the retainer comprising a free forward end that does not extend forwardly of the needle hole and a cylindrical retainer surface adapted to support an inner surface of the cap and*

*means for pressing the cap on the cylindrical retainer surface so as to retain and fix the cap in position, the pressing means comprising a front edge having a configuration substantially conforming to said free forward end of said retainer member and a belt-like resiliently flexible material having an insertion slot adapted to receive the cap visor,*

*a rotary member, wherein the holder device is mounted on the outer surface of the rotary member,*

*a first roller, a second roller and a third roller, each mounted in parallel with the shuttle base and supporting an inner surface of the rotary member and*

*an arched support plate disposed between the shuttle base and the sewing needle and extending forwardly of the free forward end of the retainer, the support plate comprising a needle slot that extends substantially in parallel with the shuttle base, wherein the needle slot is adapted to permit the needle to pass through the support plate during an embroidering operation and the support plate is adapted to support a portion of the inner surface of the curved fabric that is proximal to the area being sewn.*

*46. A sewing machine adapted to embroider a cap having a visor comprising:*

*a sewing head comprising a vertically and reciprocally driven sewing needle,*

*a shuttle base extending substantially perpendicularly relative to the sewing needle, the shuttle base comprising a shuttle that cooperates with the sewing needle to form stitches in the curved fabric using an upper thread and a lower thread,*

*a holder adapted to retain the cap comprising:*

*a cylindrical retainer adapted to rotate around a rotational axis that extends substantially perpendicularly relative to the sewing needle, the retainer comprising a free forward end constructed so as not to extend forwardly of a needle hole that receives the sewing*

*needle, a cylindrical retainer surface adapted to support an inner surface of the cap, a first support pin and a second support pin, the support pins adapted to permit the cap to be fixed to the support pins using clips and*

*means for pressing the cap on the cylindrical retainer surface so as to retain and fix the cap in position, the pressing means comprising a front edge having a configuration substantially conforming to said free forward end of a belt-like resiliently flexible material having an insertion slot adapted to receive the cap visor and said retainer member, wherein one end of the pressing means is pivotably coupled to the first support pin, and the other end of the pressing means comprises a lock adapted to couple to the second support pin,*

*a rotary member, wherein the holder device is mounted on the outer surface of the rotary member,*

*a first roller, a second roller and a third roller, each mounted in parallel with the shuttle base and supporting an inner surface of the rotary member and*

*an arched support plate disposed between the shuttle base and the sewing needle and extending forwardly of the free forward end of the retainer, the support plate comprising a needle slot that extends substantially in parallel with the shuttle base, wherein the needle slot is adapted to permit the needle to pass through the support plate during an embroidering operation and the support plate is adapted to support a portion of the inner surface of the cap that is proximal to the area being sewn.*

*47. A sewing machine adapted to embroider a cap having a visor comprising:*

*a sewing head comprising a vertically and reciprocally driven sewing needle,*

*a shuttle base extending substantially perpendicularly relative to the sewing needle, the shuttle base comprising a shuttle that cooperates with the sewing needle to form stitches in the curved fabric using an upper thread and a lower thread,*

*a holder adapted to retain to the cap comprising:*

*a cylindrical retainer adapted to rotate around a rotational axis that extends substantially perpendicularly relative to the sewing needle, the retainer comprising a free forward end constructed so as not to extend forwardly of a needle hole that receives the sewing needle, a cylindrical retainer surface adapted to support an inner surface of the cap, a flange and a first support pin and a second support pin fixed to the flange, the support pins adapted to support the inner surface of the cap and*

*means for pressing the cap on the cylindrical retainer surface so as to retain and fix the cap in position, the pressing means comprising a belt-like resiliently flexible material having an insertion slot adapted to receive the cap visor and a front edge having a configuration substantially conforming to said free forward end of said retainer member, wherein one end of the pressing means is pivotably coupled to the first support pin, and the other end of the pressing means comprises a lock adapted to couple to the second support pin, the insertion slot comprising a set of teeth adapted to secure the cap to the retainer,*

*a rotary member, wherein the holder device is detachably mounted on the outer surface of the rotary member,*

*a first roller, a second roller and a third roller, each mounted in parallel with the shuttle base and supporting an inner surface of the rotary member and*

*an arched support plate disposed between the shuttle base and the sewing needle and extending forwardly of the free forward end of the retainer, the support plate comprising a needle slot that extends substantially in parallel with the shuttle base, wherein the needle slot is adapted to permit the needle to pass through the support plate during an embroidering operation and the support plate is adapted to support a portion of the inner surface of the curved fabric that is proximal to the area being sewn.*

*48. A sewing machine as in claim 45, 46 or 47, wherein the first roller and the second roller extend forwardly of the free forward end of the retainer and each comprises a tapered front end adapted to support a portion of the inner surface of the curved fabric that is proximal to the area being sewn.*

*49. A sewing machine adapted to form stitches on a curved fabric, comprising:*

*a sewing head comprising a vertically reciprocally driven needle,*

*a shuttle base extending substantially perpendicularly relative to the sewing needle, the shuttle base comprising a shuttle that cooperates with the sewing needle to form stitches in the curved fabric using an upper thread and a lower thread,*

*holder means for retaining the curved fabric, the holder means having a supporting surface adapted to support an inner surface of the curved fabric, the supporting surface having a circumference that substantially corresponds to the circumference of the curved fabric,*

*support means for rotatably supporting the holder means within a plane in parallel to an X axis, the support means being movable in a Y axis direction and comprising:*

*a rotary member, wherein the holder means is detachably mounted on the outer surface of the rotary member and*

*a plurality of rollers mounted in parallel with the shuttle base and supporting an inner surface of the rotary member, wherein the rotary member is adapted to rotate about the X axis and the X axis and the Y axis are perpendicular to each other within a plane extending substantially perpendicular to the driving direction of the needle,*

*X axis drive means for rotating the holder means within the plane in parallel to the X axis, wherein the X axis drive means is operable to rotate the holder means by about at least one revolution and*

*Y axis drive means for moving the support means in the Y axis direction, so that the holder means is moved in the Y axis direction when the support means is moved in the Y axis direction.*

*50. A sewing machine as in claim 49 further comprising an arched support plate disposed between the shuttle base and the sewing needle and comprising a needle slot that extends substantially in parallel with the shuttle base, wherein the needle slot is adapted to permit the needle to pass through the support plate during an embroidering operation and the support plate is adapted to support a portion of the inner surface of the curved fabric that is proximal to the area being sewn.*

*51. A sewing machine as in claim 50, wherein the X axis drive means comprises a cord wrapped around the rotary member, wherein the cord causes the support means and the holder means to rotate relative to the arched support plate.*

*52. A sewing machine as in claim 49 wherein the support means further comprises a plate, and a plurality of guide*

*members fixed to the plate and adapted to permit rotation of the rotary member.*

*53. A sewing machine adapted to form stitches on a curved fabric, comprising:*

*a sewing head comprising a vertically reciprocally driven needle,*

*a shuttle base extending substantially perpendicularly relative to the sewing needle, the shuttle base comprising a shuttle that cooperates with the sewing needle to form stitches in the curved fabric using an upper thread and a lower thread,*

*holder means for retaining the curved fabric, the holder means having a supporting surface for supporting an inner surface of the curved fabric, the supporting surface having a circumference that substantially corresponds to the circumference of the curved fabric,*

*support means for rotatably supporting the holder means within a plane in parallel to an X axis, the support means movable in a Y axis direction, wherein the X axis and the Y axis are perpendicular to each other within a plane extending substantially perpendicular to the driving direction of the needle,*

*X axis drive means for rotating the holder means within the plane in parallel to the X axis, wherein the X axis drive means is operable to rotate the holder means by about at least one revolution,*

*Y axis drive means for moving the support means in the Y axis direction, so that the holder means is moved in the Y axis direction when the support means is moved in the Y axis direction and*

*an arched support plate disposed between the shuttle base and the sewing needle and comprising a needle slot that extends substantially in parallel with the shuttle base, wherein the needle slot is adapted to permit the needle to pass through the support plate during an embroidering operation and the support plate is adapted to support a portion of the inner surface of the curved fabric that is proximal to the area being sewn.*

*54. A sewing machine as in claim 53, wherein the X axis drive means comprises a cord wrapped around the support means, wherein the cord causes the support means and the holder means to rotate relative to the arched support plate.*

*55. A sewing machine as in any one of claims 49–54, wherein the curved fabric is a cap having a visor and the holder means comprises:*

*a retainer adapted to rotate around a rotational axis that is substantially perpendicular to the moving direction of the needle, the retainer comprising a cylindrical retainer surface for supporting an inner surface of the cap and a free forward end positioned rearwardly of the moving direction of the needle, and*

*a belt-like resiliently flexible material adapted to be pressed and tightened around the cap, whereby the cap is fixed in position with respect to the retainer.*

*56. A sewing machine as in claim 55, wherein the belt-like resiliently flexible material comprises an insertion slot adapted to receive the visor.*

*57. A sewing machine as in claim 56, wherein the belt-like resiliently flexible material further comprises a plurality of teeth adapted to enage the cap when the belt-like resiliently flexible material is tightened around the cap.*

*58. A sewing machine as in claim 57, wherein the belt-like resiliently flexible material further comprises engaging means disposed between the belt-like resiliently flexible material and the retainer for preventing the belt-like resiliently flexible material from moving in the direction of the rotational axis when the belt-like resiliently flexible material is tightened to press the cap on the retainer.*

*59. A sewing machine as in claim 55 wherein the arched support plate extends forwardly of the holder means.*

*60. A sewing machine as in claim 55 wherein the holder means further comprises a flange and a first support pin and a second support pin fixed to the flange, the support pins adapted to support the inner surface of the cap.*

*61. A sewing machine adapted to form stitches on a flat fabric and a curved fabric, comprising:*

*a machine table having an elevator adapted to move in a vertical direction,*

*an embroidery frame adapted to support the flat fabric in a flat fabric embroidery operation mode, the embroidery frame disposed above the machine table and adapted to move together with the machine table,*

*a sewing head disposed above the embroidery frame and comprising a vertically reciprocally driven needle,*

*a shuttle base extending substantially perpendicularly relative to the sewing needle and substantially in parallel with the embroidery frame, the shuttle base comprising a shuttle that cooperates with the sewing needle to form stitches using an upper thread and a lower thread,*

*holder means for retaining the curved fabric, the holder means having a supporting surface adapted to support an inner surface of the curved fabric in a curved fabric embroidery operation mode, the supporting surface having a circumference that substantially corresponds to the circumference of the curved fabric,*

*support means for rotatably supporting the holder means in the curved fabric embroidery operation mode within a plane in parallel to an X axis, the support means movable in a Y axis direction, wherein the X axis and the Y axis are perpendicular to each other within a plane extending substantially perpendicularly to the driving direction of the needle,*

*X axis drive means for moving the embroidery frame in the direction of the X axis, wherein in the curved fabric embroidery operation mode, the X axis drive means comprises:*

*a cord wound around the support means and the holder means and*

*means for rotating the support means and the holder means in a direction parallel to the X axis in response to movement of the embroidery frame in the direction of the X axis, the X axis drive means being operable to rotate the holder means by about at least one revolution, and*

*Y axis drive means for moving the embroidery frame in the Y axis direction and in the curved fabric embroidery operation mode, the Y axis drive means causes the support means and the holder means to move in the Y axis direction,*

*wherein the embroidery frame is adapted to be disposed below the shuttle base to permit the holder means, support means and cord to be mounted on the sewing machine for the curved embroidery operation mode and*

*wherein the machine table is adapted to rise and to be flush with a top surface of the shuttle base for the flat fabric operation mode and the support means and cord are adapted to be removed from the sewing machine for the flat fabric embroidery operation.*

*62. A sewing machine as in claim 61 further comprising an arched support plate disposed between the shuttle base*

*and the sewing needle and comprising a needle slot that extends substantially in parallel with the shuttle base, wherein the needle slot is adapted to permit the needle to pass through the support plate in the curved fabric embroidering operation mode and the support plate is adapted to support a portion of the inner surface of the curved fabric that is proximal to the area being sewn, wherein the support plate is adapted to be removed from the sewing machine in the flat fabric embroidery operation mode.*

*63. A sewing machine as in claim 62, wherein the support plate extends forwardly of the holder means.*

*64. A sewing machine as in claims 61–63, wherein in the curved fabric embroidery operation mode, the support means comprises:*

*a rotary member, wherein the holder means is detachably mounted on the outer surface of the rotary member and*

*a plurality of rollers mounted in parallel with the shuttle base and supporting an inner surface of the rotary member.*

*65. A holder adapted to retain a curved fabric, whereby an upper thread and a lower thread can form stitches in the curved fabric through cooperation of a shuttle and a sewing needle, the sewing needle being vertically and reciprocally driven by a sewing machine, comprising:*

*a retainer member adapted to rotate around a rotational axis that extends substantially perpendicularly relative to the moving direction of the sewing needle, the retainer comprising a free forward end constructed so as not to extend forwardly of the driving path of the sewing needle and a needle hole that receives the sewing needle and a retainer surface adapted to support an inner surface of the curved fabric,*

*an auxiliary retainer member connected to the free forward end of the retainer member via an arm, the auxiliary retainer member is disposed forwardly of the needle hole, has an auxiliary retainer surface adapted to support the inner surface of the curved fabric at a position forwardly of the needle hole and is spaced from said free forward end of said retainer member, wherein the retainer surface and the auxiliary retainer surface each have a circumference that substantially corresponds to the circumference of the curved fabric and*

*means for pressing the curved fabric on the retainer surface and the auxiliary retainer surface so as to retain and fix the curved fabric in position.*

*66. A holder as in claim 65, wherein the pressing means comprises two pressing rings.*

*67. A holder as in claim 65, wherein the pressing means comprises a substantially rectangular frame.*

*68. A holder as in claim 29, 30, 36, 47 or 60, wherein the support pins are further adapted to permit the cap to be fixed to the support pins using clips.*

*69. A holder as in claim 33, wherein the support pins are further adapted to permit the curved fabric to be fixed to the support pins using clips.*

*70. A sewing machine as in claim 47, wherein the support pins extend forwardly substantially the same distance as the arched support plate.*

*71. A sewing machine as in claim 52, wherein said rotary member further comprises a flange, the flange being disposed within the guide members.*

*72. A sewing machine as in claim 51, wherein the cord is attached to the rotary member.*

*73. A sewing machine as in claim 51, wherein the rotary member has an annular recess adapted to receive the cord.*

*74. A sewing machine as in claim 73, wherein a cord fixing member attaches the cord to the rotary member.*

*75. A sewing machine as in claim 54 or 61, wherein the cord is attached to the support means.*

*76. A sewing machine as in claim 51, wherein the support means has an annular recess adapted to receive the cord.*

*77. A sewing machine as in claim 76, wherein a cord fixing member attaches the cord to the support means.*

* * * * *